US005315980A

United States Patent [19]

Otsuka et al.

[11] Patent Number: 5,315,980

[45] Date of Patent: May 31, 1994

[54] MALFUNCTION DETECTION APPARATUS FOR DETECTING MALFUNCTION IN EVAPORATIVE FUEL PURGE SYSTEM

[75] Inventors: Takayuki Otsuka; Akinori Osanai; Takaaki Itoh; Yoshihiko Hyodo; Toru Kidokoro, all of Susono, Japan

[73] Assignee: Toyota Jidosha Kabushiki Kaisha, Aichi, Japan

[21] Appl. No.: 6,113

[22] Filed: Jan. 15, 1993

[30] Foreign Application Priority Data

| | | | |
|---|---|---|---|
| Jan. 17, 1992 | [JP] | Japan | 4-6372 |
| Jul. 23, 1992 | [JP] | Japan | 4-197220 |
| Aug. 7, 1992 | [JP] | Japan | 4-211790 |
| Aug. 10, 1992 | [JP] | Japan | 4-212938 |
| Aug. 11, 1992 | [JP] | Japan | 4-214384 |

[51] Int. Cl.[5] ..... F02M 33/02

[52] U.S. Cl. ..... 123/520; 123/198 D

[58] Field of Search ..... 123/516, 518, 519, 520, 123/198 D

[56] References Cited

U.S. PATENT DOCUMENTS

| | | | |
|---|---|---|---|
| 4,926,825 | 5/1990 | Ohtaka et al. | 123/520 |
| 4,949,695 | 8/1990 | Uranishi et al. | 123/520 |
| 5,143,035 | 9/1992 | Kayanuma | 123/198 D |
| 5,143,040 | 9/1992 | Okawa et al. | 123/520 |
| 5,146,902 | 9/1992 | Cook et al. | 123/520 |
| 5,150,686 | 9/1992 | Okawa et al. | 123/520 |
| 5,158,054 | 10/1992 | Otsuka | 123/520 |
| 5,186,153 | 2/1993 | Steinbrenner et al. | 123/520 |
| 5,191,870 | 3/1993 | Cook | 123/198 D |
| 5,193,512 | 3/1993 | Steinbrenner et al. | 123/520 |
| 5,205,263 | 4/1993 | Blumenstock et al. | 123/518 |
| 5,216,997 | 6/1993 | Osanai et al. | 123/520 |
| 5,220,896 | 6/1993 | Blumenstock et al. | 123/198 D |
| 5,249,561 | 10/1993 | Thompson | 123/520 |
| 5,261,379 | 11/1993 | Lipinski et al. | 123/198 D |

FOREIGN PATENT DOCUMENTS

| | | |
|---|---|---|
| 102360 | 4/1990 | Japan . |
| 130255 | 5/1990 | Japan . |
| 26862 | 2/1991 | Japan . |
| 171169 | 2/1991 | Japan . |
| 249364 | 11/1991 | Japan . |
| 503844 | 7/1992 | Japan . |

OTHER PUBLICATIONS

WO 9112426 (PCT) Aug. 1991.

WO 9116216 (PCT) Oct. 1991.

*Primary Examiner*—Noah P. Kamen

*Assistant Examiner*—Thomas N. Moulis

*Attorney, Agent, or Firm*—Kenyon & Kenyon

[57] ABSTRACT

A malfunction detection apparatus for detecting a malfunction in an evaporative fuel purge system, which malfunction detection apparatus is able to suppress a fluctuation of an air-fuel ratio. A negative pressure inside an intake passage is introduced into the evaporative fuel purge system. The existence/nonexistence of a malfunction in the evaporative fuel purge system is determined by using pressure values inside the evaporative fuel purge system which values are detected and supplied by a pressure detecting unit. The apparatus is provided with an air-fuel ratio fluctuation suppressing unit for suppressing a fluctuation of the air-fuel ratio of air suctioned into an engine when introducing the negative pressure into the evaporative fuel purge system.

18 Claims, 41 Drawing Sheets

A
B
LEAK DETERMINING TIMER = 0 ?
P112
YES
NO
STORE Ps
P113
LEAK DETERMINING TIMER = α sec. ?
P116
YES
NO
STORE LEAK DETERMINING TIMER
P114
STORE PE
P117
COMPUTE (PE - Ps) / α
P118
RATE OF CHANGE ≧ β ?
P119
YES
NO
SET LEAK DETECTING FLAG
P115
TURN ON WARNING LAMP
P120
STORE LEAK FAIL CODE
P121
OPEN CANISTER VSV
P122
CLEAR LEAK DETERMINING TIMER
P123
SET EXECUTION FLAG
P124
CLEAR LEAK DETECTING FLAG
P125
END

MALFUNCTION DETECTION APPARATUS FOR DETECTING MALFUNCTION IN EVAPORATIVE FUEL PURGE SYSTEM

BACKGROUND OF THE INVENTION (1) Field of the Invention

The present invention is generally related to a malfunction detection apparatus, and more particularly to an apparatus for detecting a malfunction in an evaporative fuel purge system which is provided in an internal combustion engine for temporarily adsorbing evaporative fuel, or fuel vapor, in an adsorbent in a canister and for purging the fuel vapor into an intake system of the internal combustion engine under given operating conditions, so that an air-fuel mixture is fed into a combustion chamber in the internal combustion engine.

(2) Description of the Related Art

Generally, the fuel vapor evaporated in the fuel tank is adsorbed by the adsorbent in the canister so as to prevent escaping of the fuel to the atmosphere. However, the amount of fuel adsorbed in the canister is limited because the capacity of the canister is limited. Therefore, there is a fuel vapor purge system that purges the fuel vapor adsorbed in the canister to an intake system of the engine in order to prevent overflow of fuel in the canister. The fuel vapor flows through a purge passage connecting the canister to the intake system of the engine and is purged to the inside of the intake system by a vacuum pressure generated by the engine operation. A purge control valve is usually provided to the purge passage to control the timing of the purging.

In this evaporative fuel purge system there is a possibility that the fuel in the canister overflows or that the fuel leaks to the atmosphere when a malfunction such as a fracture or a disconnection of the vapor line occurs. For this reason, an evaporative fuel purge system having a malfunction detection system is required.

In the Japanese Patent Application No. 3-138002, the applicant of the present invention suggested a malfunction detection apparatus for detecting a malfunction in an evaporative fuel purge system. In this apparatus, a negative pressure generated in an intake line of an internal combustion engine is introduced to a fuel tank and then the entire evaporative fuel purge system is put in a sealed condition. Existence/nonexistence of a malfunction is detected by monitoring a rate of change of the negative pressure inside the evaporative fuel purge system for a predetermined period of time. In the Japanese Patent Application No. 3-323364, the applicant of the present invention also suggested a malfunction detection apparatus in which existence/nonexistence of a malfunction is determined by monitoring a negative pressure inside an evaporative fuel purge system. In this apparatus, a bypass passage is provided between a vapor introducing hole of a canister and a purge passage, and a pressure sensor is also provided to a passage between the vapor introducing hole and a fuel tank. Specifically, existence/nonexistence of a malfunction is detected by monitoring a negative pressure detected by means of the pressure sensor when a control valve, provided to the bypass passage, is opened in order to introduce to the fuel tank a negative pressure generated inside an intake line of an internal combustion engine.

However, in the above mentioned malfunction detection apparatus suggested by the applicant, due to the introduction of a negative pressure generated inside an intake line, in addition to fuel vapor released from an adsorbent in the canister being purged into the intake line, fuel vapor from the fuel tank is also purged into the intake line via the canister.

Particularly in an internal combustion engine having an electronic fuel injection control system, a feedback control of an air-fuel ratio is performed so as to obtain the stoichiometric air-fuel ratio of the mixture to be suctioned into the engine. This feedback control is performed by correcting a basic fuel-injection time computed based on the rotation speed of the engine and the suction air amount (or a pressure inside the intake pipe) based on oxygen concentration in an exhaust gas as detected by an oxygen sensor provided in an exhaust pipe of the engine. However, despite the above mentioned air-fuel ratio feedback-control, the air-fuel ratio may temporarily be on the fuel-rich side of the stoichiometric ratio as a large amount of fuel vapor is suctioned into the intake line due to the introduction of the negative pressure.

Hence the above mentioned malfunction detection apparatuses suggested by the applicant cannot obtain an advantage of reduction in hydrocarbon (HC) and carbon monoxide (CO) in the exhaust gas performed by a catalytic converter because a large amount of fuel vapor is added to the basic fuel-injection amount due to the introduction of the negative pressure.

SUMMARY OF THE INVENTION

It is a general object of the present invention to provide a malfunction detection apparatus for detecting a malfunction of an evaporative fuel purge system in which malfunction detection apparatus the above mentioned disadvantages are eliminated.

A more specific object of the present invention is to provide a malfunction detection apparatus for detecting a malfunction of an evaporative fuel purge system in which suction of a large amount of fuel vapor is prevented when a negative pressure, generated inside an intake line, is introduced to the evaporative fuel purge system.

In order to achieve the above mentioned objects, a malfunction detection apparatus according to the present invention comprises:

an evaporative fuel purge system having a fuel tank storing an amount of fuel, a canister storing fuel vapor generated in a fuel tank, a vapor passage connecting the fuel tank and the canister, a purge passage through which the fuel vapor stored in the canister is purged into an intake passage of an engine, and a purge control valve provided on the purge passage to allow a purge operation by opening of the purge control valve;

a pressure introducing means for introducing a negative pressure from the intake passage of the engine into the evaporative fuel purge system;

a pressure detecting means for detecting a pressure inside the evaporative fuel purge system when the negative pressure is introduced into the system by the pressure introducing means;

an air-fuel ratio fluctuation suppressing means for suppressing a fluctuation of the air-fuel ratio of mixture gas suctioned into the engine, the suppression effected by controlling the pressure introducing means when the negative pressure is into the evaporative fuel purge system; and a determining means for determining the existence or nonexistence of a malfunction in the evaporative fuel purge system by monitoring a pressure inside the evaporative fuel purge system the monitoring using values supplied by the pressure detecting means.

According to the present invention, due to provision of an air-fuel ratio fluctuation suppressing means, a fluctuation of the air-fuel ratio due to the introduction of a negative pressure is prevented. Thus, a preferred exhaust emission state is well maintained.

Other objects, features and advantages of the present invention will become more apparent from the following detailed description when read in conjunction with the accompanying drawings.

DETAILED DESCRIPTION OF THE PREFERRED EMBODIMENTS

Figure 1:
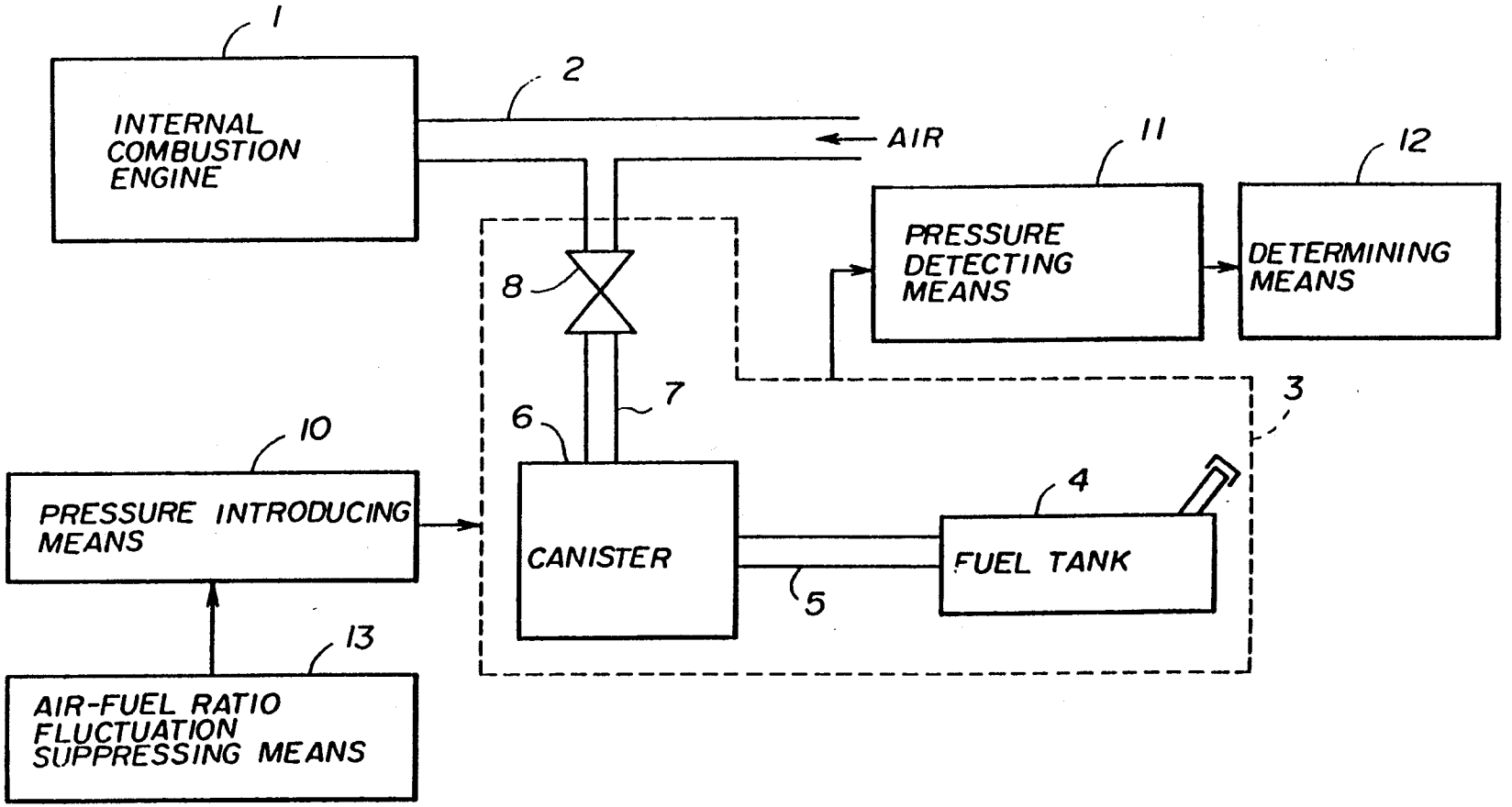
FIG. 1 is a block diagram for explaining the basic structure of the malfunction detection apparatus according to the present invention.

A description will now be given of a basic structure of a malfunction detection apparatus for detecting a malfunction in an evaporative fuel purge system according to the present invention. FIG. 1 is a block diagram for explaining the basic structure of the malfunction detection apparatus according to the present invention.

The malfunction detection apparatus according to the structure shown in FIG. 1 comprises an evaporative fuel purge system 3 comprising a fuel tank 4, a vapor passage 5, a canister 6, a purge passage 7, and a purge control valve 8. Fuel vapor evaporated in the fuel tank 4 is adsorbed after flowing through the vapor passage 5 by an adsorbent in the canister. The fuel vapor in the canister 6 is purged into an intake passage 2 of an internal combustion engine 1 via the purge passage 7 and a purge control valve 8 under a given operating condition of the engine.

The apparatus further comprises a pressure introducing means 10, a pressure detecting means 11, a determining means 12, and an air-fuel ratio fluctuation suppressing means 13. The pressure introducing means mainly controls the purge valve 8 so as to introduce a negative pressure inside the intake line 2 under a given condition.

The pressure detecting means 11 detects a pressure inside the system 3, when the pressure inside the intake line 2 is introduced to the system 3. The determining means 12 monitors a rate of pressure change inside the system based on the pressure detected by the pressure detecting means 11 and determines existence/nonexistence of a malfunction of the evaporative fuel purge system 3. The air-fuel ratio fluctuation suppressing means 13 controls the introduction of negative pressure to the system 3 so as to suppress fluctuation of the air-fuel ratio when the negative pressure is introduced into the system 3, which fluctuation results in a large amount of the fuel vapor flowing into the intake line 2.

Figure 2:
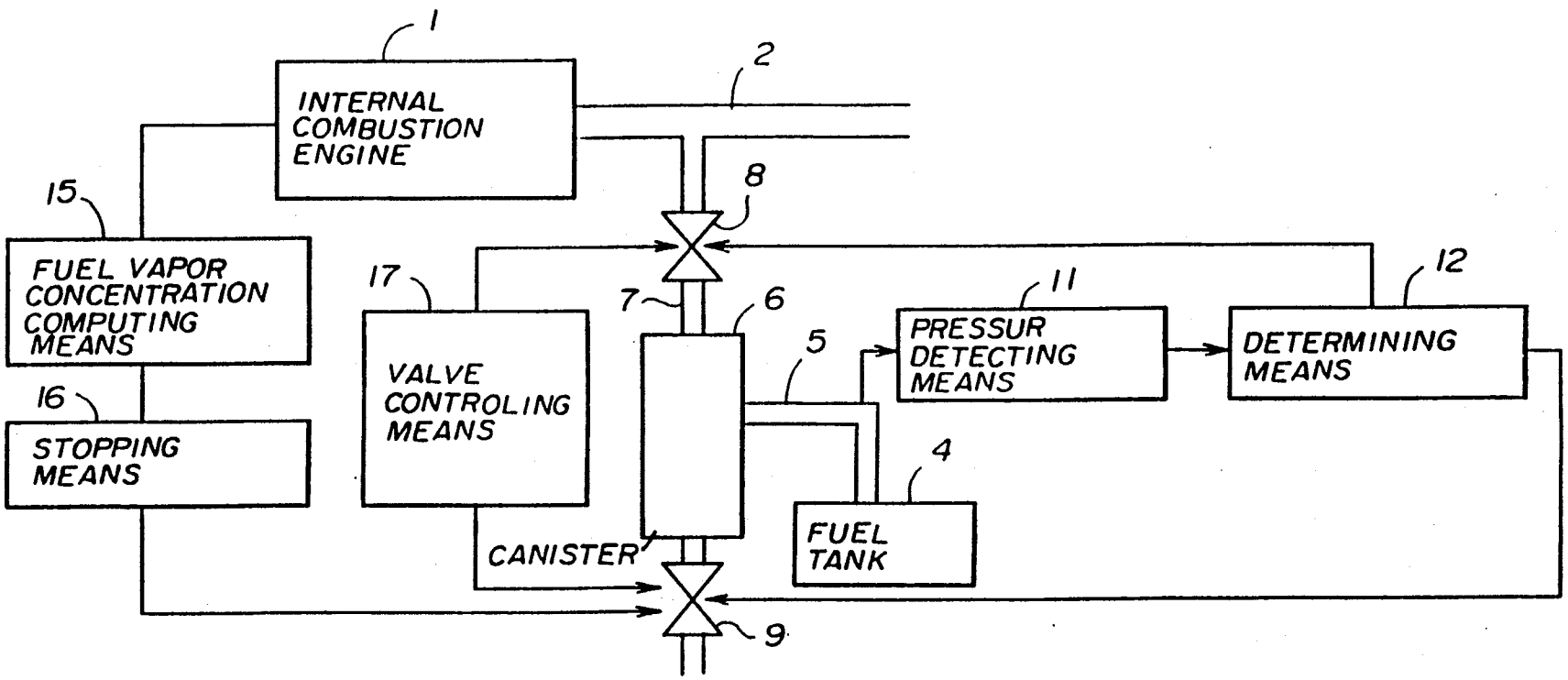
FIG. 2 is a block diagram for explaining a structure of a first embodiment of the malfunction apparatus according to the present invention.

A description will now be given of a first embodiment of the malfunction detection apparatus according to the present invention. FIG. 2 is a block diagram for explaining a structure of the first embodiment of the malfunction apparatus according to the present invention. In FIG. 2, parts that are the same as parts shown in FIG. 1 are given the same reference numerals from figure to figure, and descriptions thereof will be omitted.

The malfunction detection apparatus according to the structure shown in FIG. 2 comprises the evaporative fuel purge system 3 including a canister control valve 9, a pressure detecting means 11, a determining means 12, a fuel vapor concentration computing means 15, a stopping means 16, and valve controlling means 17.

The valve control means 17 closes the canister control valve 9 and opens the purge control valve 8 in order to introduce a pressure inside the intake line 2 to the system 3. The aforementioned pressure introducing means shown in FIG. 1 comprises the valve control means 17, the purge control valve 8, and the canister valve 9.

The fuel vapor concentration computing means 15 detects a concentration of the fuel vapor inside the system 3, which fuel vapor is suctioned into the intake line 2 when the negative pressure inside the intake line 2 is introduced to the system 3. When the concentration computed by the fuel vapor concentration computing means 15 is less than a predetermined value, the negative pressure is introduced into the system 3. The determining means 12 then closes the purge control valve 8 and the canister control valve 9. Then the determining means 12 observes a rate of pressure change inside the system and determines existence/nonexistence of a malfunction of the evaporative fuel purge system. The stopping means 16 stops the introduction of the negative pressure to the system when the concentration computed by the fuel vapor concentration computing means 15 exceeds the predetermined value. A combination of the fuel vapor concentration computing means 15 and the stopping means 16 corresponds to the air-fuel ratio fluctuation suppressing means 13 of FIG. 1.

In the first embodiment of the present invention, the fuel vapor inside the system is suctioned into the intake line 2, in accordance with a start of the malfunction detecting operation, upon opening of the purge control valve 8 operated by the valve control means 17. The detecting means 14 detects the concentration of fuel vapor at this time. Due to the provision of the stopping means 16, flowing of an excessive amount of fuel vapor into the intake line 2 is prevented, and determining of existence/nonexistence of a malfunction performed by the determining means is stopped.

Figure 3:
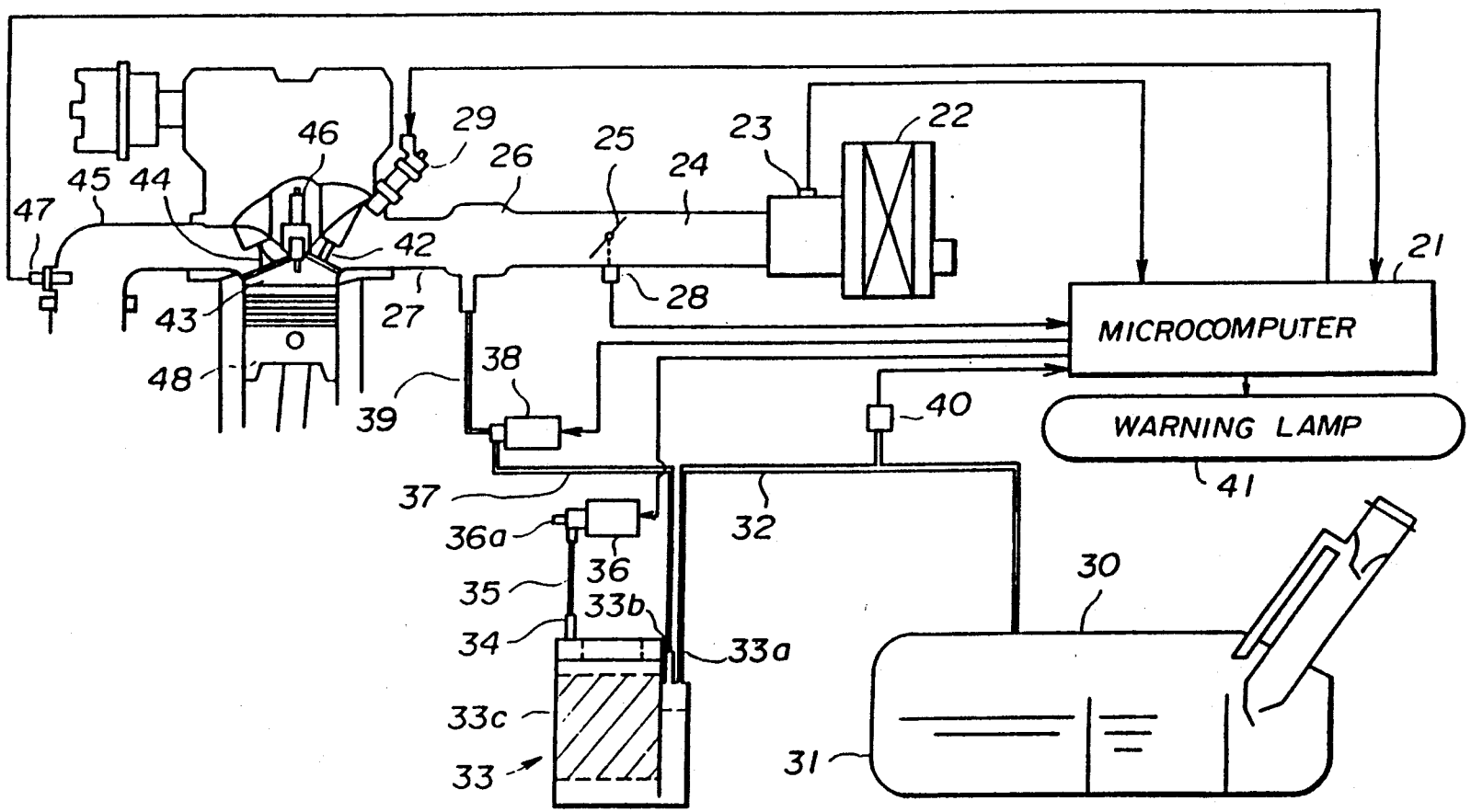
FIG. 3 is a schematic illustration of a construction of the first embodiment according to the present invention.

FIG. 3 is a schematic illustration of a first embodiment of the malfunction detection apparatus according to the present invention. An amount of air passes through an air cleaner 22 where dust contained in the air is trapped and a flow amount of the air is measured by a flow meter 23. The flow amount of the air is controlled by a throttle valve 25 provided inside an intake pipe 24. Then the air is suctioned into a combustion chamber 43 of an internal combustion engine via a surge tank 26 and an intake manifold 27. The aforementioned intake passage 14 comprises the intake pipe 24, the surge tank 26, and the intake manifold 27.

An opening of the throttle valve is controlled by an acceleration pedal not shown in the figure, and a degree of the opening is detected by a throttle position sensor 28. A fuel injection valve 29 is mounted on each of cylinders 43 so that a portion of the fuel injection valve 29 protrudes inside the intake manifold 27. The fuel injection valve 29 injects an amount of fuel 31 stored in a fuel tank 30 into the air flowing inside the intake manifold 27, the fuel injection lasting for a period of time as directed by a microcomputer 21.

The combustion chamber 43 is connected to an exhaust manifold 45 via an exhaust valve 44. An ignition plug 46 is provided to the engine so that an electrode of the ignition plug 46 protrudes inside the combustion chamber 43. A piston 48 reciprocates up and down in the figure. An oxygen concentration sensor 47 ($O_2$ sensor), which detects an oxygen concentration contained in exhaust gas, is provided such that a sensing portion of the sensor 47 protrudes into the exhaust manifold 45.

The fuel tank 30 corresponds to the aforementioned fuel tank 10 of FIG. 1, and the fuel tank 30 stores an amount of fuel 31. Fuel vapor generated in the fuel tank 30 flows into a canister 33, corresponding to the canister 12 of FIG. 1, via a vapor passage 32, which corresponds to the vapor passage 11 of FIG. 1. The canister 33 contains an adsorbent such as an activated carbon 33*c*, and the canister 33 is provided with an air inlet port 34.

The air inlet port 34 is connected to a vacuum switching valve (VSV) 36 via an air passage 35. The canister VSV 36 is provided with an air introducing port 36*a*, and the VSV 36 opens and closes a passage between the air passage 35 and the air introducing port 36*a* based on control signals from the micro computer 21. The VSV 36 corresponds to the canister control valve 9 of FIG. 2.

Additionally, a purge port of the canister 33 is connected to a purge VSV 38 via a purge passage 37. Another purge passage 39 is connected to the VSV 38 and the other end of the purge passage 39 is connected to the surge tank 26 of the intake line. The VSV 38 opens or closes a passage between the purge passage 37 and the purge passage 39 based on control signals by the micro computer 21. The VSV 38 corresponds to the purge control valve 8 of FIG. 2.

A pressure sensor 40, provided on the vapor passage 32 which connects a vapor introducing port 33*a* of the canister 33 and the fuel tank 30, detects a pressure inside the fuel tank 30 by detecting a pressure inside the vapor passage 32. A warning lamp 41 is provided so that an operator is warned of an occurrence of a malfunction when the microcomputer 21 detects the malfunction.

In the above mentioned construction, release to the atmosphere of the fuel vapor generated inside the fuel tank 30 is prevented due to adsorption of the fuel vapor, which flows into the canister via the vapor passage 32, by the activated carbon in the canister 33. Normally, the VSV 36 and the VSV 38 are opened during an operation of the evaporative fuel purge system. Accordingly, due to a negative pressure inside the intake manifold 27, which pressure is generated during operation of the engine, air is introduced into the canister 33 from the air introducing port 36*a* via the VSV 36, the air passage 35, and the air inlet port 34.

Then the fuel vapor adsorbed by the activated carbon 33*c* is released and the fuel vapor is suctioned into the surge tank 26 via the purge passage 37, the VSV 38, and the purge passage 39. The activated carbon is reactivated by the release of the fuel vapor.

Figure 4:
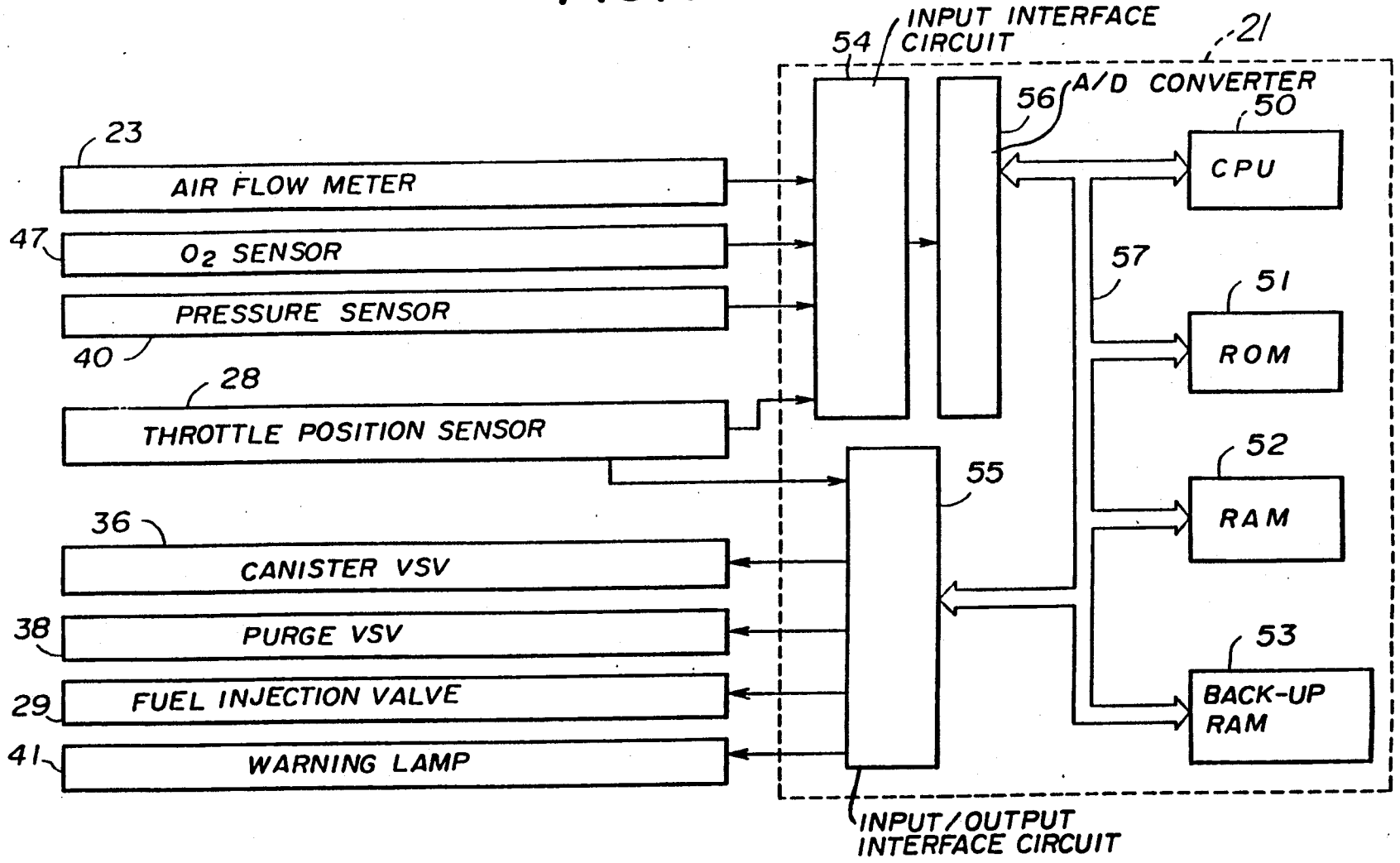
FIG. 4 is a block diagram of a microcomputer of the first embodiment shown in FIG. 3.

The microcomputer 21, having a known hardware structure shown in FIG. 4, realizes the aforementioned valve control means 17, detecting means 14, determining means 15, and stopping means 16 by means of a software process. In FIG. 4, parts that are the same as parts shown in FIG. 3 are given the same reference numerals from figure to figure, and descriptions thereof will be omitted.

The microcomputer 21 comprises a central processing unit (CPU) 50, a read only memory (ROM) 51 which stores processing programs, a random access memory (RAM) 52 which is used as a processing area, a back-up RAM 53 which holds data after the engine stops, an input interface circuit 54, an A/D converter 56 provided with a multiplexer, an input/output interface circuit 55, and a bus 57 which interconnects the above parts.

The A/D converter 56 reads, by switching, signals supplied via the input interface circuit 54 by the air flow meter 23, the throttle position sensor 28, the pressure sensor 40, and $O_2$ sensor 47. The signals are converted from analog signals to digital signals by the A/D converter 56 and are then output to the bus 57.

The input/output interface circuit 55 is supplied with a signal by the throttle position sensor 28, and the input/output interface circuit 55 sends the signal to the CPU 50 via the bus 57. Additionally, the input/output interface circuit 55 selectively sends each signal input via the bus 57 to the fuel injection valve 29, the VSV 36, the VSV 38 and the warning lamp 41 so as to control them.

Figure 5A:
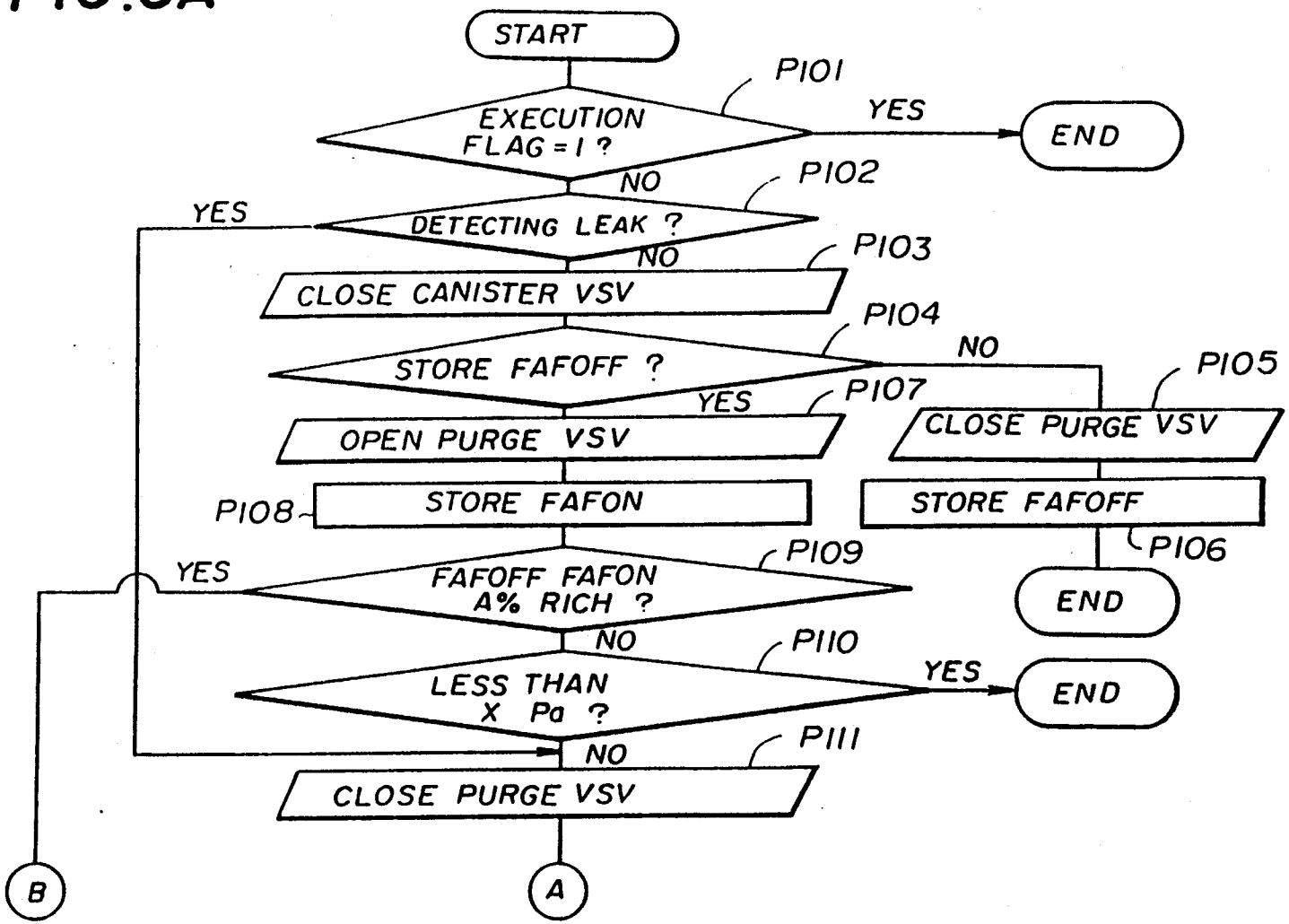
FIGS. 5A and 5B are parts of a flow chart for explaining an essential part of the first embodiment of according to the present invention.
Figure 5B:
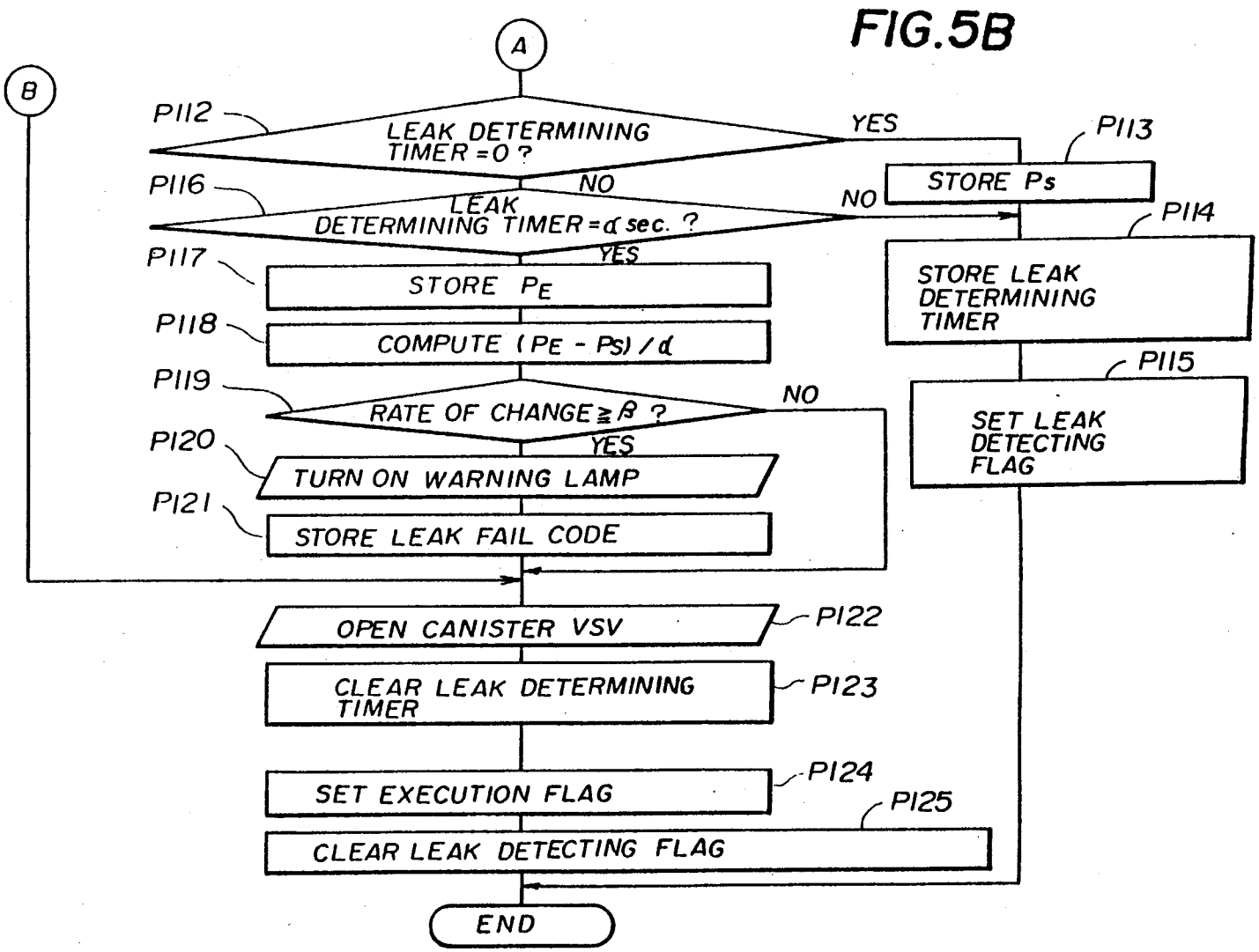

The CPU 50 of the microcomputer 21 executes a following process, as shown in the flow charts of FIGS. 5A and 5B, in accordance with the program stored in the ROM 51.

FIGS. 5A and 5B are flow charts for explaining an operation of an essential part of the first embodiment. The valve control means 17, a part of the detecting means 14, the determining means 15, and the stopping means 16 are realized by the procedure shown in FIGS. 5A and 5B. It should be noted that the rest of the detecting means 14, that is of the detection of fuel vapor concentration in the system, is performed by using an air-fuel ratio (A/F) feedback correction factor FAF computed in an A/F feedback control routine shown in FIG. 6, which routine is performed separately from the routine shown in FIGS. 5A and 5B.

Figure 6:
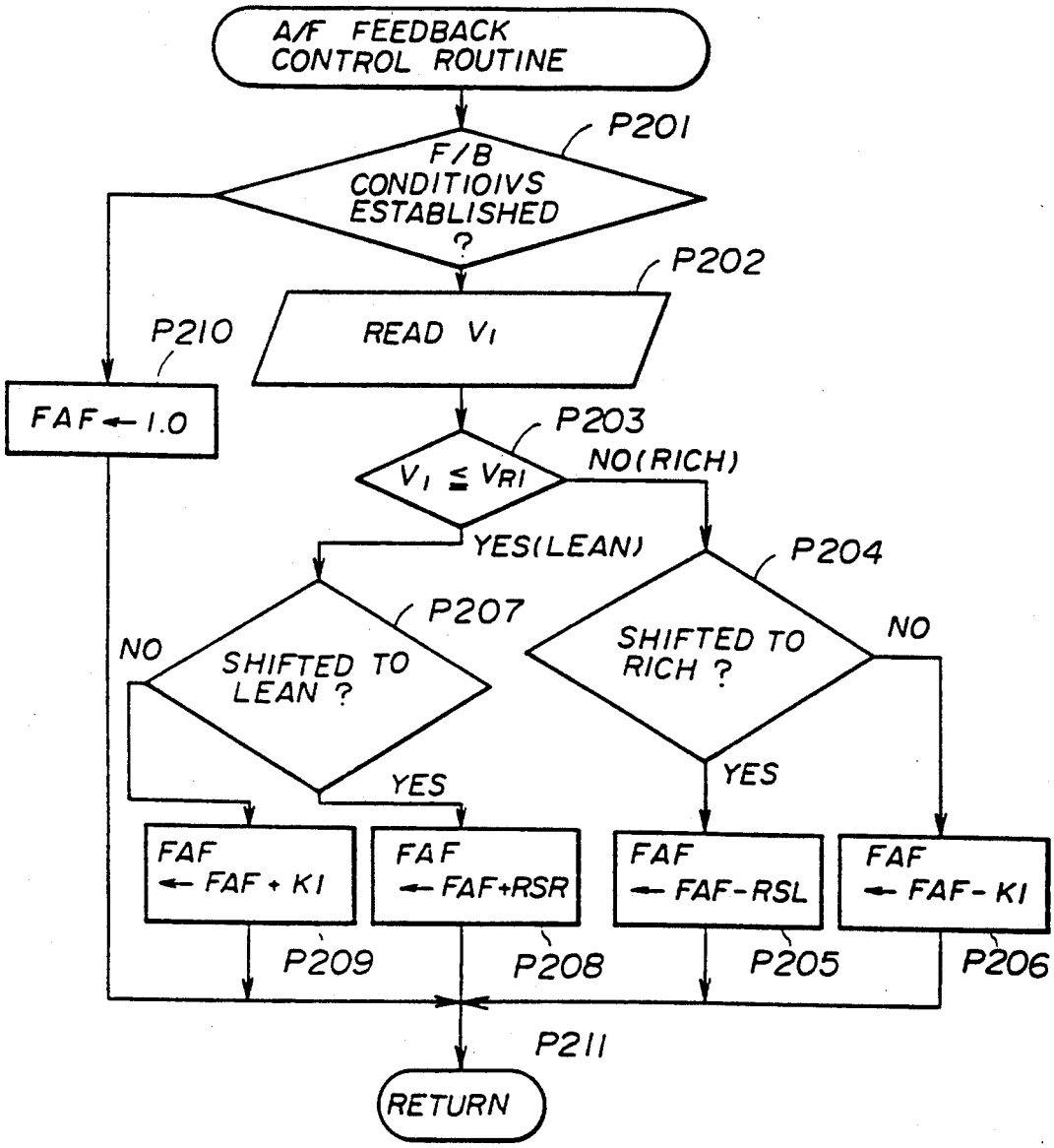
FIG. 6 is a flow chart for explaining an air-fuel ratio feedback control routine for computing an air-fuel ratio feedback correction factor FAF.

A description will be now given, with reference to FIG. 6, of the A/F feedback control routine. When the routine starts, for example every 4 ms, the microcomputer 21 judges whether or not feedback (F/B) conditions of A/F are established in step P201 (hereinafter step P is abbreviated P). If the F/B conditions are not established (for example, if water temperature is less than a predetermined value, then the engine is in starting-operation condition, fuel is increasing after starting of the engine, or fuel flow is increasing during warm-up of the engine, or fuel flow is increasing for power-ip, or the engine is in fuel-cut operation), the correction factor FAF is set to 1.0 in P210 and the routine ends in P211. By this process, an open control of the A/F is performed.

Alternatively, when the F/B conditions are established, the routine proceeds to P202 where a voltage $V_1$ detected by the $O_2$ sensor 47 is read by the CPU 50 after the A/D conversion.

Next, in P203, it is determined whether the air-fuel ratio is on the rich side or the lean side of the stoichiometric ratio by determining whether or not the detected voltage $V_1$ is less than a reference voltage $V_{R1}$. When the air-fuel ratio is on the rich side ($V_1 > V_{R1}$), it is judged, in P204, whether or not the condition has been shifted from the lean side to the rich side. If the condition has been shifted, the correction factor FAF is substituted by the value of a skip constant RSL subtracted from the last value of FAF in P205. On the other hand, if the air-fuel ratio condition has been continuously on the rich side, the correction factor FAF is substituted by the value of an integral constant KI subtracted from the last value of FAF in P206, and the routine ends in P211.

Alternatively, when the air-fuel ratio is on the lean side ($V_1 \leqq V_{R1}$), it is judged, in P207, whether or not the condition has been shifted from the rich side to the lean side. If the air-fuel ratio condition has been shifted, the correction factor FAF is substituted by the value of a skip constant RSR added to the last value of FAF in P208. On the other hand, if the air-fuel ratio condition has been continuously on the lean side, the correction factor FAF is substituted by the value of an integral constant KI added to the last value of FAF in P209, and the routine ends in P211. The skip constants RSL and RSR are set to values considerably larger than the integral constant KI.

Figure 7:
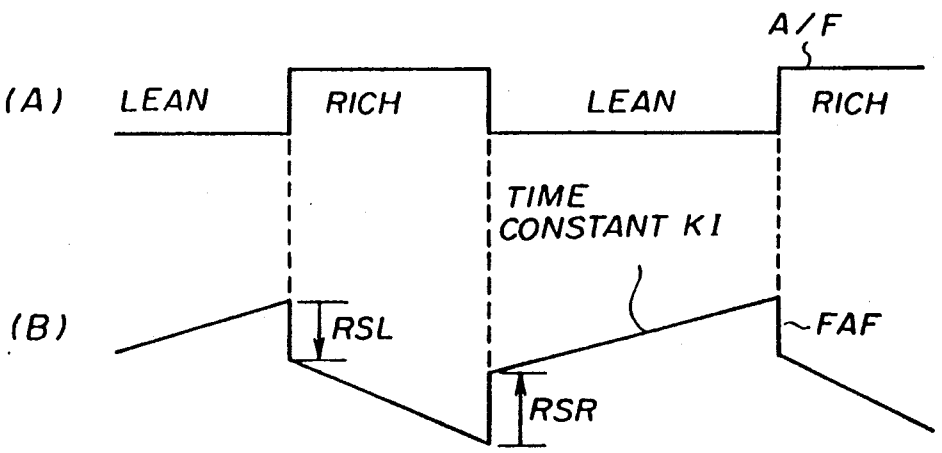
FIG. 7 is a time chart for explaining the operation of the routine shown in FIG. 6.

According to the above routine, when the air-fuel ratio shifts as indicated by (A) of FIG. 7, and the shift is from the lean side to the rich side, the correction factor FAF is decreased stepwise by the skip constant RSL as indicated by (B) of FIG. 7, and a fuel injection time TAU is changed to a smaller value. When the shift is from the rich side to the lean side, the correction factor FAF is increased stepwise by the skip constant RSR as indicated by (B) of FIG. 7, and a fuel injection time TAU is changed to a larger value. When the air-fuel ratio is continuously in the same condition, FAF is gradually increased if on the lean side or gradually decreased if on the rich side, the increase or the decrease being in accordance with the integral constant KI.

The final fuel-injection time TAU is determined by multiplying the basic fuel-injection time (determined by an engine speed and a negative pressure inside the intake pipe) by the air-fuel ratio feedback correction factor FAF together with other factors. Thus the suctioned mixture gas is controlled so as to obtain a targeted air-fuel ratio.

Next, a description will be given of a malfunction detection routine shown in FIGS. 5A and 5B. When the routine interruptedly starts, for example every 65 ms, it is judged whether or not an execution flag is set to 1 in P101. Since the execution flag has been cleared to 0 by an initial routine at the starting time of the engine, the routine proceeds to the next step P102.

In P102, it is judged whether or not a leak detection flag is set to a predetermined value. The leak detection flag is also cleared by the initial routine, the routine proceeds to the next step P103. In P103, the canister VSV 36 is closed. In step P104, it is judged whether or not FAFOFF, which is a mean value over a unit of time of the correction factor FAF is stored in the RAM 52.

If it is judged that FAFOFF is not stored, the purge VSV 38 is closed in P105, and then the mean value FAFOFF is computed and stored in the RAM 52 in P106.

Alternatively, if it is judged in P104 that FAFOFF is stored in the RAM 52, the purge VSV 38 is opened in P107, and FAFON, which is a mean value over a unit of time of the correction factor FAF is computed and stored in the RAM 52 in P108. Next, the difference between the two mean values FAFOFF and FAFON is computed in P109.

When the VSV 38 is opened to perform a purge and the evaporative fuel purge system is in normal condition, the fuel vapor in the canister 33 and in the fuel tank 30 is purged into the intake line via the VSV 38 and the purge passage 39. Accordingly, the air-fuel ratio of the suctioned mixture gas shifts to the rich side by a value corresponding to the amount of fuel vapor purged. In order to correct the shift, the correction factor FAF changes to the lean side (decreasing side) so as to push the air-fuel ratio to the lean side.

The difference between the above mentioned FAFOFF and FAFON is proportional to the concentration of fuel vapor purged into the surge tank 26 when the VSV 38 is opened. When the difference, in the case where the shift is to the rich side, is less than a predetermined percentage A %, it is judged that the concentration of the purged fuel vapor is not overly high. When the difference exceeds A %, it is judged that the concentration of the purged fuel vapor is high enough to cause an increase of exhaust emission and an over-richness of the air-fuel ratio. It should be noted that a value of the predetermined percentages A % can be set by experiment, and that the value may be changed in accordance with operational conditions of the engine.

In P110, when the value of (FAFOFF-FAFON), in the case where the shift is on the rich side, is less than A %, the malfunction detection processes, which realizes the determining means 19, is executed by steps P110-P121. On the assumption that the closing of the VSV 36, performed in P103, is executed at time $t_1$ as indicated by (B) of FIG. 8 and that the opening of the VSV 38 performed in P107 is executed at substantially the same time $t_1$ as indicated by (A) of FIG. 8, a negative pressure of the combustion chamber is effected to the fuel tank 30 via the purge passage 32, the purge VSV 38, the purge passage 37, the canister 33, and the vapor passage 32. Accordingly, a pressure inside the fuel tank rapidly decreases after the time $t_1$.

Next, in P110, it is judged whether or not the pressure inside the fuel tank 30 is less than X Pa. When the pressure is less than X Pa, the routine ends, as the operation is in a negative pressure setting condition. The above mentioned steps P101 to P104 and P107 to P110 are repeated every 65 ms until the negative pressure inside the fuel tank 30 reaches X Pa. When it is judged that the negative pressure is lower than X Pa in P110, the VSV 38 is closed at time $t_2$, as indicated by (A) of FIG. 8 in P111.

Since the two VSVs 36 and 38 are both in the closed condition at the time $t_2$, in the case where there is no malfunction in the system, the pressure inside the system from the purge VSV 38 to the fuel tank 30 returns very slowly to the atmospheric pressure.

After that, in P112, it is judged whether or not a leak-determining timer is set to 0. since the leak-determining timer is set to 0 by the aforementioned initial routine, the routine proceeds to P113 the first time the step P112 is executed. In P113, the current value as obtained by the pressure sensor 40 is set as a detection-start pressure value $P_S$ and the value is stored in the RAM 52.

Next, in P114, a predetermined value is added to the value of the leak-determining timer, and, in P115, the leak detection flag is set to 1, and then the routine ends. When the routine next starts, the routine jumps steps P103 to P110 and proceeds to P111 as it is judged that the leak detection flag is set to 1.

This time, in P112, since it is judged, in P112, that the leak-determining timer is not set to 0, the routine proceeds to P116 where it is judged whether or not the value of the leak-determining timer is equal to a value corresponding to a determination time $\alpha$ (a time for executing a leak determination). If the value is not equal to the value corresponding to the time $\alpha$, the routine ends after executing P114 and P115.

The steps P101, P102, P111, P112, P116, P114 and P115 are executed every 65 ms, and when the value of the leak-determining timer is equal to a value corresponding to a determination time $\alpha$, a value obtained by the pressure sensor 40 is set as a detection-end pressure value $P_E$ and the value is stored in the RAM 52 in P117. Then in P118, a rate of change is computed by an equation represented by $(P_S-P_E)/\alpha$ by using the values $P_S$, and $P_E$ which are read out from the RAM 52.

Next, in P119, it is judged whether or not the rate of change is greater than a predetermined threshold value $\beta$. If the rate of change is greater than $\beta$, in P120, it is determined that a malfunction has occurred because there is a large leak, as the pressure change is rapid, and the warning lamp 41 is turned on so as to warn driver that a malfunction has occurred. After that, in P121, a leak fail code is stored in the back-up RAM 53, and the routine proceeds to P122. The leak fail code is used in a repair operation for checking a cause of the malfunction, the leak fail code being read out from the back-up RAM 53.

Alternatively, if the rate of change is less than $\beta$, the routine proceeds to P122 by jumping P120 and P121, as the leakage is less than the specified value. In P122, the canister VSV 36 is opened. In P123, the leak-determining timer is cleared, and in P124, the execution flag is set to 1. The leak detection flag is then cleared to 0 in P125, and the routine ends. After that, the routine portion after the step P101 will not be executed, if the routine is started, until the engine is stopped and restarted, because it is judged that the execution flag is set to 0 in P101 and the routine proceeds directly to the ending step.

Figure 8:
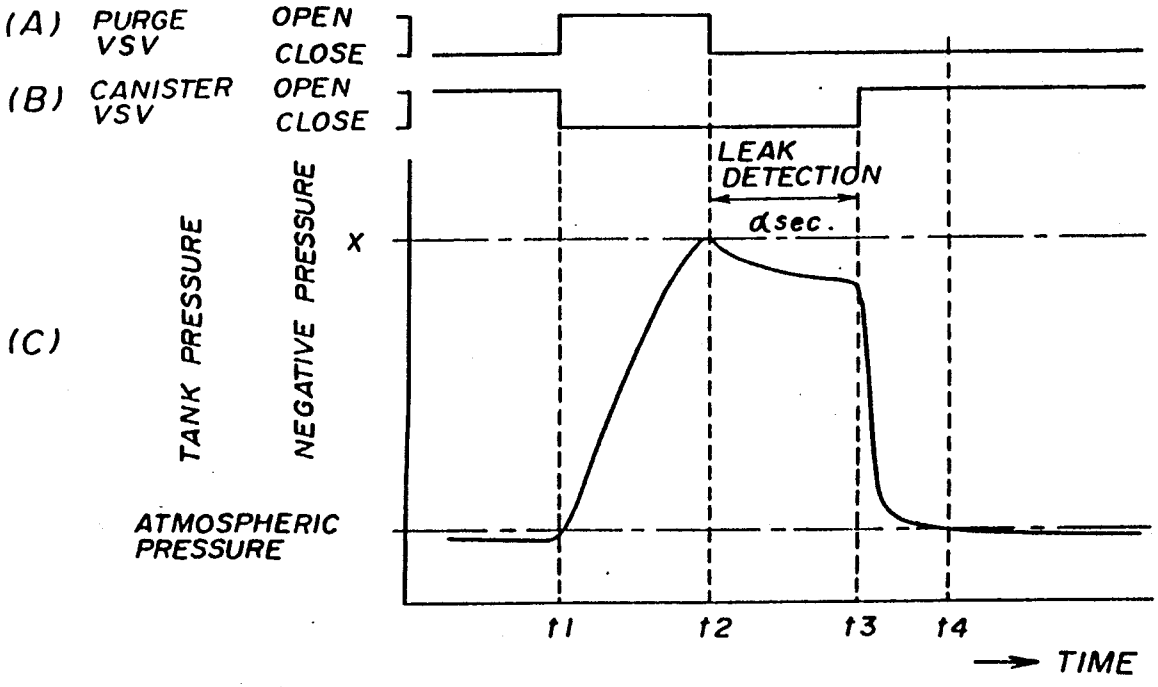
FIG. 8 is a time chart for explaining the operation of the routine shown in FIGS. 5.

As shown by (C) of FIG. 8, the canister VSV 36 is opened at time $t_3$, whereby the pressure inside the fuel tank 30 returns to a positive pressure, via the atmospheric pressure, in a short time, as air is introduced into the system from the air inlet port 36*a*.

The step P109 realizes the aforementioned detecting means 14. When the value of (FAFOFF-FAFON) indicates that the shift of the air-fuel ratio is to the rich side, the routine jumps the steps P110 to P121 and proceeds directly to P121, without performing the leak detection, and the canister VSV 36 is immediately opened. When the canister VSV 36 is opened, air is introduced into the system and the introduction of the negative pressure is stopped, that is, the step P122 realizes the aforementioned stopping means 16.

As mentioned above, according to the present embodiment, since the introduction of the negative pressure is stopped when the concentration of the purged fuel vapor inside the system affects the air-fuel ratio so that the air-fuel ratio is shifted to the rich side by A %, an excessive flow of the fuel vapor into the intake line is prevented, and thus an increase of exhaust emission and an over-rich condition of the air-fuel ratio are minimized.

Additionally, since the malfunction detection is not performed under the above mentioned condition, mis-detection of a malfunction can be eliminated which mis-detection is due to pressure change caused by large amount of fuel vapor generated in the system. It should be noted that normal evaporative-fuel purging operation is performed after the stopping of the introduction of the negative pressure. In this operation, the fuel vapor adsorbed by the adsorbent in the canister 33 is gradually purged into the intake line, and thus the value of (FAFOFF-FAFON) is decreased to a value corresponding to a shift of the air-fuel ratio of less than A %, and the malfunction detection routine is started at that moment.

It should be noted that, for example, the stopping of the introduction of the negative pressure can be performed by closing the purge VSV 38. Additionally, a pressure sensor may be provided to the fuel tank 30 and the purging position can be at the throttle valve 25.

Figure 9:
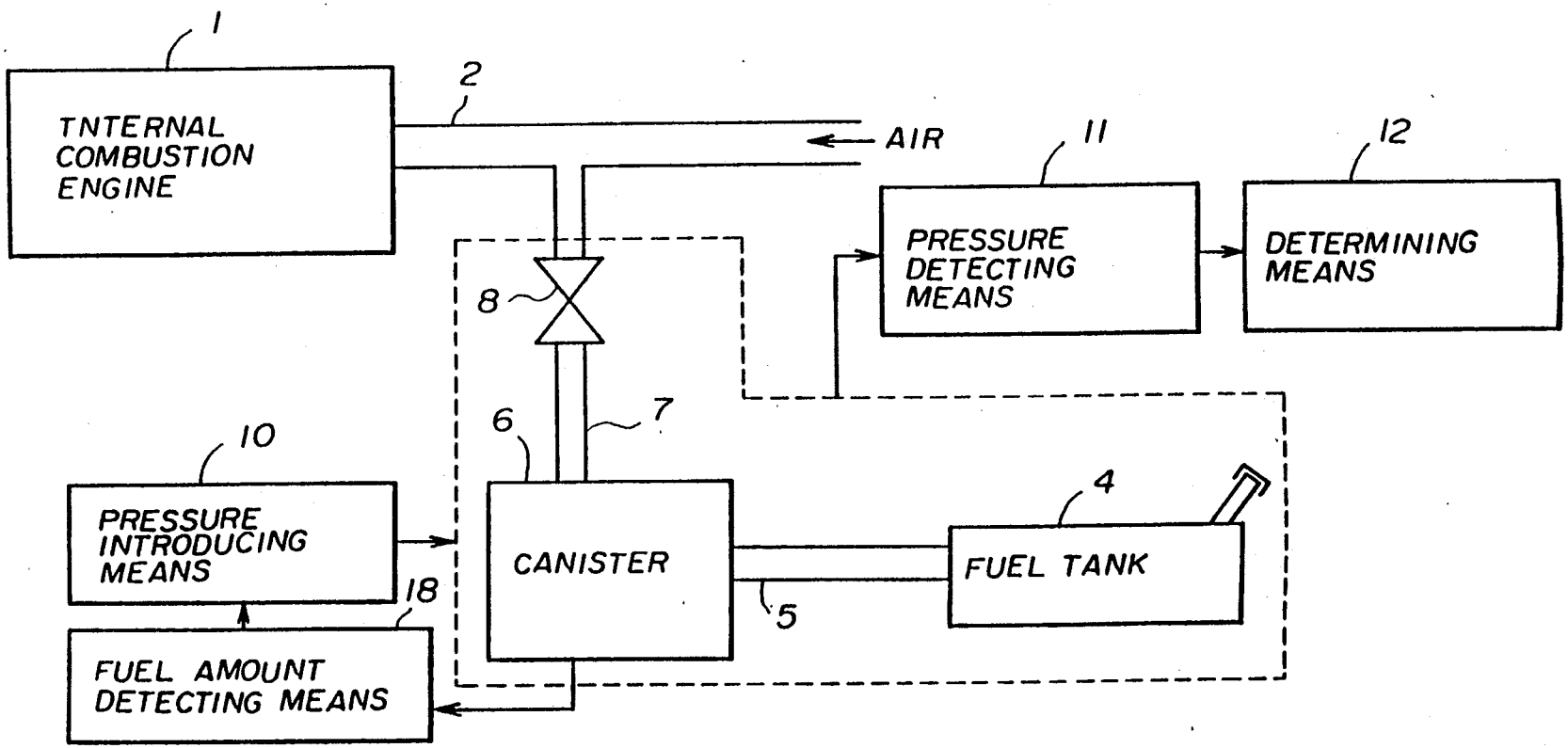
FIG. 9 is a block diagram for explaining a structure of a second embodiment of a malfunction detection apparatus according to the present invention.

Next, a description will be given of a second embodiment of the malfunction detection apparatus according to the present invention. FIG. 9 is a block diagram for explaining a structure of the second embodiment according to the present invention. In FIG. 9, parts corresponding to parts in FIG. 1 are given with the same reference numerals as in the previous figure, and descriptions thereof will thus be omitted.

In addition to the basic evaporative fuel purge system 3, the second embodiment of the malfunction detection apparatus comprises a fuel amount detecting means 18, the pressure introducing means 10, the pressure detecting means 11, and the determining means 12. The fuel amount detecting means 18 detects whether or not the fuel in the canister 6 has become less than a predetermined amount. The pressure introducing means 10 introduces a negative pressure inside the intake line 2 when the fuel amount detecting means 16 detects a predetermined amount of fuel. The pressure detecting means 11 detects pressure inside the evaporative fuel purge system 3. The determining means 12 determines whether or not a malfunction of the system 3 has occurred by monitoring a rate of pressure change on the basis of a pressure value supplied by the pressure detecting means 11 when the negative pressure is introduced into the system 3.

In the above mentioned second embodiment according to the present invention, the introduction of the negative pressure into the system 3 is performed when the amount of the fuel in the canister 6, as detected by the fuel amount detecting means 18, is less than the predetermined value, which predetermined value is nearly 0. Accordingly, suction of the fuel vapor from the canister 6 into the intake line 2 while introducing the negative pressure into the system 3 can be prevented.

First, a description will be given of a system construction of a second embodiment according to the present invention.

Figure 10:
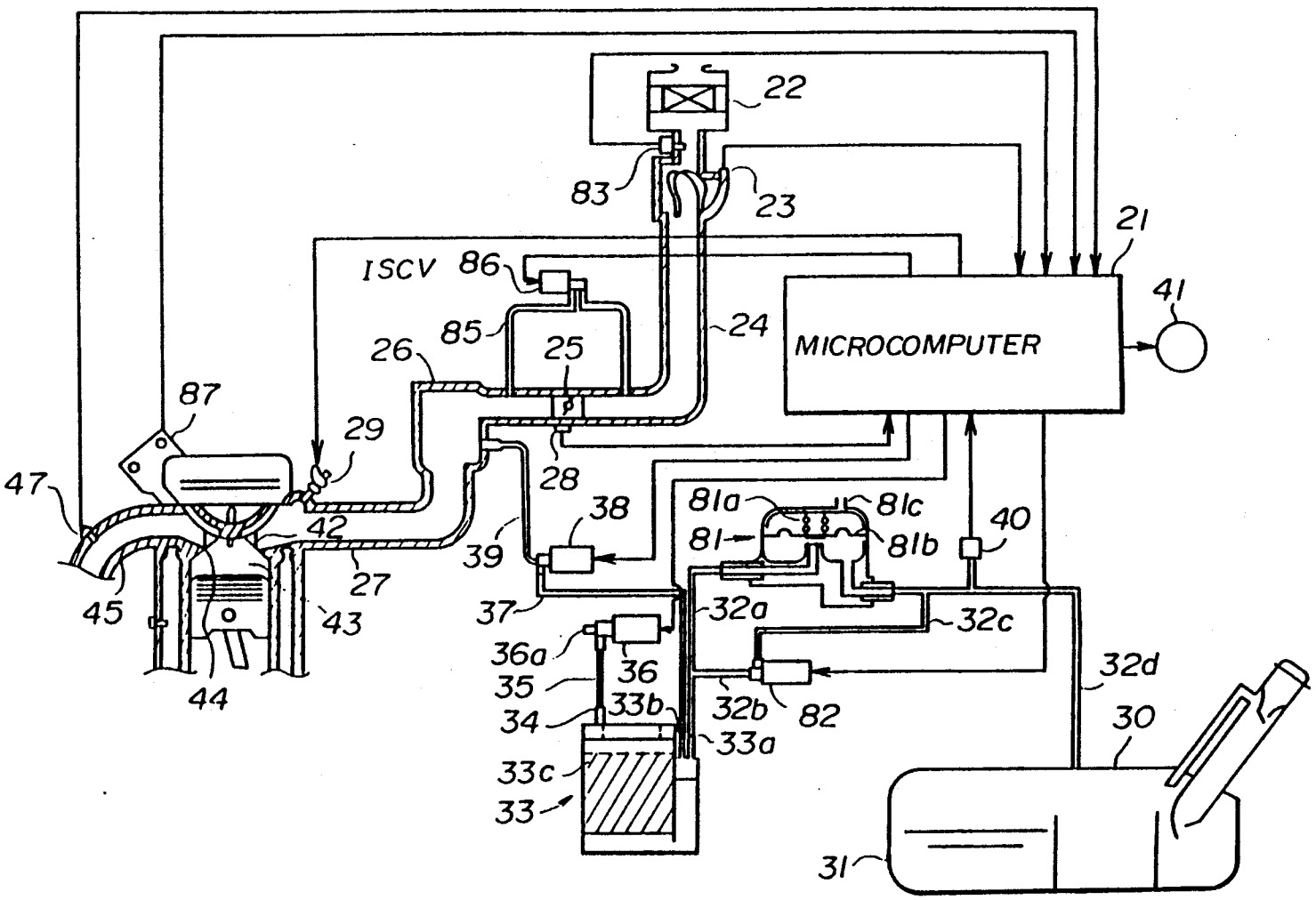
FIG. 10 is a schematic illustration of a construction of the second embodiment according to the present invention.

FIG. 10 is a schematic illustration of the second embodiment of the malfunction detection apparatus according to the present invention. Since the basic construction of the second embodiment is similar to the first embodiment shown in FIG. 3, in FIG. 10, those parts that are the same as parts shown in FIG. 3 are given the same reference numerals from figure to figure, and descriptions thereof will be omitted.

In FIG. 10, a notation 81 indicates a pressure control valve which controls a pressure inside the fuel tank 30. When a pressure inside the fuel tank 30 is higher than a setting pressure applied by a spring 31*a*, the pressure control valve 81 communicates a vapor passages 32*a* with vapor passage 32*d* via a diaphragm 81*b* positioned as shown in the figure. When the pressure inside the fuel tank 30 is lower than the setting pressure, the diaphragm 81*b* moves downward and the communication between the vapor passages 32*a* and 32*d* is cut. Accordingly, the pressure inside the fuel tank 30 is maintained in a positive pressure condition that results in a limiting of fuel vapor generation in the fuel tank 30. The pressure control valve 81 has an air release port 81*c*.

In this embodiment, vapor passages 32*b* and 32*c* are additionally provided between an inlet port and an outlet port of the pressure control valve 81. In other words, the canister 33 and the fuel tank are connected by the vapor passages 32*b* and 32*c*. A pressure switching valve (VSV) 82 is provided between the vapor passages 32*b* and 32*c*. The VSV 82 is a solenoid valve that opens or closes on the basis of control signals supplied by the microcomputer 21.

A throttle position sensor 28 is provided to a throttle body not shown in the figure. The throttle position sensor 28 detects a movement of the throttle valve 25 by means of moving contact points which serve to detect a movement. An IDL contact point of the throttle position sensor 28 is on when the throttle valve 25 is fully closed (at an idling position). Additionally, a bypass passage 85, which connects a downstream side of the air flow meter 23 with the surge tank 26, is provided so as to bypass the throttle valve. An idling speed control valve (ISCV) 86, which controls an air amount flowing in the bypass passage 85, is provided on the bypass passage 85.

Further, a rotation angle sensor 87 is provided on the engine in order to detect a position of a crank at every predetermined angle; the sensor 87 outputs signals that corresponds to a rotation speed NE of the engine.

In the above mentioned system, the pressure inside the fuel tank 30 increases in response to the generation of the fuel vapor, but, as the pressure control valve 81 is closed when the pressure is less than the predetermined setting pressure, the fuel vapor does not flow into the canister 33. When the pressure inside the fuel tank 30 exceeds the setting pressure due to the generation of a large amount of fuel vapor, the pressure control valve 81 opens, and the fuel vapor inside the fuel tank 30 flows into the canister 33 via the vapor passage 32*d*, the pressure control valve 81, and the vapor passage 32*a*. The fuel vapor is then adsorbed by the activated carbon 33*c* in the canister 33, and thus release of the fuel vapor to the atmosphere is prevented.

When the pressure inside the fuel tank 30 becomes less than the predetermined setting pressure due to the outflow of the fuel vapor into the canister 33, the pressure control valve 81 closes again. The pressure inside the fuel tank 30 is maintained at about the setting pressure by means of the pressure control valve 81 as the above operation is periodically repeated.

Figure 11:
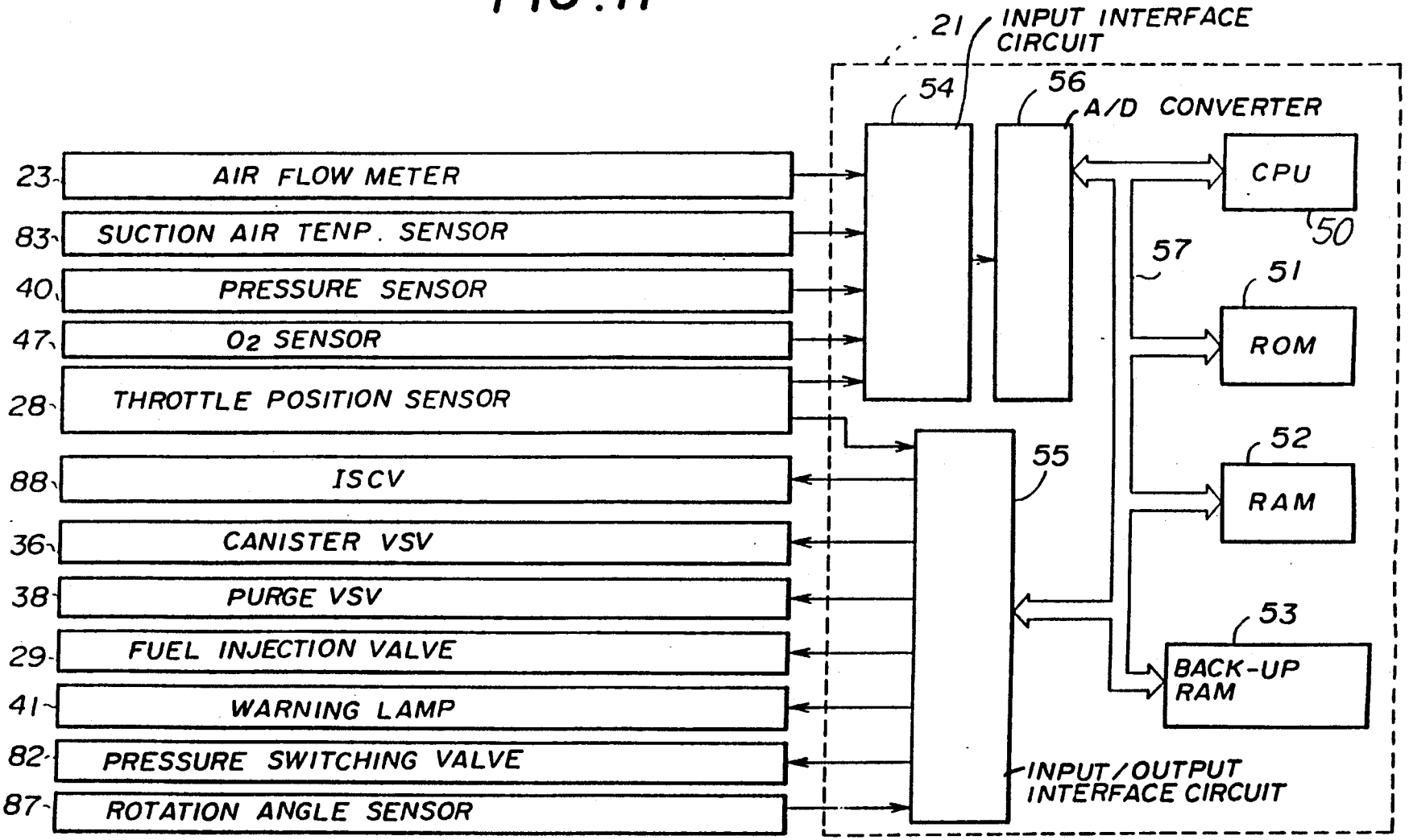
FIG. 11 is a block diagram of a microcomputer of the second embodiment shown in FIG. 10.

The microcomputer 21 shown in FIG. 10 (and FIG. 12 and 13 in the following) realizes the aforementioned fuel amount detecting means 18, pressure introducing means 10, and determining means 12 by means of a software process involving the VSV 81 and VSV 36. The microcomputer 21 has a known hardware as shown in FIG. 11. In FIG. 11, parts that are the same as parts shown in FIG. 10 and FIG. 4 are given the same reference numerals from figure to figure, and descriptions thereof will be omitted. In this embodiment, signals from additional sensor (the intake air temperature sensor 83) are supplied to the input interface circuit 54 in addition to signals from other sensors as described before. Similarly, signals are supplied from additional sensor (the rotation angle sensor) to the input/output interface circuit 55. Also signals are supplied to additional valves (the ISCV 88 and the pressure switching valve 82) from the input/output interface 55.

Figure 12:
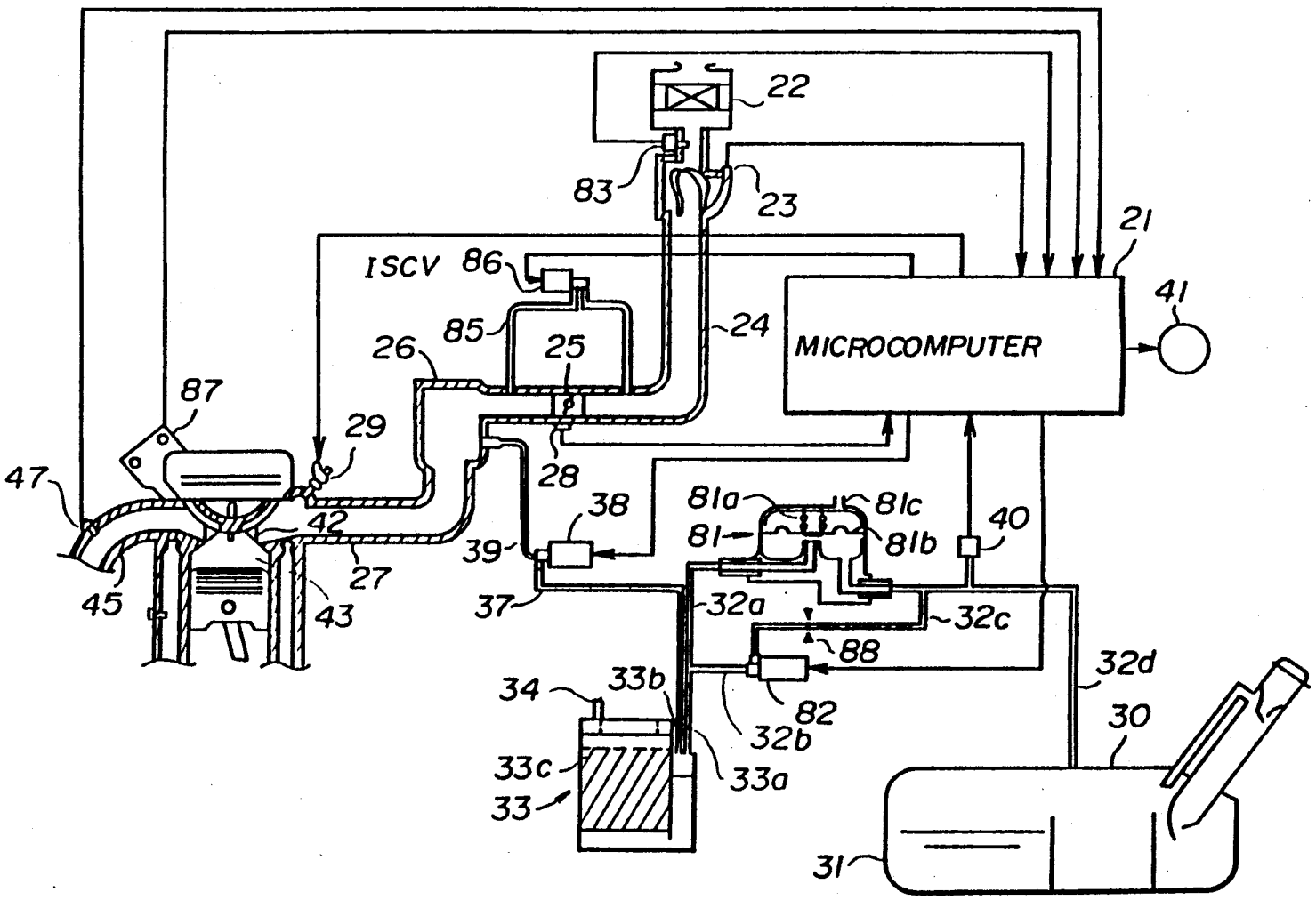
FIG. 12 is a schematic illustration of a construction of a first variation of the second embodiment according to the present invention.

FIG. 12 is a schematic illustration of a construction of a first variation of the second embodiment. In FIG. 12, parts that are the same as parts shown in FIG. 10 are given the same reference numerals from figure to figure, and descriptions thereof will be omitted.

The first variation of the second embodiment shown in FIG. 12 features that the VSV 36 of the second embodiment is deleted, and that an orifice 88 is provided on the vapor passage 32*c*. In this variation, a malfunction detection is performed by introducing a negative pressure inside the surge tank 26 by opening the purge VSV 38 and the pressure switching valve 82. Accordingly, the negative pressure is introduced not via the pressure control valve 81 but via the pressure switching valve 82 and the orifice 88.

Figure 13:
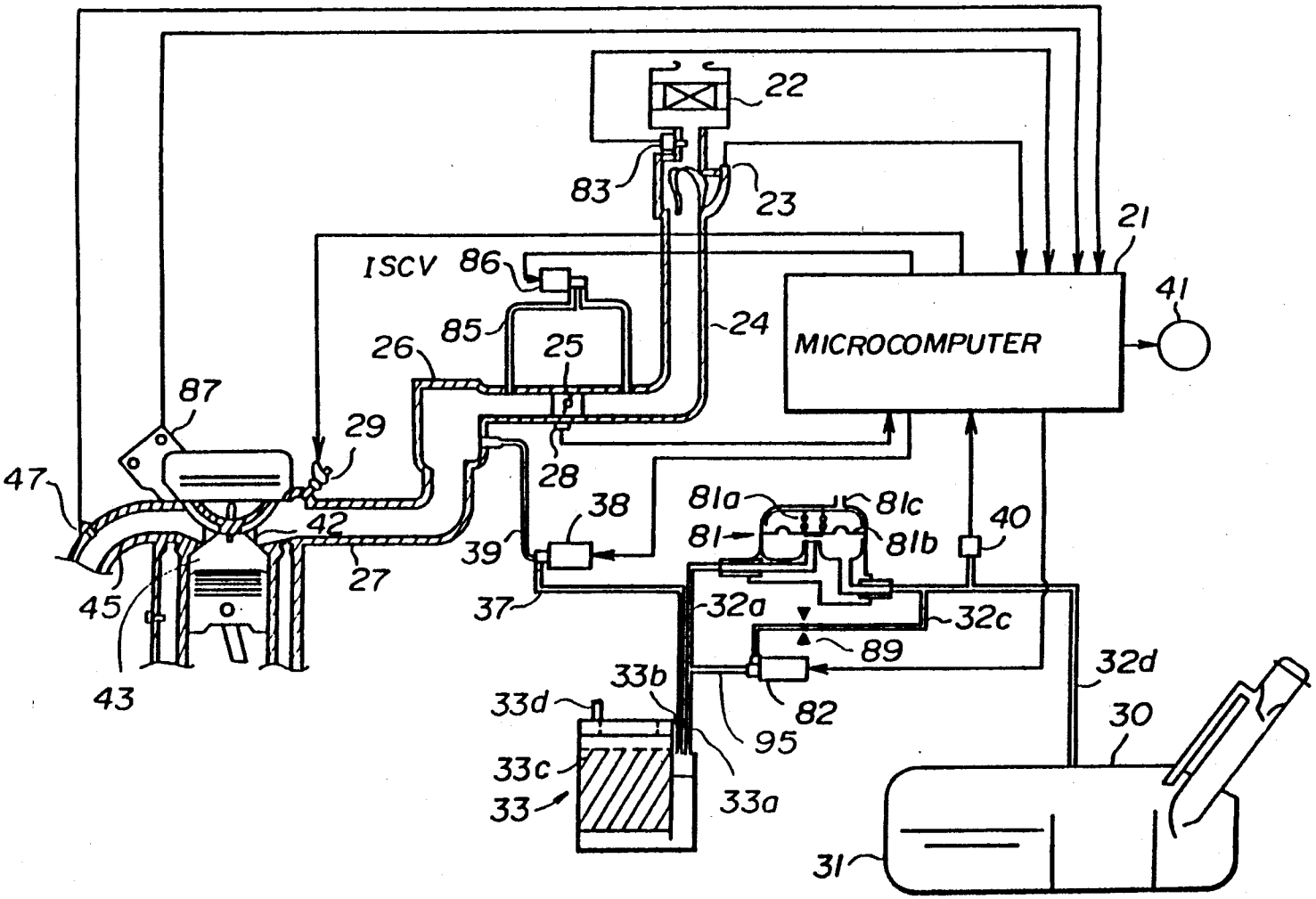
FIG. 13 is a schematic illustration of a construction of a second variation of the second embodiment according to the present invention.

FIG. 13 is a schematic illustration of a construction of a second variation of the second embodiment according to the present invention. In FIG. 13, parts that are the same as parts shown in FIG. 10 are given the same reference numerals from figure to figure, and descriptions thereof will be omitted.

The second variation of the second embodiment shown in FIG. 13, features that the canister VSV 36 of the first embodiment is deleted and that an orifice 89 is provided on the vapor passage 32*c*. Additionally, the pressure switching valve 82 is connected to the purge passage 37 with a bypass passage 95 instead of the vapor passage 32*b*, which bypass passage 95 connects the pressure switching valve 82 to the vapor passage 37, shown in FIG. 13.

In this variation, since the pressure switching valve 82 is closed during the usual purging operations, the vapor passage 32*c* and the purge passage 37 are not communicated with each other. And thus, an evaporative fuel purge system the same as that of the first and second embodiment results, in which the fuel vapor generated inside the fuel tank 30 is adsorbed by the activated carbon 33*c* in the canister 33.

During the malfunction detection operation, since the pressure switching valve 82 is opened, the vapor passage 32*c* is communicated with the purge passage 37 via the bypass passage 95. Upon opening of the VSV 38, the negative pressure inside the surge tank 26 is introduced into the fuel tank 30 via the purge passage 39, the purge VSV 38, purge passage 37, the bypass passage 95, the pressure switching valve 82, the orifice 89, and the vapor passages 32*c* and 32*d*.

Because an opening of the orifice 89 is small enough to allow a large pressure loss, the upstream side of the system (fuel tank side) becomes approximately a static system with respect to the pressure. By the above construction, the negative pressure can be introduced into the fuel tank 30 in the case where there is no leakage in the upstream side, while the negative pressure does not affect the upstream side when there is a leakage on the upstream side. Thus, high accuracy is obtained in the detection performed by the pressure sensor 40.

Next, a description will be given of a malfunction detecting operation of the second embodiment according to the present invention. The second embodiment and the variations shown in FIGS. 10, 12, and 13 are characterized in that the malfunction detecting operation is performed after almost all the fuel vapor in the canister 33 has been purged by the usual purging operation. By doing this, an effect of the fuel vapor in the canister 33 on the air-fuel ratio can be eliminated.

Now, descriptions will be given of the fuel amount detecting means 18, shown in FIG. 9, which is an essential part of the second embodiment according to the present invention. This fuel amount detecting means 18 detects that the fuel vapor in the canister 33 has become less than a predetermined amount during of the usual purging operation performance.

Figure 14:
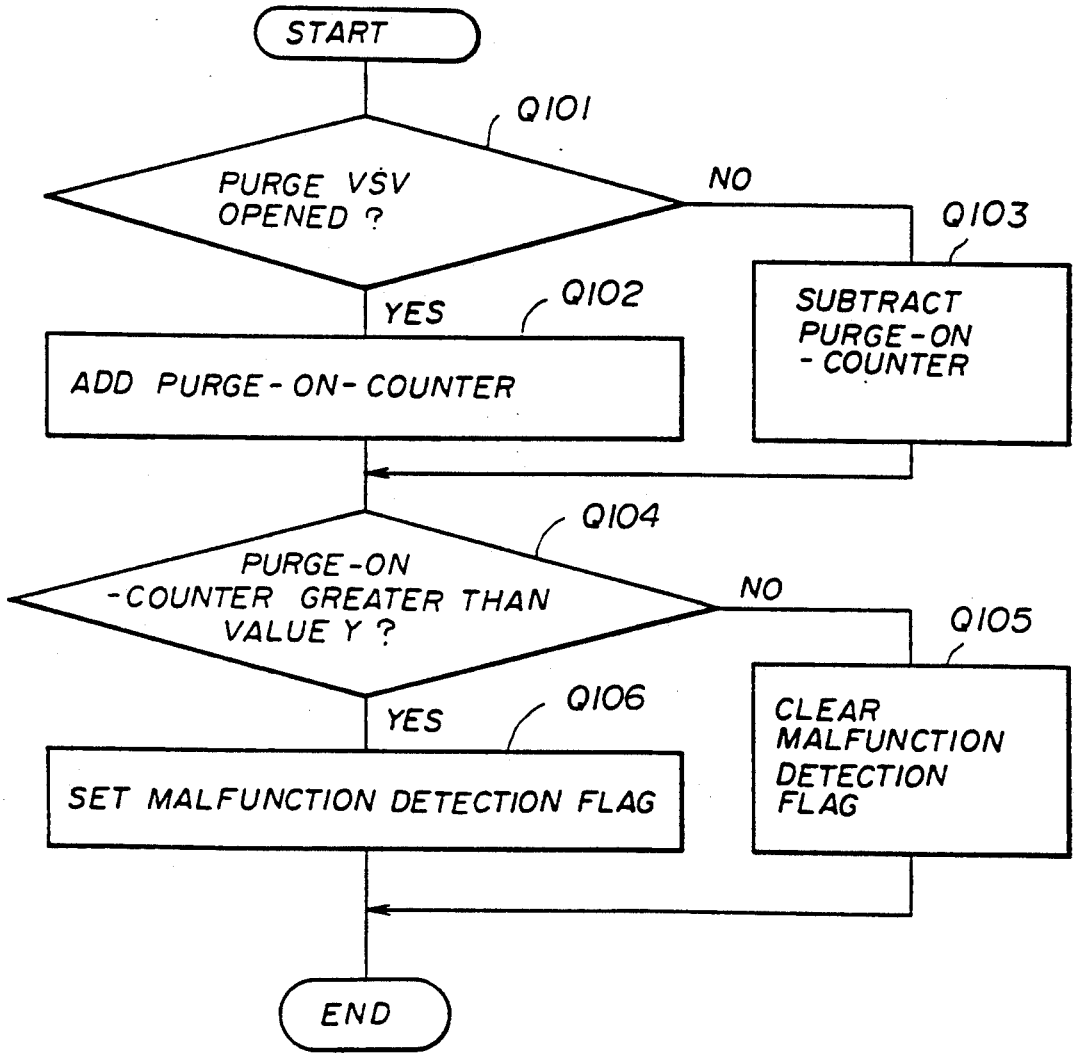
FIG. 14 is a flow chart of a first embodiment of a fuel amount detecting routine.

FIG. 14 is a flow chart of a first embodiment of the fuel amount detecting routine according to the second embodiment. This routine is performed by the microcomputer 21. This routine is executed in a part of a purge control routine of a main routine. The purge control routine is, for example, a routine that judges an establishment of predetermined conditions in order to open the purge VSV 38 and close the pressure control valve 82 (in the system shown in FIG. 10, the VSV 36 is also opened) so as to perform a purge operation. The conditions are, for example, that: the warm-up operation of the engine is finished, the air-fuel ratio feedback is being performed, and the engine is not in an idling operation. When all of those conditions are met, it is determined that the purge condition has been established.

In this purge control routine, in step Q101 of FIG. 14 (hereinafter the word "step" will be omitted), it is judged whether or not the purge VSV 38 is open. If the VSV 38 is open, a predetermined value is added, in Q102, to a purge-on counter. If the VSV 38 is closed, a predetermined value is subtracted, in Q103 from the purge-on counter.

Next, in Q104, it is judged whether or not the purge-on-counter is greater than a predetermined value Y. If the purge-on-counter is less than the value Y, it is judged that considerable amount of the fuel vapor remains in the canister 33 and a malfunction detection flag is cleared in Q105. This purge-on-flag is provided for determining whether or not a sufficient time has elapsed since the VSV 38 was opened.

On the other hand, Q104, if it is judged that the purge-on-counter is equal to or greater than the value Y, the remaining fuel vapor in the canister 33 is considered to be almost 0 and then the routine proceeds to Q106 where the malfunction detection flag is set to 1, and the routine ends.

Figure 15:
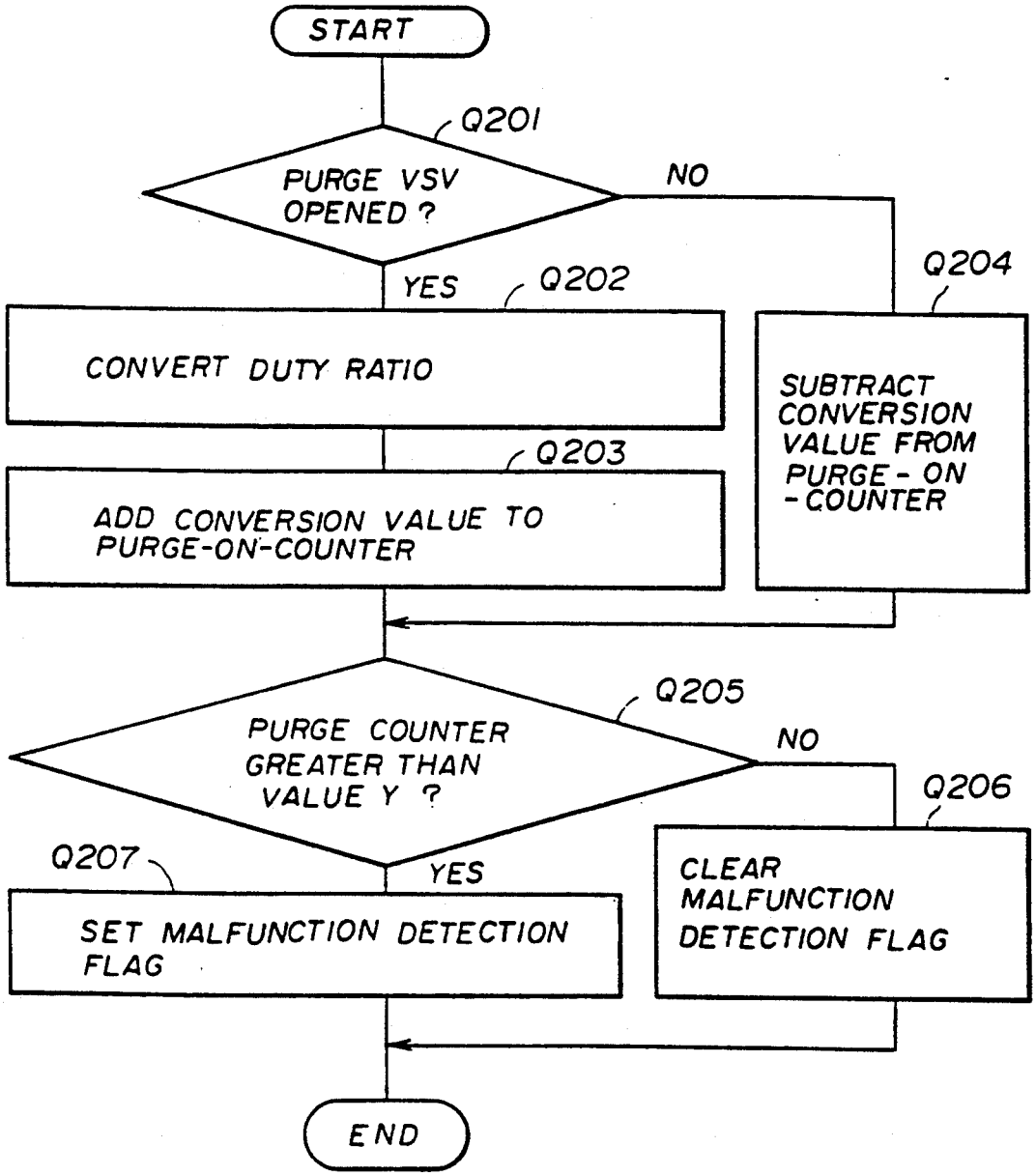
FIG. 15 is a flow chart of a second embodiment of a fuel amount detecting routine.

FIG. 15 is a flow chart of a second embodiment of the fuel amount detecting routine. This routine is performed by the microcomputer 21. This routine is executed in a part of a purge control routine of a main routine. In this purge control routine, in step Q201 of FIG. 15, it is judged whether or not the purge VSV 38 is open. If the VSV 38 is open, a predetermined value is added, in Q102, to a purge-on counter.

If the VSV 38 is open, a duty ratio of the VSV 38 is converted into the conversion value in Q202, and then the conversion value is added to the last value of the purge-on counter in Q203. That is, in this embodiment, an opening of the purge VSV 38 is operated by a duty ratio control by the microcomputer 21. Accordingly, greater the duty ratio, the longer the opening time of the VSV 38. The conversion value is in proportion to the duty ratio as shown in the following table.

| Duty Ratio | 0 | ≦10 | ≦20 | ≦30 | ≦40 | ≦50 | ≦60 | ≦70 | ≦80 | ≦90 | ≦100 |
|---|---|---|---|---|---|---|---|---|---|---|---|
| Conversion Value | 0 | 1 | 2 | 3 | 4 | 5 | 6 | 7 | 8 | 9 | 10 |

If it is judged that the VSV 38 is not opened in Q201, a predetermined value is subtracted, in Q204, from the purge-on-counter.

Next, in Q205, it is judged whether or not the purge-on-counter is greater than a predetermined value Y. If the purge-on-counter is less than the value Y, it is judged that considerable amount of the fuel vapor remains in the canister 33 and a malfunction detection flag is cleared in Q206. This purge-on-flag is provided for determining whether or not a sufficient time has elapsed since the VSV 38 was opened.

On the other hand, if it is judged that the purge-on-counter is equal to or greater than the value Y in Q205, the remaining fuel vapor in the canister 33 is considered to be almost 0 and then the routine proceeds to Q207 where the malfunction detection flag is set to 1, and the routine ends.

As mentioned above, in this embodiment, a time integration weighted by the duty ratio is performed when the VSV 38 is operated by duty ratio control, and if the purge-on-counter is equal to or greater than the predetermined value Y, it is judged that the fuel vapor in the canister is almost 0 and the malfunction detection flag is set to 1.

Figure 16A:
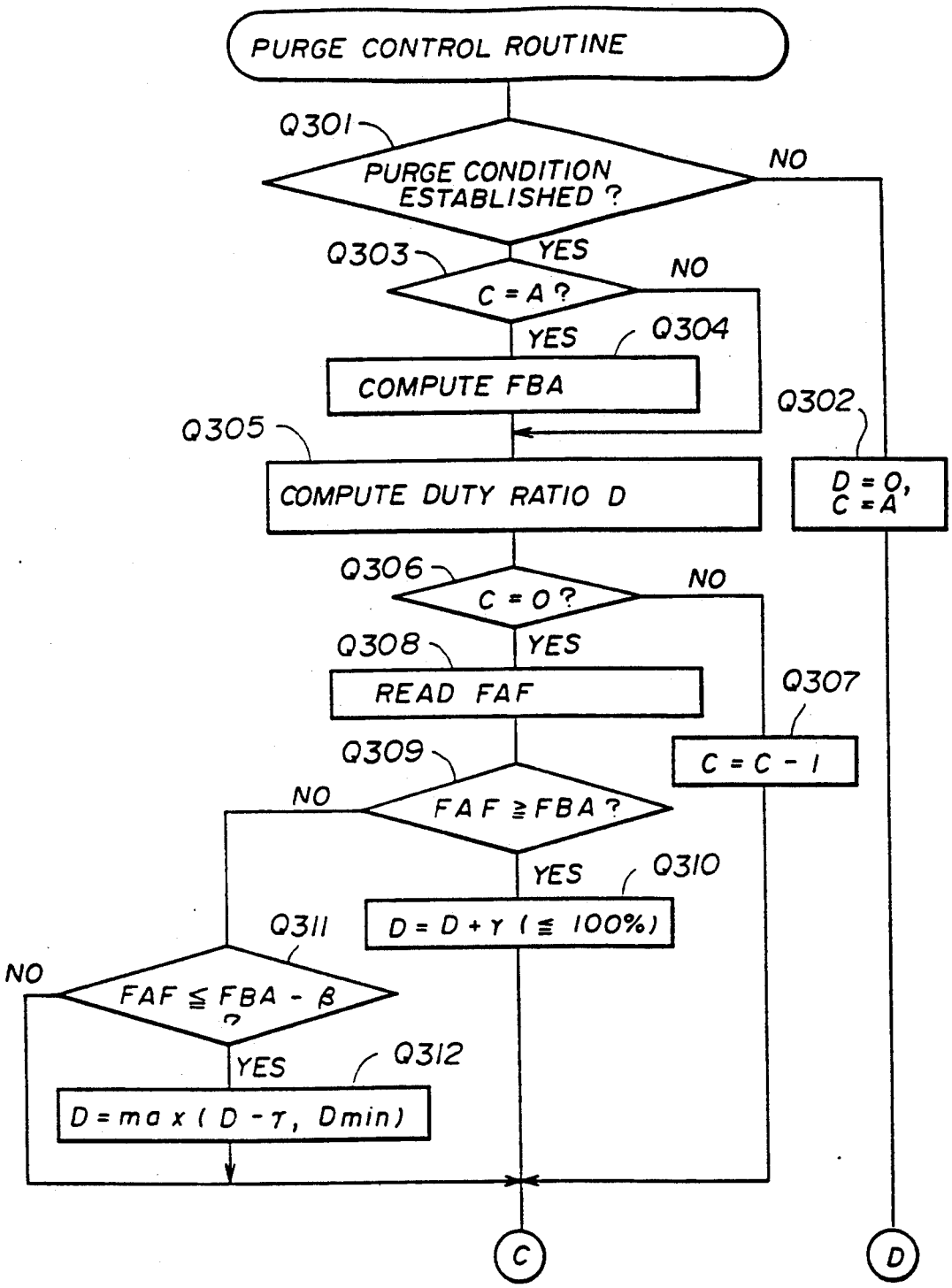
FIGS. 16A and 16B are parts of a flow chart of a third embodiment of a fuel amount detecting routine.
Figure 16B:
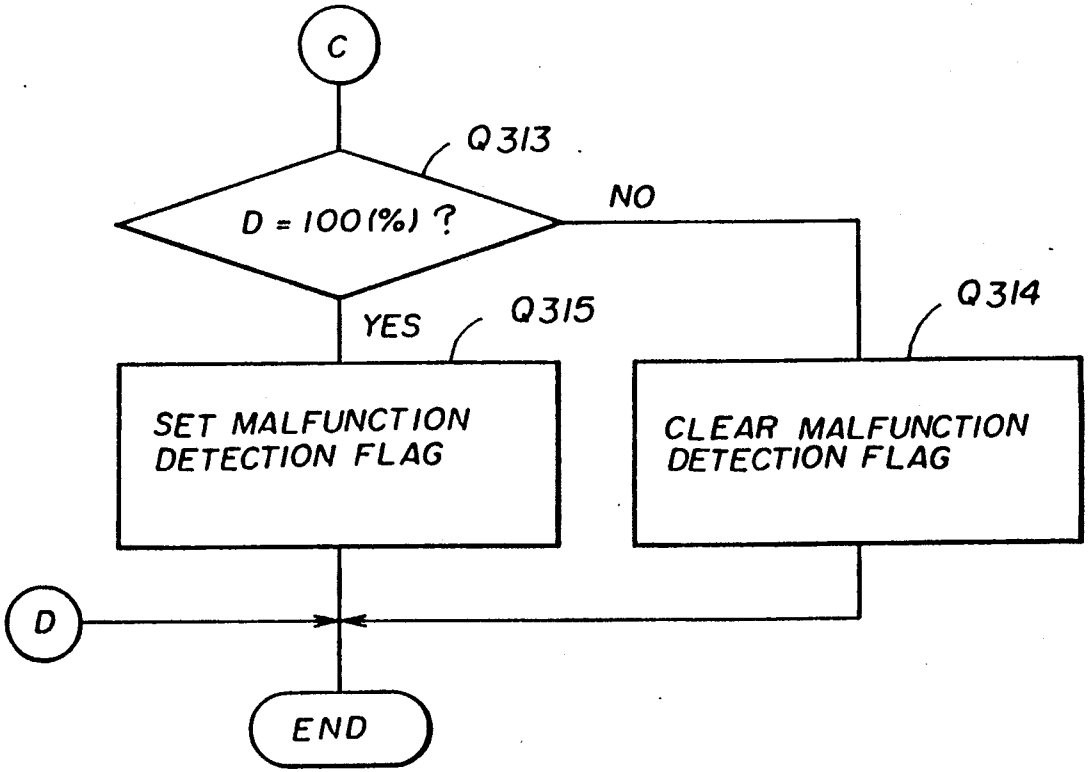

FIGS. 16A and 16B are parts of a flow chart of a third embodiment of a fuel amount detecting routine. In this embodiment, the purge VSV 38 is controlled in response to the air-fuel ratio in order to perform a purge control. In Q301, it is judged whether or not the purge conditions are established. These purge conditions are the same as the aforementioned purge conditions. Accordingly, for example, if the engine is in a state immediately after starting, that is, if the purge conditions are not established, a duty ratio D of a driving signal supplied to the VSV 38 is set to 0 (%) and a counter C is set to a predetermined value A in Q302, and the routine ends.

On the other hand, when it is judged, in Q301, that the purge conditions are established, the routine proceeds to Q303 where it is judged whether or not the counter C is equal to the predetermined value A. Since C=A in the first execution of Q303, the routine proceeds to Q304. In Q304, a feedback correction factor FBA is computed as FAFAV, which is a mean value of the air-fuel ratio feedback correction factor FAF. It should be noted that FAF and FAFAV are computer by the known FAF computing routine described in the following.

Next, the duty ratio D is computed by the CPU 50 in accordance with a rotational speed signal, supplied by the rotational angle sensor 87, and in accordance with a signal from the throttle position sensor, which signal is with reference to a map, which map is a relationship between the rotation speed NE and an engine load, the map being stored in the ROM 51. The duty ratio D is a function based on the rotation speed NE and the engine load Q/N (ratio of suction air flow and rotation speed NE). The duty ratio D becomes larger when the rotational speed NE or the engine load becomes larger, so that an effect thereof on the air-fuel ratio becomes as small as possible.

Next, it is judged, in Q306, whether or not the counter is 0. Since the initial value of the counter is A, and thus C is not 0, the routine proceeds to Q307 where the counter C is decremented by 1. Then the routine proceeds to Q313 where it is judged whether or not the duty ratio D is 100%. When the duty ratio D is not 100, the malfunction detection flag is cleared in Q314. When D is 100, the malfunction detection flag is set in Q315. It should be noted that normally the duty ratio D is not 100 immediately after a purge operation.

When this routine is restarted, and if the purge conditions are established, the routine proceeds to Q306 via Q301, Q303, and Q305. In Q306, it is judged whether or not the counter C is 0, and if C is not 0, the counter C is decremented by 1 again in Q307. Then the routine ends after executing Q313 and Q314.

On the assumption that if the routine is repeated A times, it is judged that the counter C is 0 in Q306. Then the routine proceeds to Q308 where the CPU 50 reads the present air-fuel ratio feedback correction factor FAF from the RAM 52. After that, in Q309, the CPU 50 performs a comparison of the correction factor FAF and the feedback factor FBA computed in Q304. If FAF is equal to or greater than FBA, a predetermined value $\tau$ is added to the duty ratio D in Q310. It should be noted that the duty ratio D is never set to a value greater than 100%.

On the other hand, if it is judged that FAF is less than FBA, it is judged, in Q311, whether or not FAF is equal to or less than FBA-$\beta$. When it is judged that FAF is equal to or less than the threshold value (FBA-$\beta$), the duty ratio D is set, in Q312, to the value of (d-$\tau$) or the minimum value $D_{min}$, whichever is greater, and the routine proceeds to Q313. If it is judged that FAF is greater than (FBA-$\beta$), the duty ratio D is not revised and the routine proceeds to Q313.

Namely, the air-fuel ratio feedback correction factor FAF is less than the feedback factor FBA when the current air-fuel ratio is on the rich side compared to that of the starting time of the purge operation; and FAF is greater than FBA when the current air-fuel ratio is on the lean side as compared to that of the starting time of the purge. When there is more fuel vapor in the canister 33 than a predetermined amount, the air-fuel ratio becomes richer due to the purge operation. However, when there is only a small amount of fuel vapor in the canister 33, the air-fuel ratio becomes leaner as the air introduced form the air introducing port 33*d* is purged into the intake passage.

In this embodiment, when it is judged, by comparing FAF with (FBA-$\beta$), that the air-fuel ratio is greater than that of the starting time of the purge operation, the duty ratio D is changed to a smaller value in Q311 and Q312, and thus the shift of the air-fuel ratio to the rich side is prevented. On the other hand, when it is judged, by comparing FAF with FBA, that the air-fuel ratio is equal to or smaller than that of the starting time of the purge operation the duty ratio D is changed increased by $\tau$ in Q310, and thus the release of the fuel vapor in the canister 33 is promoted.

As mentioned above, the duty ratio D is increased by the predetermined value $\tau$ when FAF is equal to or greater than that at the starting time of the purge operation. When it is judged in Q313 that the duty ratio has reached 100%, it is determined that the fuel vapor in the canister 33 is less than the predetermined value which is almost 0. Then the routine proceeds to Q315 where the malfunction detection flag is set to 1 and the routine ends.

It should be noted that the duty ratio D may be alternated with a purge ratio, which purge ratio is a ratio of the purge flow amount to the suction air flow amount, so as to perform the process shown in FIGS. 16.

Figure 17:
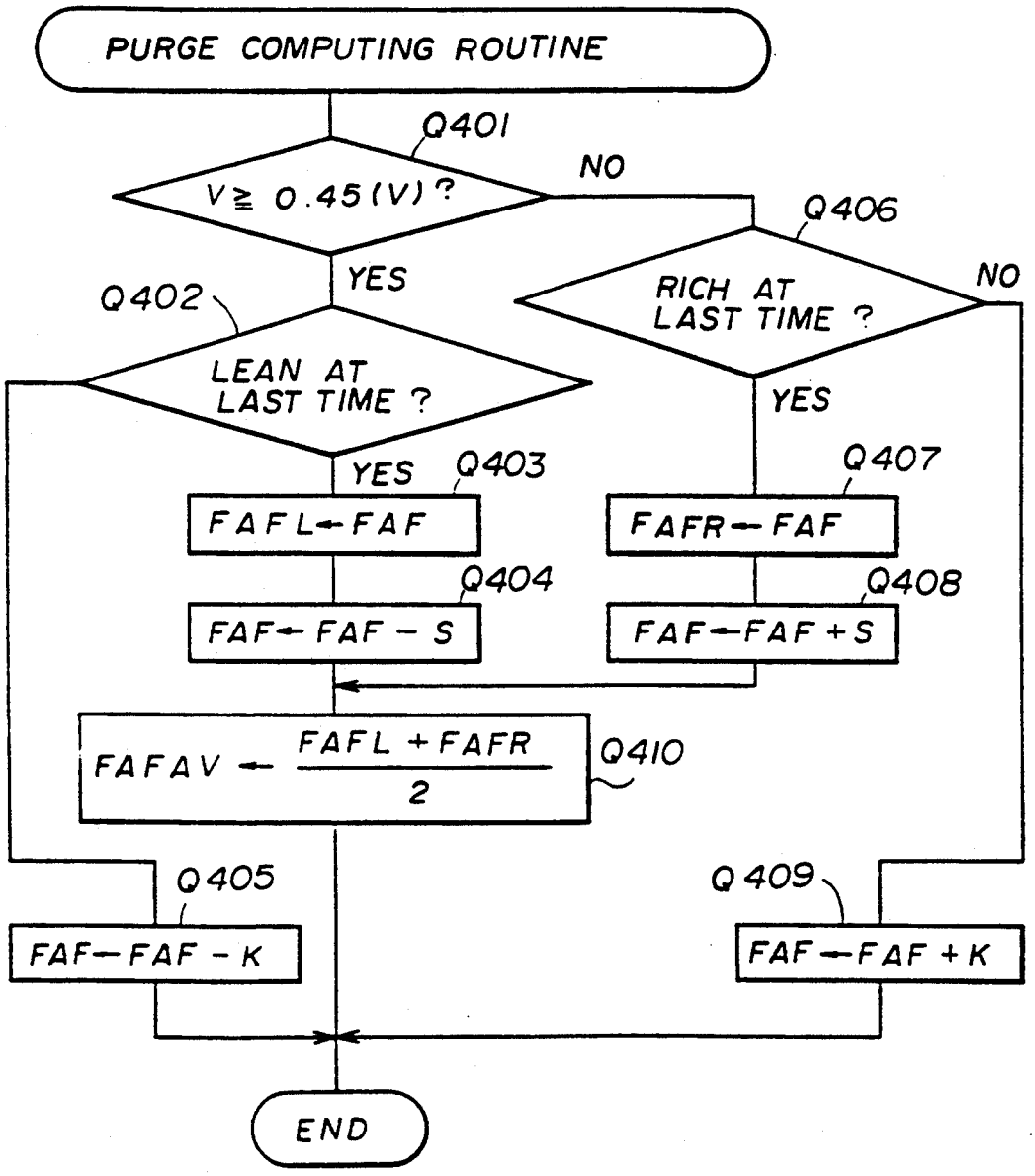
FIG. 17 is a flow chart of a known routine for computing the air-fuel ratio feedback correction factor.

FIG. 17 is a flow chart of a known routine for computing the air-fuel ratio feedback correction factor FAF. When this routine starts, for example, every 4 ms, and the predetermined air-fuel ratio feedback conditions are established, a detected voltage supplied by the $O_2$ sensor 47 provided on the exhaust passage of the engine is compared with a reference voltage (in this case 4.5 V) in step Q401.

If the air-fuel ratio is rich ($V \geqq 0.45$ V), it is judged, in Q402, whether or not the condition was shifted from the lean side to the rich side. If it has been shifted to the rich side, the last value of FAF is substituted for FAFL. After that, in Q404, a value obtained by subtracting a skip constant S from the last FAF is substituted for FAF. On the other hand, if the condition has not changed, that is if the same rich condition is continuing, a value obtained by subtracting an integral constant K from the last FAF is substituted, in Q405, for FAF, and the routine ends.

On the other hand, if the air-fuel ratio is lean ($V < 0.45$ V), it is judged, in Q406, whether or not the condition has been shifted from the rich side to the lean side. If it has been shifted to the lean side, the last value of FAF is substituted, in Q407, for FAFR. After that, a value obtained by adding a skip constant S to the last FAF is substituted, in Q408, for FAF. Alternatively, if the condition has not changed, that is if the same lean condition is continuing, a value obtained by adding an integral constant K to the last FAF is substituted, in Q409, for FAF, and the routine ends. The skip constant S is set to a value considerably larger than the integral constant K. After the execution of the steps Q404 and Q408, a mean value of FAFL and FAFR is computed, and the calculated mean value is substituted, in Q410, for FAFAV, and the routine ends.

Figure 18:
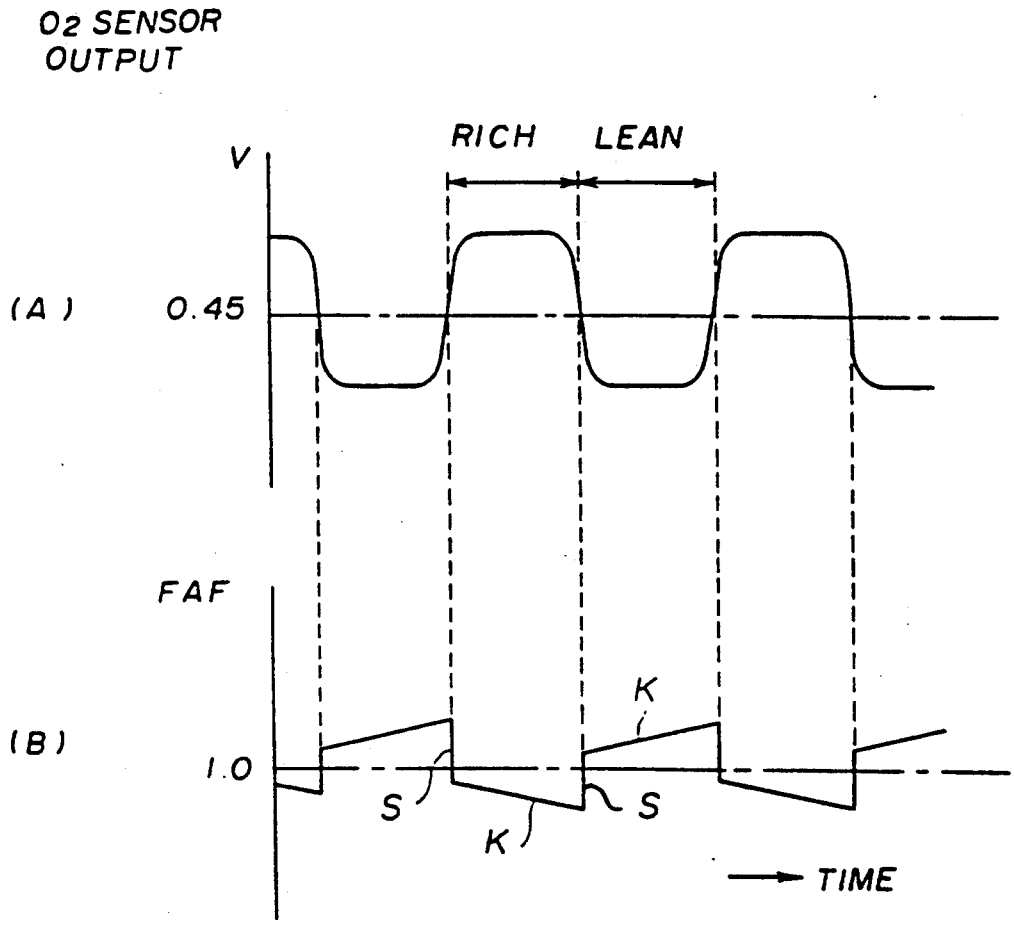
FIG. 18 is a time chart for explaining an operation shown in FIG. 17.

According to the above routine, when the air-fuel ratio shifts as indicated by (A) of FIG. 18, and the shift is from the lean side to the rich side, the correction factor FAF is decreased stepwise by the skip constant S as indicated by (B) of FIG. 18, and a fuel injection time TAU is changed to a smaller value. When the shift is from the rich side to the lean side, the correction factor FAF is increased stepwise by the skip constant S as indicated by (B) of FIG. 18, and a fuel injection time TAU is changed to a larger value. When the air-fuel ration has been continuously in the same condition, FAF is gradually increased in the lean side case or gradually decreased in the rich side case in accordance with the integral constant K.

The final fuel-injection time TAU is determined by multiplying the basic fuel-injection time, determined by an engine speed and a suction air amount (or a negative pressure inside the intake pipe), by the air-fuel ratio feedback correction factor FAF together with other factors. Thus the suctioned mixture gas is controlled to have a targeted air-fuel ratio.

Figure 19A:
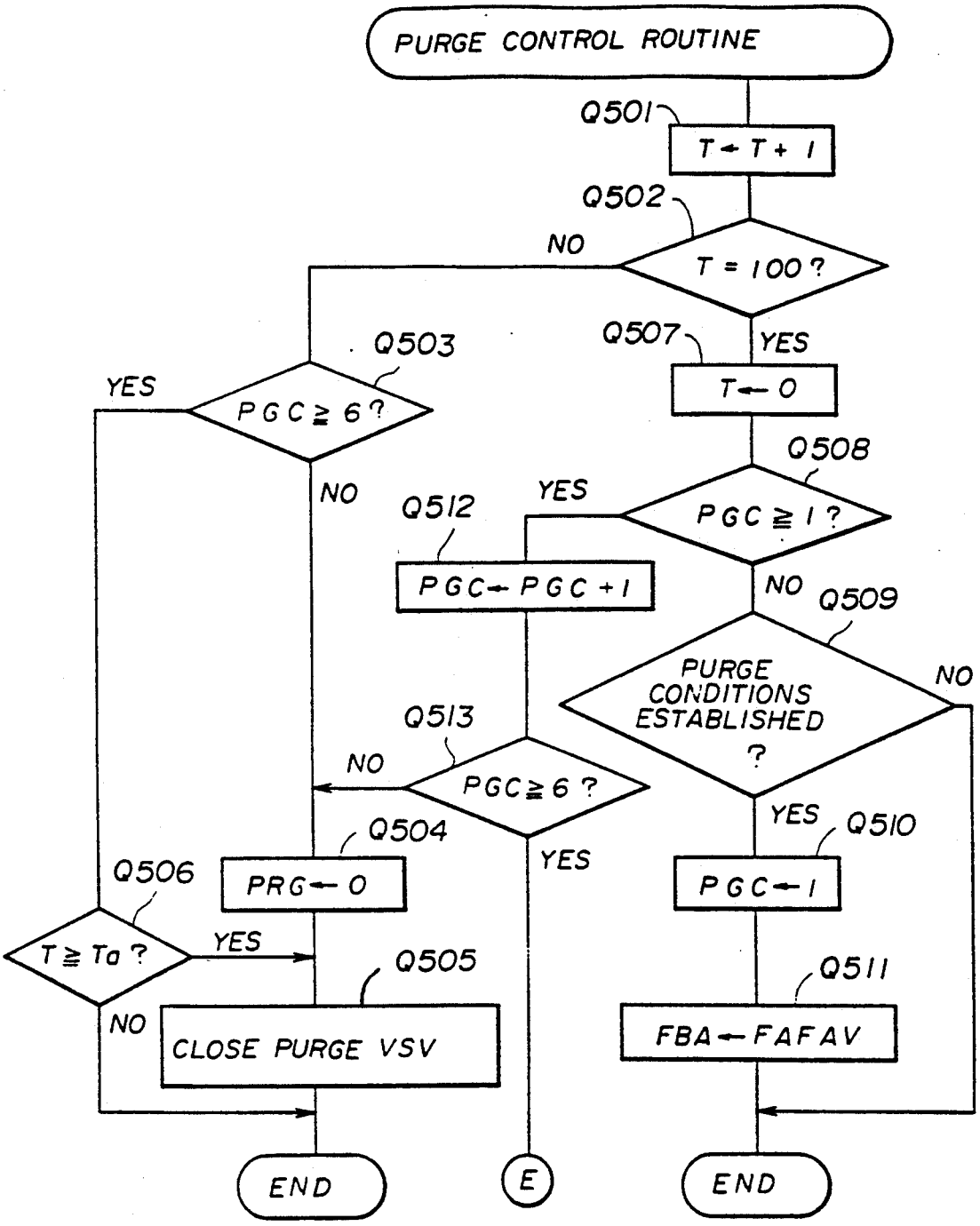
FIGS. 19A, 19B, 19C, and 19D are parts of a flow chart of a fourth embodiment of a fuel amount detecting routine.
Figure 19B:
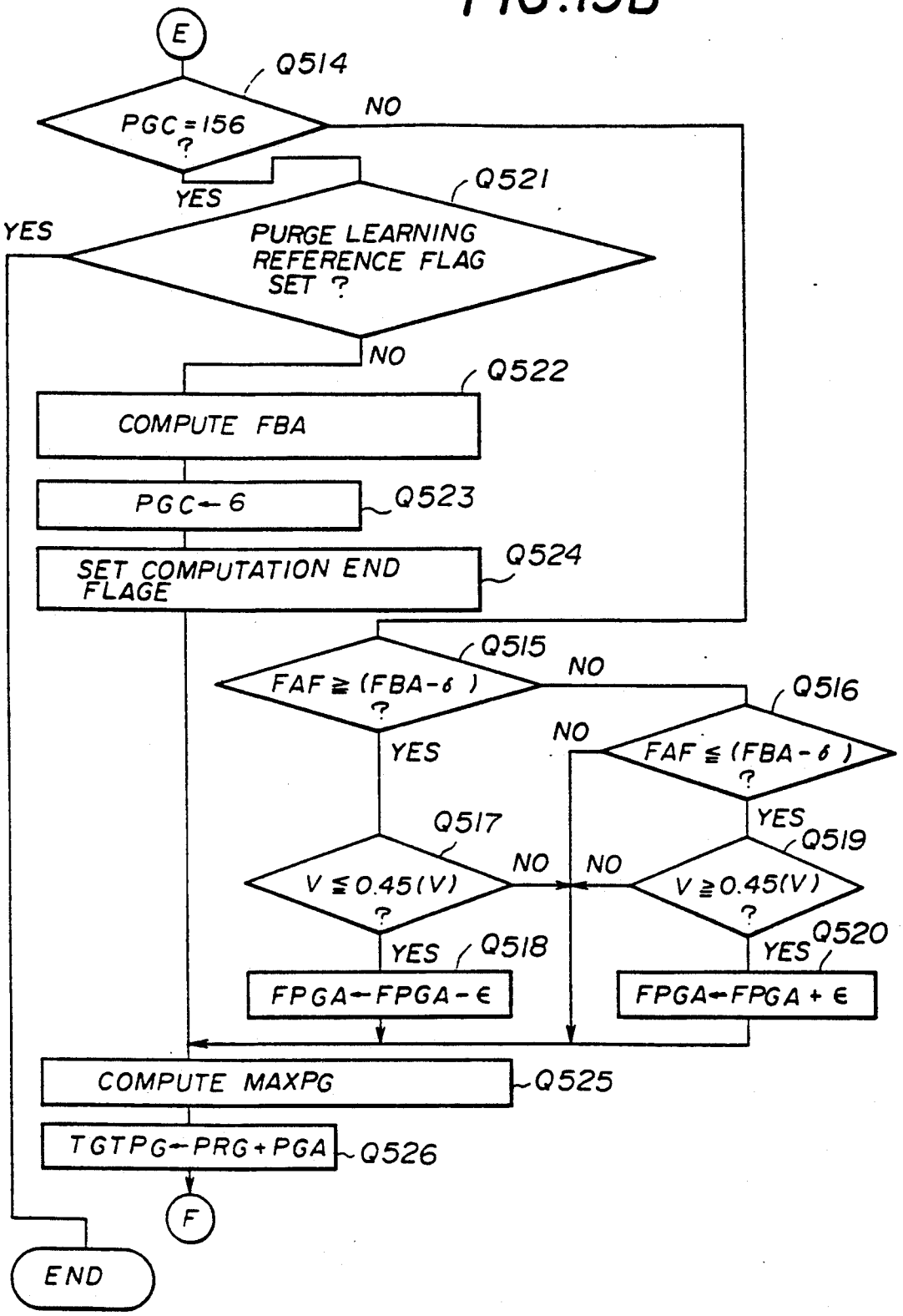
Figure 19C:
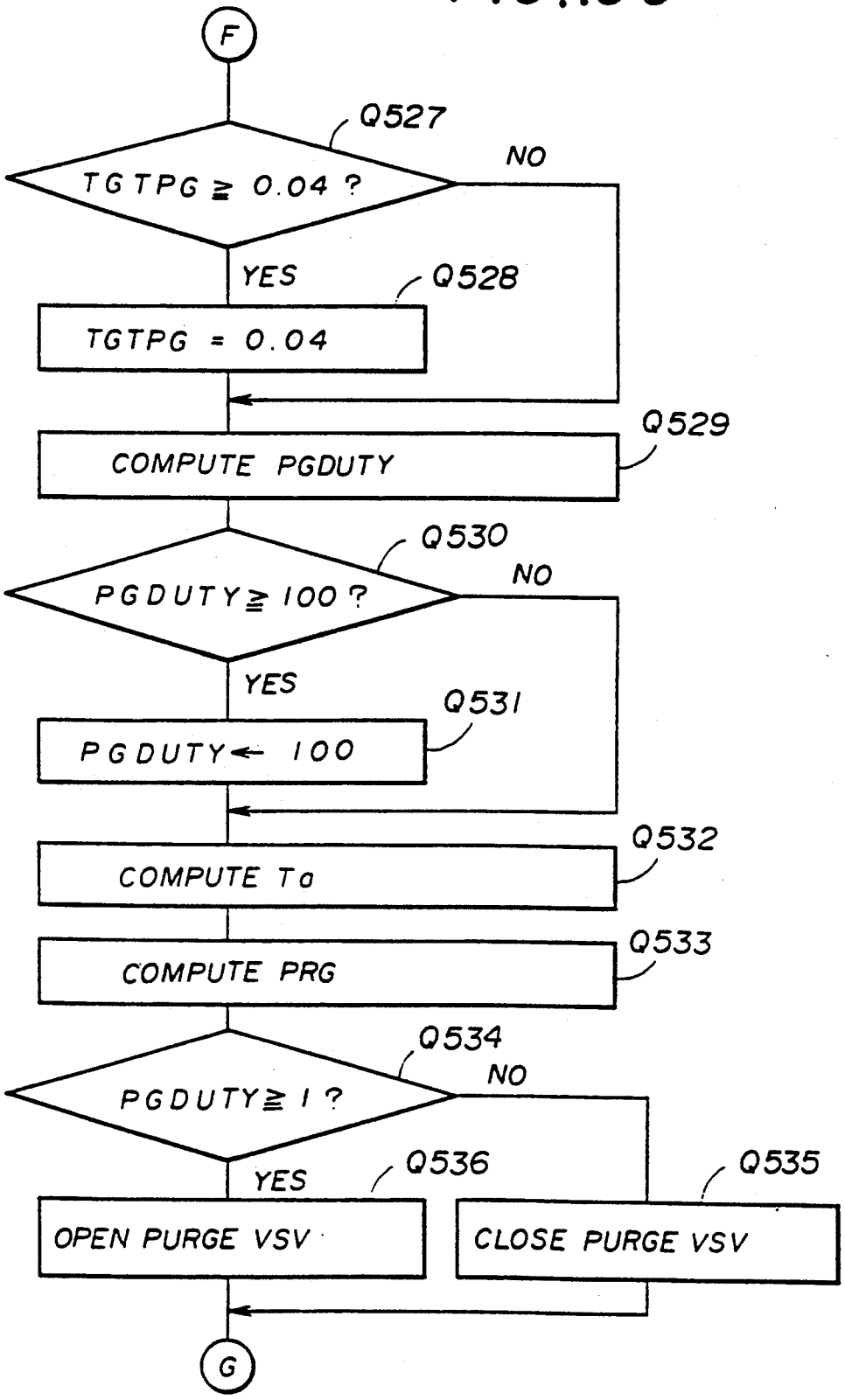
Figure 19D:
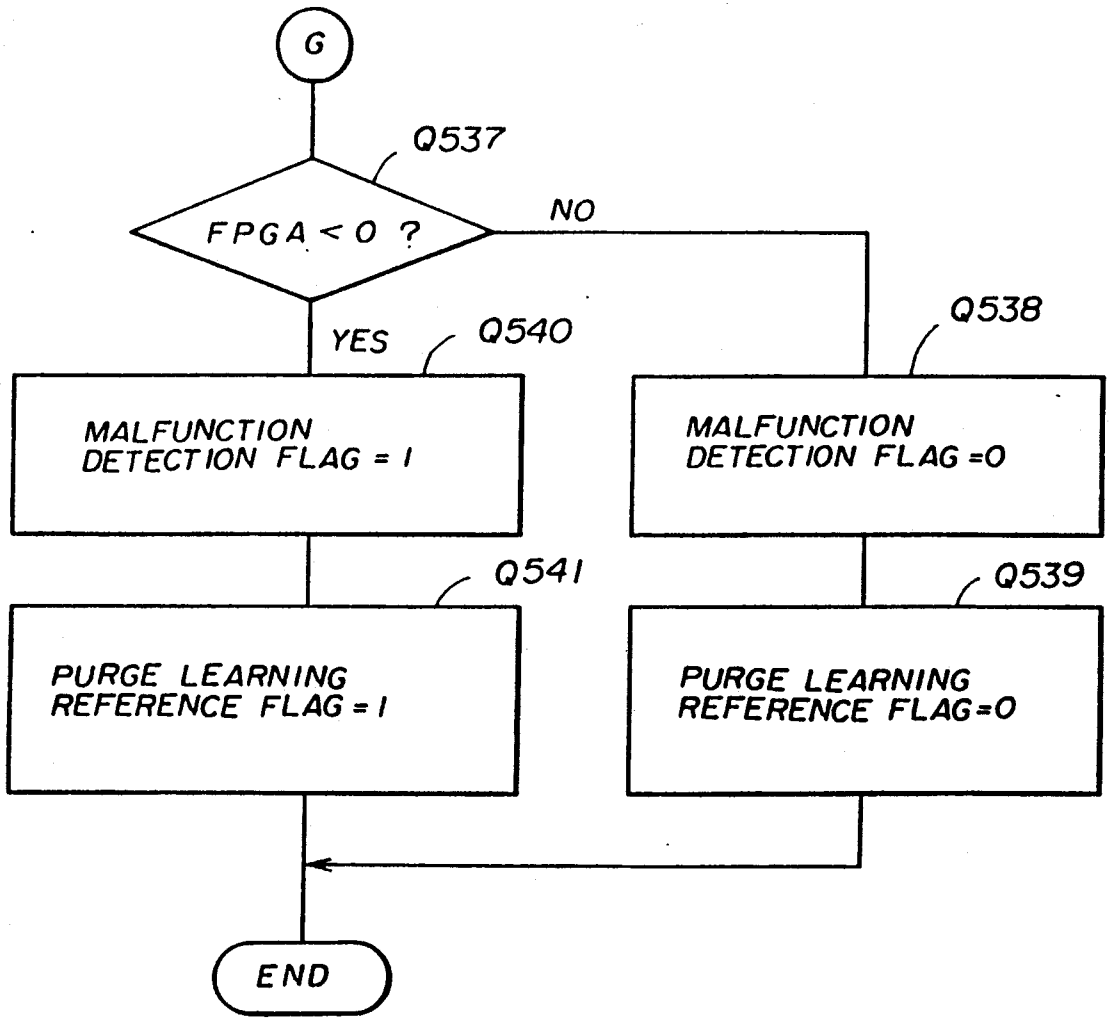

Next, a description will be given, with reference to FIGS. 19A, 19B, 19C, and 19D, of a fourth embodiment of the fuel amount detecting routine. This embodiment provided in the purge control routine in which an air-fuel ratio learning control for a purge operation is performed against a change in the air-fuel ratio during the purge operation, and the flow charts shown in FIG. 19A to 19C are for performing the purge control.

When the routine is interruptedly started, for example every 1 ms, in Q501, a timer counter T is incremented by 1. In Q502, it is judged whether or not the timer counter T is 100. When the timer counter T is less than 100, it is judged, in Q503, whether or not a purge counter PGC is equal to or greater than 6. Since the purge counter PGC is set to 0 by the initial routine, the routine proceeds to Q504. In Q504, a purge ratio PRG is cleared to 0, and in Q505, a signal for closing the purge VSV 38 is sent, and the routine ends. If it is judged that PGC is equal to or greater than 6, then it is judged, in Q506, whether or not the timer counter T is greater than Ta. If T is equal to or greater than Ta, the routine proceeds to Q505 where the purge VSV 38 is closed.

When it is judged that T=100 in Q502, the routine proceeds to Q507 where the timer counter T is cleared to 0, and the routine proceeds to Q508. Accordingly, the step Q508 is repeated every 100 ms. In Q508, it is judged whether or not the purge counter PGC is equal to or greater than 1. As mentioned above, since the initial value of PGC is 0, the routine proceeds to Q509 where it is judged whether or not the purge conditions are established.

The purge conditions are the same as the above mentioned purge conditions. If the purge conditions are not established, the routine ends. If the purge conditions are established, the purge counter PGC is set to 1 in Q510. In Q511, FAFVA, which is a mean value of the air-fuel ratio feedback correction factor FAF, is substituted for the feedback factor FAB, and the routine ends.

If this step is executed every 100 ms, the next time routine proceeds to Q512 as the purge counter PGC is equal to or greater than 1. In Q512, the purge counter PGC is incremented by 1, and in Q513, it is judged whether or not PGC is equal to or greater than 6. At that moment, since PGC is less than 6, the routine ends after executing Q504 and Q505.

When 500 ms have elapsed since the establishment of purge conditions, it is judged that PGC is equal to or greater than 6, and the routine proceeds to Q514. In Q514, it is judged whether or not the value of PGC is 156, that is, whether or not 15 seconds have elapsed since establishment of purge conditions. At this time, since the PGC is equal to 6, FAF is compared to the upper threshold value ($FBA+\delta$) and the lower threshold value ($FBA+\delta$) in Q515 and Q516 respectively.

When it is judged that FAF is equal to or greater than ($FBA+\delta$) in Q515, it is judged whether or not the air-fuel ratio is lean ($V \leqq 0.45$ V) based on the detected voltage supplied by the $O_2$ sensor 47 in Q517. If it is judged that the air-fuel ratio is on the lean side, a predetermined value $\epsilon$ is subtracted from the last value of a purge vapor concentration factor FPGA in Q518. On the other hand, when it is judged, in Q516, that FAF is equal to or less than ($FBA-\delta$), it is judged whether or not the air-fuel ratio is on the rich side ($V \geqq 0.45$ V) based on the detected voltage supplied by the $O_2$ sensor 47 in Q519. If it is judged that the air-fuel ratio is rich, a predetermined value $\epsilon$ is added to the last value of the purge vapor concentration factor FPGA in Q520.

If it is judged that $FBA+\delta>FAF>FBA-\delta$ or that the conditions in Q517 or Q519 are not established, the routine proceeds to Q525 without changing FPGA. Also, after the execution of Q518 or Q520, the routine proceeds to Q525.

The initial value of the above mentioned purge vapor concentration factor FPGA is set to 0 by the initial routine. In Q514, if it is judged that PGC is equal to 156, the routine proceeds to Q521 where it is judged whether or not a purge learning reference flag is set to 1. If the purge learning reference flag, explained in the following, is set to 1, the computation of FPGA is not performed, and the routine ends.

When performing a malfunction detecting operation, a negative pressure inside the surge tank 26 is introduced into the fuel tank 30 via the canister 33. Due to this, the fuel vapor in the evaporative fuel purge system is suctioned into the surge tank 26 that resulting in a rich condition of the air-fuel ratio. If FPGA, which is a purge learning value, is transmitted to the purge operation under this condition, the air-fuel ratio becomes even richer. Therefore, the transmission of the purge learning value is stopped during the malfunction detecting operation. It should be noted that computation of the fuel injection time is performed under a condition where FPGA is 0 when the purge learning reference flag is set.

If it is judged, in Q512, that the purge learning reference flag is set, the purge vapor concentration factor FPGA is computed, in Q522, by the following equation.

$$FPGA=FPGA-\{(FAFAV-FBA)/(2*PRG)\} \quad (1).$$

As shown in the equation (1), FPGA is a value based on FAFAV, FBA, and PRG. If FAFAV is less than FBA, FPGA is increased, and if FAFAV is greater than FBA, it is decreased.

After the computation of FPGA is performed in Q522, the purge counter PCG is set to 6 in Q523 so that Q521 and Q522 are executed every 15 seconds. In Q521 following, an FPGA computation end flag is set, and the routine proceeds to Q525. In Q525, the maximum purge rate MAXPG is computed using the engine rotational speed NE and the suction air amount with reference to the following table.

| NE | Q/N 0.15 | 0.30 | 0.45 | 0.60 | 0.75 | 0.90 | 1.05 | 1.20 | 1.35 | 1.50 | 1.65 |
|---|---|---|---|---|---|---|---|---|---|---|---|
| 400 | 25.6 | 25.6 | 21.6 | 15.0 | 11.4 | 8.6 | 6.3 | 4.3 | 2.8 | 0.8 | 0 |
| 800 | 25.6 | 16.3 | 10.8 | 7.5 | 5.7 | 4.3 | 3.1 | 2.1 | 1.4 | 0.4 | 0 |
| 1600 | 16.6 | 8.3 | 5.5 | 3.7 | 2.8 | 2.1 | 1.5 | 1.2 | 0.9 | 0.3 | 0 |
| 2400 | 10.6 | 5.3 | 3.5 | 2.4 | 1.8 | 1.4 | 1.1 | 0.8 | 0.6 | 0.3 | 0.1 |
| 3200 | 7.8 | 3.9 | 2.6 | 1.8 | 1.4 | 1.1 | 0.9 | 0.6 | 0.5 | 0.4 | 0.2 |
| 4000 | 6.4 | 3.2 | 2.1 | 1.5 | 1.2 | 0.9 | 0.7 | 0.6 | 0.4 | 0.4 | 0.3 |

The maximum purge rate MAXPG represents a ratio of the purge amount to the suction air amount when the purge VSV 38 is fully opened. As apparent from the above table, MAXPG is a function with respect to the engine load Q/N and the rotation speed NE. MAXPG becomes greater as the engine load Q/N decreases, and MAXPG becomes greater as the rotation speed decreases.

Next, in Q526, a target purge rate TGTPG is computed by adding a constant purge change rate PGA to the purge rate PRG. Accordingly, the target purge rate TGTPG is increased by the constant PGA every 100 ms.

Next, in Q527 and Q528 shown in FIG. 19C. The target purge rate TGTPG is processed in an upper limit guard process. Namely, an increase or decrease of the target purge rate is limited within 4% of the purge rate PGA because if TGTPG becomes too great, the air-fuel ratio cannot be maintained at the stoichiometric air-fuel ratio.

In Q529, a drive duty ratio PGDUTY for the purge VSV 38 is computed as per the following equation by using the maximum purge rate MAXPG computed in Q525 and the target purge rate TGTPG computed in Q526.

$$PGDUTY=(TGTPG/MAXPG)*100 \quad (2).$$

In the following step Q530, it is judged whether or not the duty ratio PGDUTY is equal to or greater than 100. If PGDUTY is less than 100, the routine jumps to Q532. If PGDUTY is equal to or greater than 100, the routine proceeds to Q531 where PGDUTY is set to 100, and the routine proceeds to Q 532. In Q532, the timer counter Ta, which is provided for closing the purge VSV 38, is computed. In Q533, the purge rate PRG is computed by the following equation.

$$PRG=MAXPG*PGDUTY/100 \quad (3).$$

The purge rate PRG is, as apparent from the equations (2) and (3), equal to the target purge rate TPTPG as long as the duty ratio PGDUTY is less than 100. However, if the duty ratio PGDUTY exceeds 100 due to a decrease of the maximum purge rate MAXPG, PGDUTY is limited to 100, and thus the purge rate PRG becomes less than the target purge rate TGTPG.

Next, in Q534, it is judged whether or not PGDUTY is equal to or greater than 1. If PGDUTY is less than 1, the purge VSV 38 is closed in Q535. On the other hand, if PGDUTY is equal to or greater than 1, the purge VSV 38 is opened in Q536. After execution of Q535 or Q536, the routine proceeds to Q537 of FIG. 19D, where it is judged whether or not a purge vapor concentration factor FPGA is a negative value.

Meanwhile, the fuel injection time TAU is computed as per the following equation.

$$TAU=TP*\{1+K+(FAF-1)+FPG\} \quad (4).$$

Where TP is a basic fuel injection time, K is a correction factor, FAF is an air-fuel feedback correction factor, and FPG is a purge A/F correction factor.

The basic fuel injection time TP is a fuel injection time, obtained by experiment, required for setting a fuel-air ratio to the target air-fuel ratio. TP is stored in the ROM 51 as a function with respect to the engine load Q/N and rotation speed NE. The correction factor K represents a warm-up increasing factor and an acceleration increasing factor, and K is 0 when such a correction is not needed.

The purge A/F correction factor FPG is provided for correcting a fuel injection amount when a purge operation is performed, and thus FPG is 0 when the purge operation is not preformed. The purge A/F correction factor FPG is obtained as per the following equation.

$$FPG = FPGA * PRG \quad (5).$$

Accordingly, as apparent from the equation (5), if FPGA decreases, the fuel injection amount increases. In other words, when the FPGA is decreased to a negative value, FPG becomes a positive value, and thus the fuel injection amount is increased. When FPGA is a negative value, it is considered that there is little fuel vapor remaining in the canister 33.

Accordingly, when it is judged, in Q537, that FPGA is equal to or greater than 0, it is judged that the fuel vapor in the canister 33 is not less than the predetermined value, and the purge learning reference flag is cleared to 0 in Q539 and the routine ends. On the other hand, when it is judged that FPGA is less than 0 in Q537, that is, when there is a small amount of fuel vapor remaining in the canister 33, the malfunction detection flag is set to 1 in Q540. Additionally, in Q541, the purge learning reference flag is set to 1, and the routine ends.

When this routine is restarted 100 ms later, the routine proceeds to Q506 after executing Q501, Q502, and Q503. In Q506, it is judged whether or not the timer counter T is equal to or greater than Ta. If T is less than Ta, the routine ends. If T is equal to or greater than Ta, the purge VSV is closed. Accordingly, when PGC is equal to or greater than 6, that is, 500 ms have elapsed since the start of the purge control, the fuel vapor is purged by opening of the VSV 38. An opening time interval of the VSV 38 corresponds to the duty ratio PGDUTY.

Since the target purge rate TGTPG increases as the purge counter PGC increases, the duty ratio PGDUTY is increased and the vapor amount to be purged is gradually increased.

As mentioned above, in this embodiment, since the concentration of the purged vapor is proportional to the maximum purge rate MAXPG of the suction air in the case where the amount of fuel vapor in the canister 33 is constant, the purge amount is increased by increasing the opening of the VSV 38 in response to the decrease of the maximum purge rate MAXPG so that the concentration of the purged vapor in the suction air stays constant. Namely, the concentration of fuel vapor in the suction air can be maintain in constant regardless of conditions of the engine by controlling the opening of the VSV 38 in response to the ratio of the target purge rate TGTPG to the maximum purge rate MAXPG when TGTPG is constant; thus fluctuation of the air-fuel ratio is prevented even if the operation of the engine is in a transition condition.

On the other hand, when the purge operation has started, the air-fuel ratio feedback correction factor is decreased so as to maintain the air-fuel ratio at the stoichiometric air-fuel ratio. Accordingly, FAFV, which is the mean value of the air-fuel ratio feedback correction factor, is gradually decreased after the start of the purge operation. In this case, the greater the concentration of the purged fuel vapor to the suction air, the greater the decrease amount of the air-fuel ratio feedback correction factor FAF. Since the decreasing amount of FAF is proportional to the concentration of the purged vapor in the suction air, the concentration of the purged vapor in the suction air can be obtained by using the decreasing amount of FAF.

In this case, as mentioned above, the concentration of the purged vapor is not affected by a transition operation of the engine, and thus the concentration of the purged vapor is proportional to the target purge rate; and the multiplication of the purge vapor concentration factor FPGA and the target purge rate TGTPG is proportional to TGTPG even when the engine is in a transition condition. In the present embodiment, by correcting the fuel injection amount based on the concentration of purged vapor or based on the product of the purge vapor concentration factor FGPA and the target purge rate TGTPG when the air-fuel ratio feedback correction factor changes, the air-fuel ratio can be maintained at the stoichiometric air-fuel ratio whether or not the engine is in a transition condition.

Next, a description will be given of a malfunction detecting process according to the second embodiment. Although parts of the malfunction detecting processes of the second embodiment and variations thereof are different from each other, the description is focused on the process of the second embodiment.

It should be noted that, in the processes of the first and second variations of the second embodiment, the pressure switching valve 82 and the purge VSV 38 are opened for a predetermined period of time. Then, a degree of rate of change of a negative pressure introduced in the evaporative fuel purge system 3 is monitored by the pressure sensor 40, and it is determined that the system 3 is in the normal condition when the rate of change of the pressure inside the system exceeds a predetermined value.

Figure 20A:
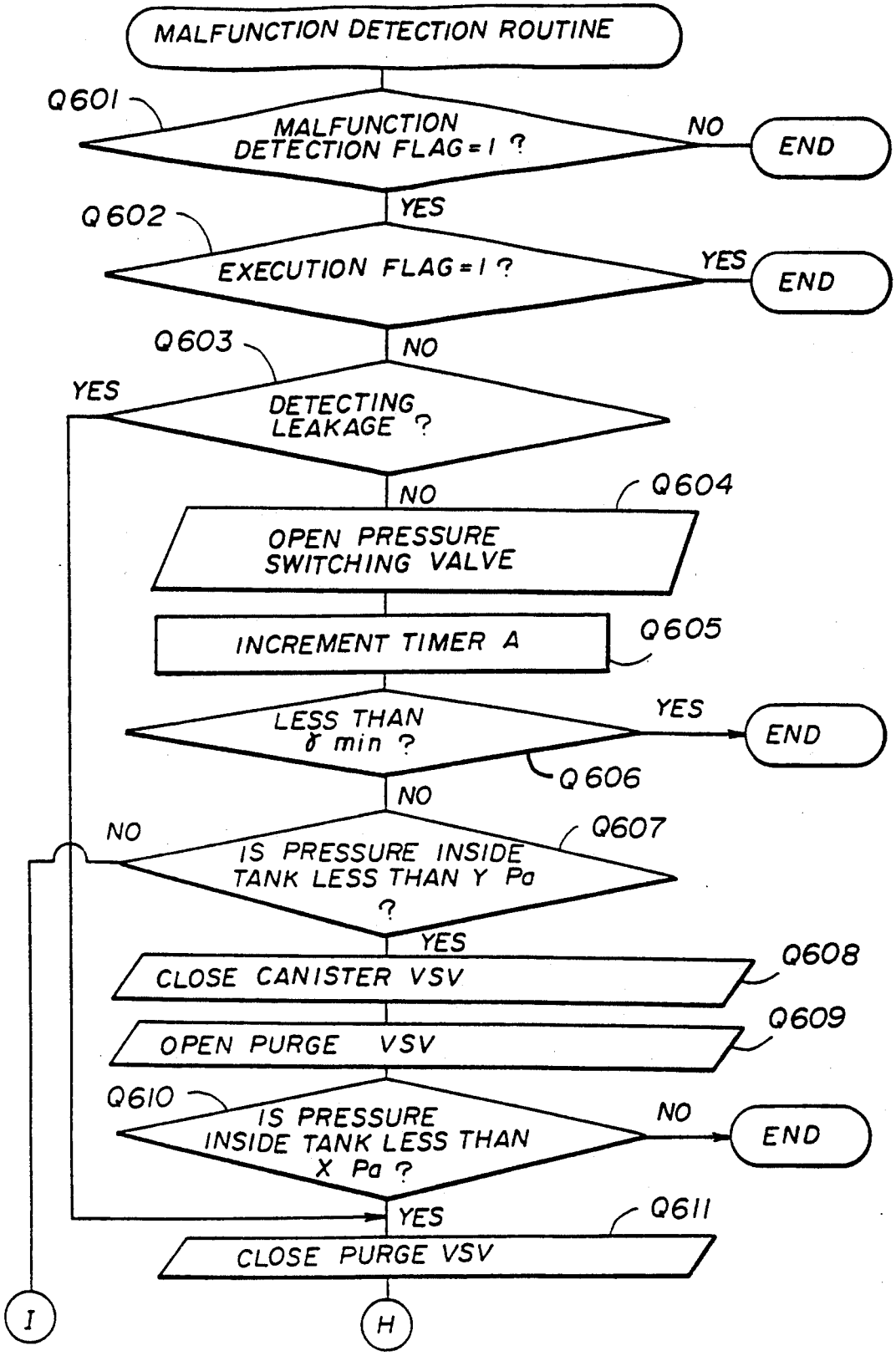
FIGS. 20A and 20B are parts of a flow chart of a malfunction detecting routine of the second embodiment according to the present invention.
Figure 20B:
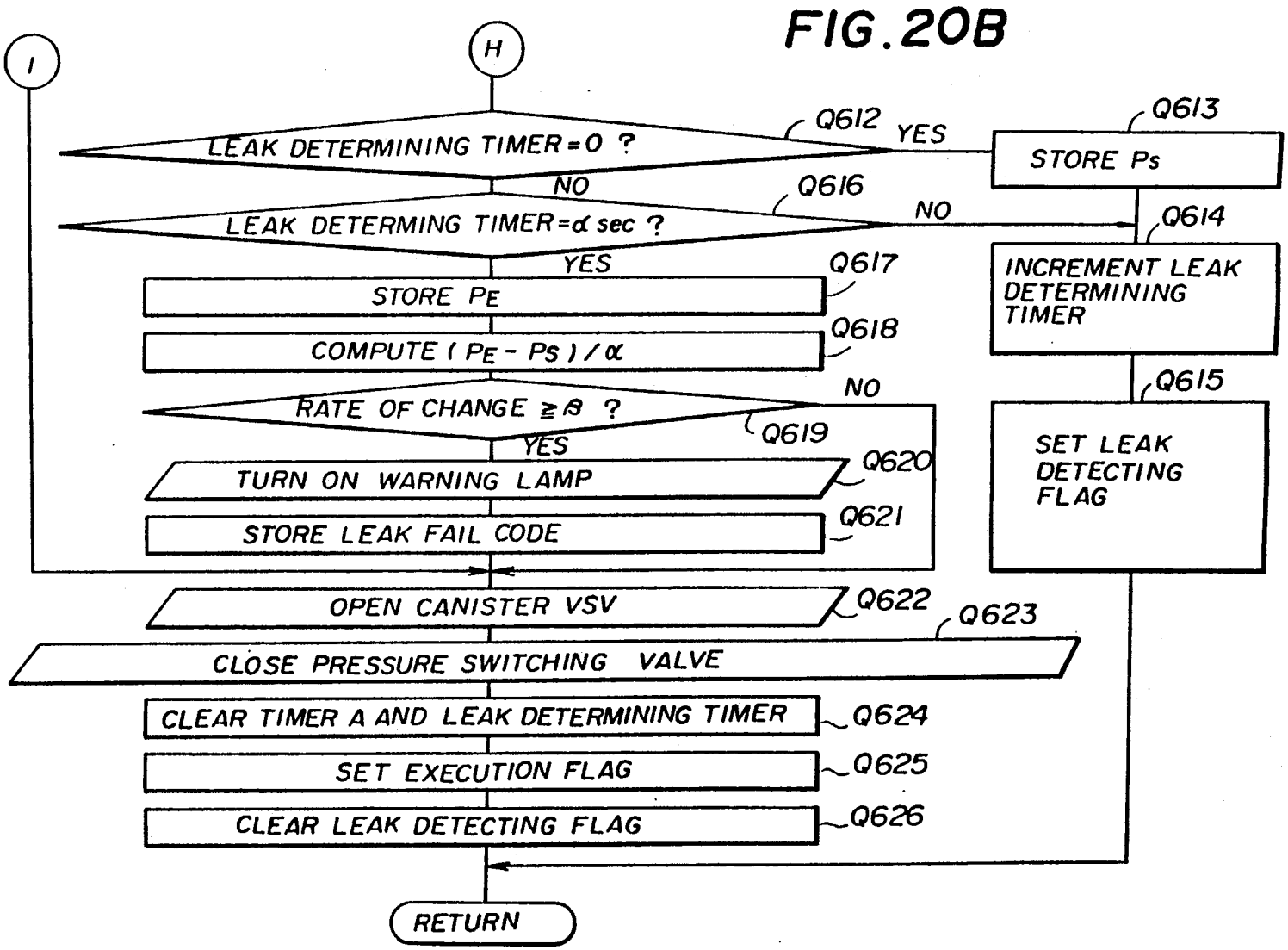

When a malfunction detection routine shown in FIGS. 20A and 20B starts at every predetermined period, it is judged, in Q601, whether or not the malfunction detection flag is set to 1. If it is judged that the malfunction detection flag is set to 1, the following malfunction detection operation is performed.

First, it is judged whether or not an execution flag is set to 1 in Q602. Since the execution flag has been cleared to 0 by the initial routine at starting time of the engine, the routine proceeds to the next step Q603 where it is judged whether or not a leak detection flag is set to a predetermined value. Since the leak detection flag is also cleared by the initial routine, the routine proceeds to the next step Q604. In Q604, the pressure switching valve 82 is opened, and in Q605, a timer A is incremented. In Q606, it is judged whether or not the timer A exceeds a value corresponding to $\tau$ minutes. If $\tau$ minutes have not elapsed, the routine ends.

In later execution of the routine, when it is judged that $\tau$ minutes have elapsed in Q606, the routine proceeds to Q607 where it is judged whether or not the pressure inside the fuel tank 30 is less than a predetermined pressure value Y Pa. When the generated amount of fuel vapor in the fuel tank 30 is small, the pressure inside the fuel tank 30 has become less than Y Pa after a predetermined period of time. This is shown by (C) and (D) of FIG. 21. The pressure inside the tank is lower than the predetermined value Y at time $t_1$ when the predetermined period of time $\tau$ has elapsed since the opening time $t_0$ of the pressure switching valve 82.

Figure 21:
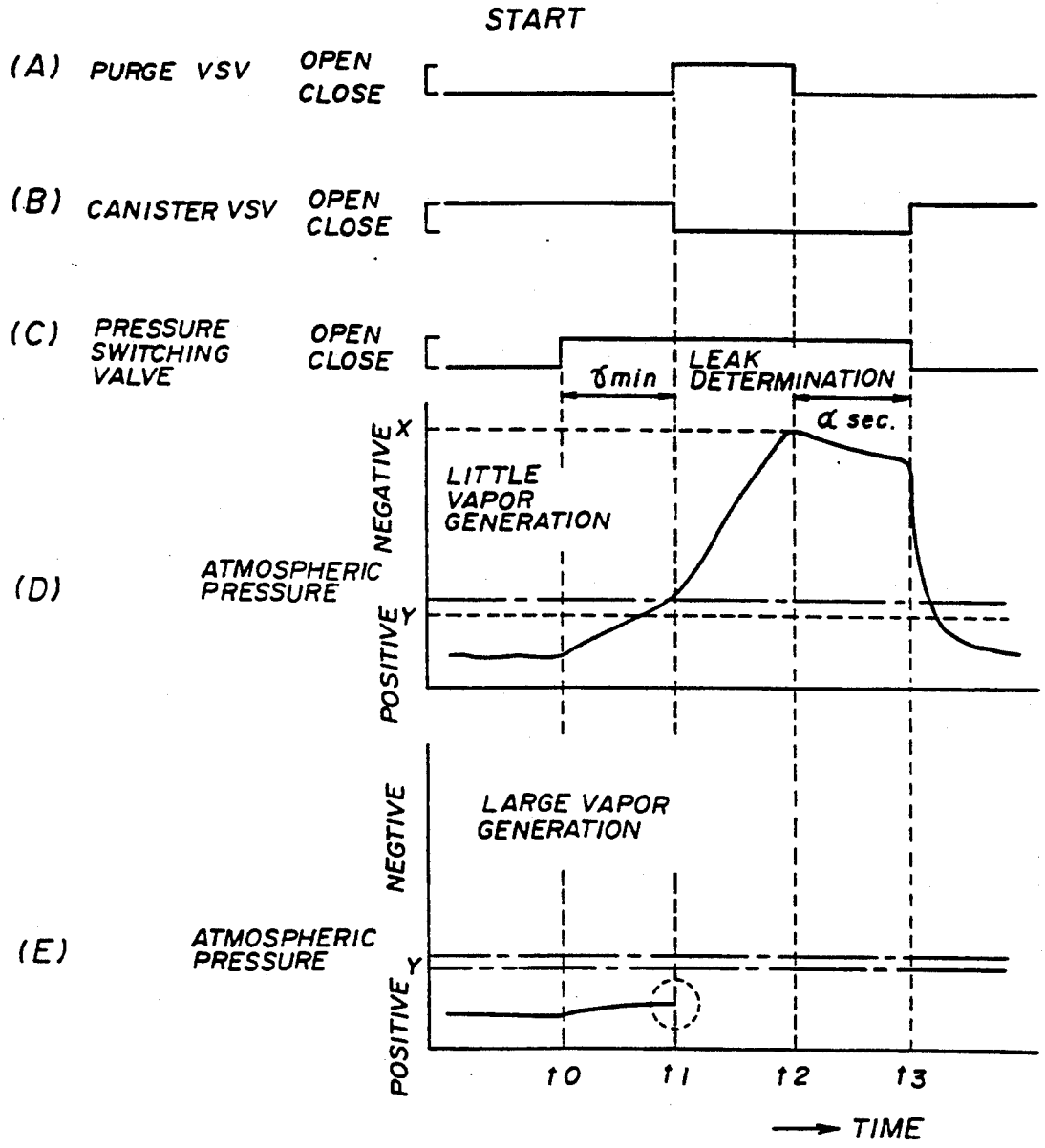
FIG. 21 is a time chart for explaining an operation of the routine shown in FIG. 20.

In Q608, the canister VSV 36 is closed at the time $t_1$ as indicated by (B) of FIG. 21, and also in Q609, the purge VSV 38 is opened at the time $t_1$ as indicated by (A) of FIG. 21. On the assumption that the closing of the VSV 36 is executed at time $t_1$ as indicated by (B) of FIG. 21 and the opening of the VSV 38 performed at substantially the same time $t_1$ as indicated by (A) of FIG. 21, a negative pressure of the combustion chamber is effected to the fuel tank 30 via the purge passage 39, the purge VSV 38, the purge passage 37, the canister 33, the vapor passage 32*b*, the pressure switching valve 82, and the vapor passage 32*c* and 32*d*. Accordingly, a pressure inside the fuel tank 30 rapidly decreased after the time $t_1$ as indicated by (D) of FIG. 21.

Next, in Q610, it is judged whether or not the pressure inside the fuel tank 30 is less than X Pa. When the pressure is less than X Pa, the routine ends as the operation is in a negative pressure setting condition. Execution of the above mentioned steps Q601 to Q610 are repeated every 65 ms until the negative pressure inside the fuel tank 30 reaches X Pa. When it is judged that the negative pressure is lower than X Pa in Q610, the VSV 38 is closed at time $t_2$, as indicated by (A) of FIG. 21 in Q611.

Since the two VSVs 36 and 38 are both in the closed condition at the time $t_2$, in the case where there is no malfunction in the system, the pressure inside the system from the purge VSV 38 to the fuel tank 30 very slowly returns to the atmospheric pressure.

After that, in Q612, it is judged whether or not a leak-determining timer is set to 0, since the leak-determining timer is set to 0 by the aforementioned initial routine, the routine proceeds to Q613 the first time the step Q612 is executed. In Q613, the present value obtained by the pressure sensor 40 is set as a detection-start pressure value $P_S$ and the value is stored in the RAM 52.

Next, a predetermined value is added to the value of the leak-determining timer in Q614, and the leak detection flag is set to 1 in Q615, and then the routine ends. When the routine starts at the next time, the routine jumps the steps from Q604 to Q610 and proceeds to Q611 as it is judged that the leak detection flag is set to 1.

This time, since it is judged, in Q612, that the leak-determining timer is not set to 0, the routine proceeds to Q616 where it is judged whether or not the value of the leak-determining timer is equal to a value corresponding to a determination time $\alpha$ (a time for executing a leak determination). If the value is not equal to the value corresponding to the time $\alpha$, the routine ends after executing Q614 and Q615.

The steps Q601, Q602, Q603, Q611, Q612, Q616, Q614 and Q615 are executed every 65 ms. When the value of the leak-determining timer is equal to a value corresponding a determination time $\alpha$, a value obtained by the pressure sensor 40 is set as a detection-end pressure value $P_E$ and the value is stored in the RAM 52 in Q617. Then in Q618, a rate of change is computed as per a relationship represented by $(P_S-P_E)/\alpha$ by using the values $P_S$ and $P_E$ which are read out from the RAM 52.

Next, in Q619, it is judged whether or not the rate of change is greater than a predetermined threshold value $\beta$. If the rate of change is greater than $\beta$, it is determined, in Q620, that a malfunction has occurred because there is a large leak as the pressure change is rapid and the warning lamp 41 is turned on so as to warn the driver of an occurrence of the malfunction. After that, in Q621, a leak fail code is stored in the back-up RAM 53, and the routine proceeds to Q622. The leak fail code is used for checking a cause of the malfunction in a repair operation by read out the leak fail code from the back-up RAM 53.

On the other hand, if the rate of change is less than $\beta$, the routine proceeds to Q622 by jumping Q620 and Q621, as the leakage is less than the specified value. In Q622, the canister VSV 36 is opened at the time $t_3$ as indicated by (B) of FIG. 21. In Q623, the pressure switching valve 82 is closed. As shown by (C) of FIG. 21, when the canister VSV 36 is opened at time $t_3$, the pressure inside the fuel tank 30 returns to a positive pressure via the atmospheric pressure in a short time as the air is introduced into the system from air inlet port 36*a*.

After that, the leak-determining timer and the timer A is cleared in Q624, the execution flag is set to 1 in Q625, the leak detection flag is cleared to 0 in Q626 and the routine ends. In the future, this routine will not be executed until the engine is restarted because it is judged that the execution flag is set to 1 in Q620.

It should be noted that if the generated amount of fuel vapor in the fuel tank 30 is large, the pressure inside the fuel tank 30 does not reach the predetermined pressure value Y at the time $t_1$, as indicated by (E) of FIG. 21. In this case, in Q607, it is judged that the pressure inside the fuel tank 30 is greater than the predetermined pressure Y Pa, and the routine proceeds to Q622 without performing the leak detection. Therefore, the malfunction detection operation is not performed until the restart of the engine, moreover erroneous detection of malfunction while a large amount of fuel vapor is generated in the fuel tank 30 is prevented.

Additionally, if the pressure inside the fuel tank is higher than the predetermined pressure Y, which is a positive pressure, indicating that the system 3 has little leakage, it can be determined that the evaporative fuel purge system 3 is in the normal condition.

Figure 22:
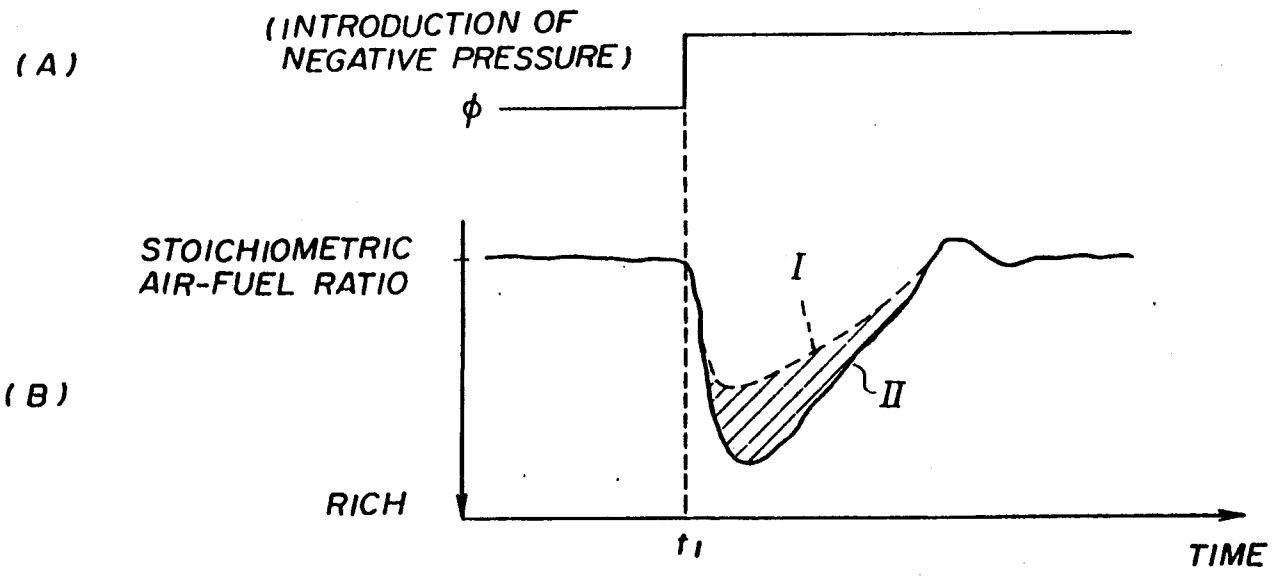
FIG. 22 is a graph for explaining a fluctuation of the air-fuel ratio according to the present invention by comparing with the conventional technology priorly suggested by the applicant of the present invention.

As mentioned above, according to the present embodiment, since introduction of the negative pressure is performed when there is little fuel vapor in the canister, only the fuel vapor in the fuel tank 30 is purged into the surge tank 26. Therefore, the shift of the air-fuel ratio to the rich side according to the present embodiment is reduced as indicated by dotted line I of FIG. 22 compared to a corresponding shift of the conventional technology as indicated by the solid line II. (A) of FIG. 22 indicates a time when the negative pressure is introduced in the system 3, and (B) indicates a fluctuation of the air-fuel ratio of mixture gas suctioned into the engine.

Figure 23:
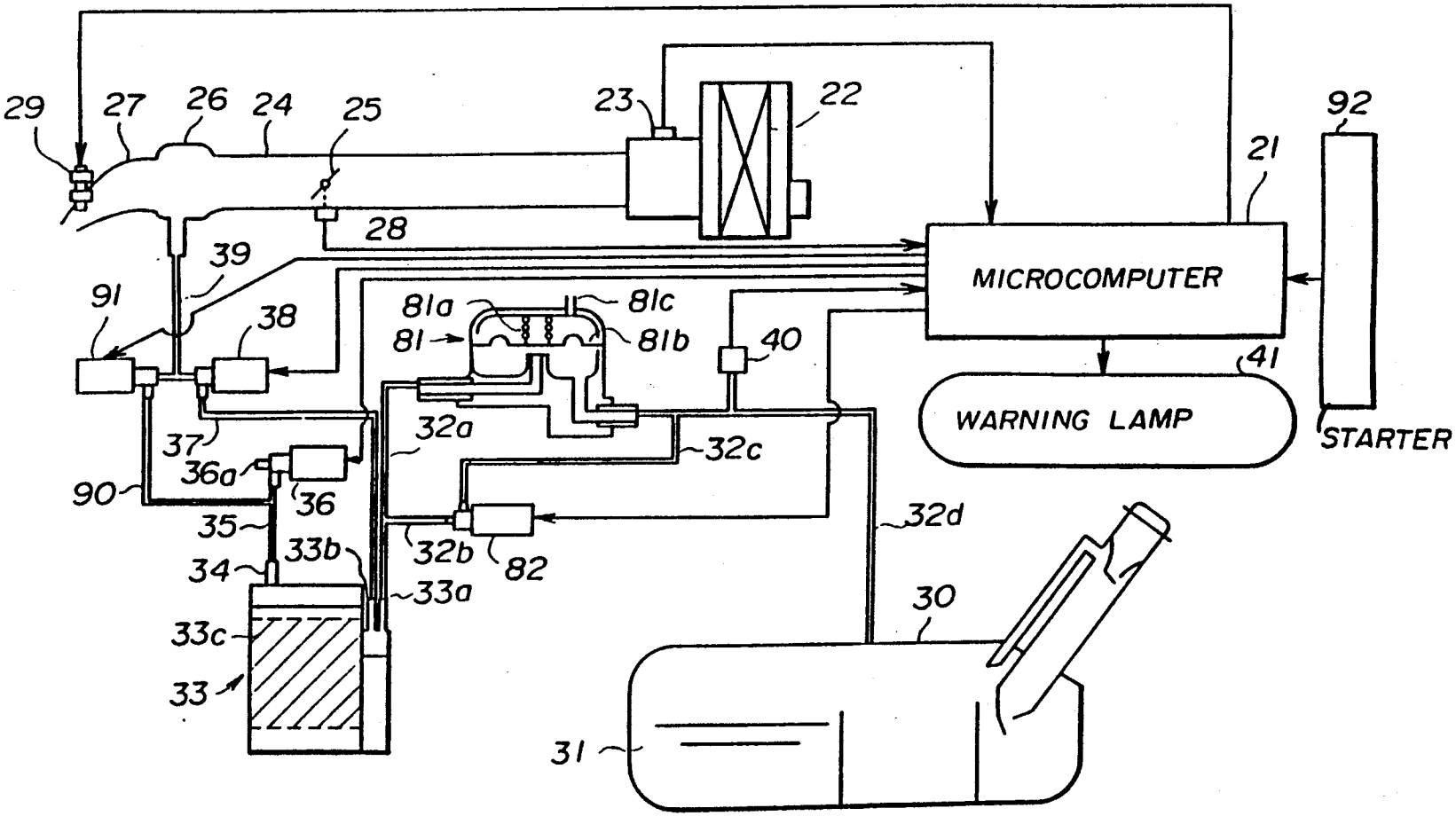
FIG. 23 is a schematic illustration of a construction of a third embodiment according to the present invention.

Next, a description will be given of a third embodiment of the malfunction detection apparatus according to the present invention. FIG. 23 is a schematic illustration of a construction of the third embodiment according to the present invention.

The construction of the apparatus of the third embodiment is similar to that of the second embodiment shown in FIG. 10. In FIG. 23 parts that are the same as parts shown in FIG. 10 are given the same reference numerals from figure to figure, and description thereof will be omitted.

The apparatus of the third embodiment shown in FIG. 23 does not have the rotation angle sensor 87 detecting a position of the crank, the oxygen sensor 47 detecting concentration of oxygen in the exhaust gas, or the intake air temperature sensor 83, shown in FIG. 10. Further, the apparatus of the third embodiment does not have the idling speed controlling valve 86 or the bypass passage 85.

However, in addition to the apparatus of the second embodiment shown in FIG. 10, the third embodiment includes a malfunction detection purge VSV 91. One side of the VSV 91 is connected to the purge passage 39 and the other side of the VSV 91 is connected to the air passage 35 via a purge passage 90. According to the provision of the VSV 91, the air passage 35 and the purge passage 39 are communicated by opening the VSV 91 by signals supplied by the microcomputer 21.

Figure 24:
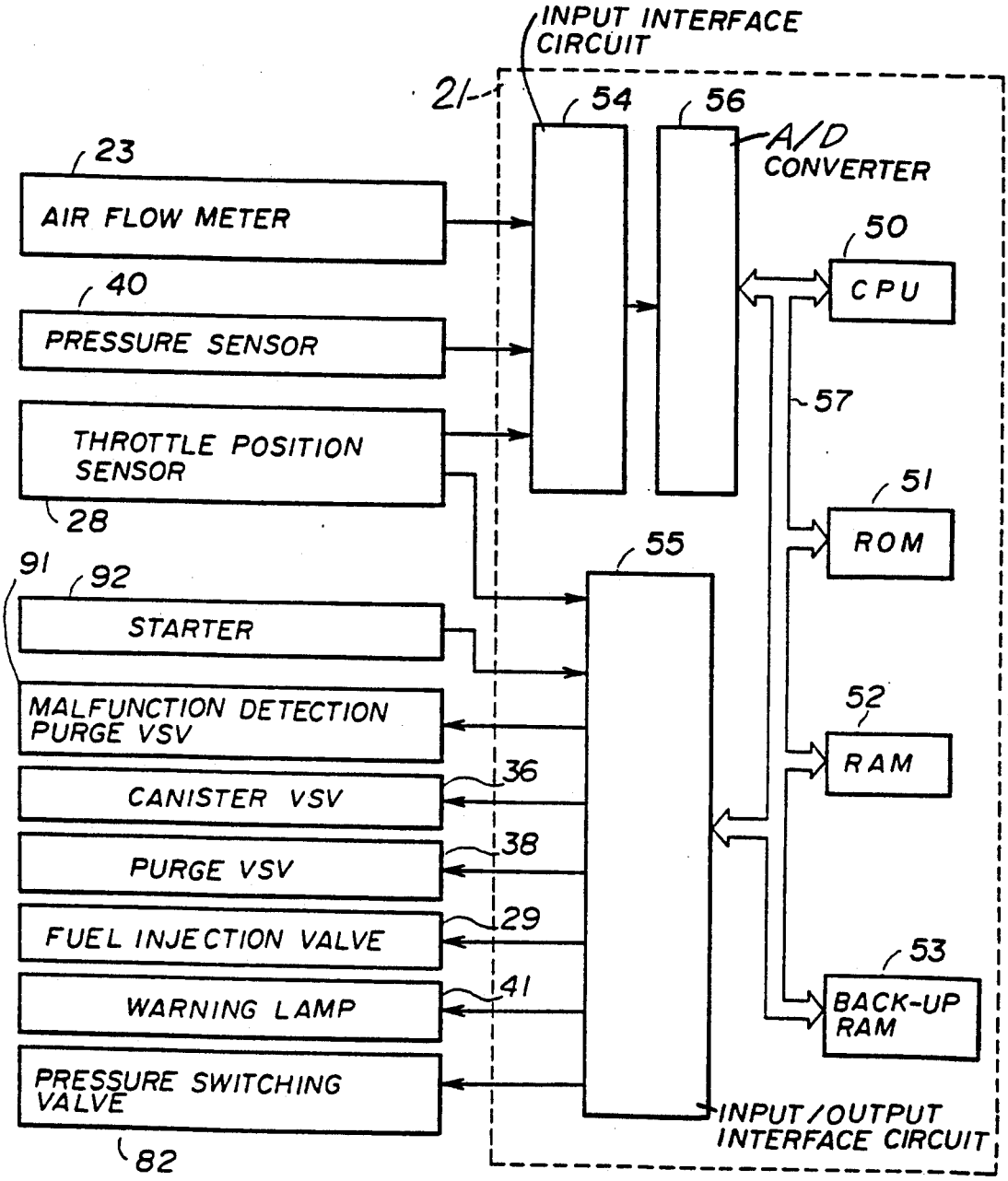
FIG. 24 is a block diagram of a microcomputer shown in FIG. 23.

FIG. 24 is a block diagram of a microcomputer shown in FIG. 23. In FIG. 24, parts that are the same as parts shown in FIG. 11 are given the same reference numerals from figure to figure, and the description thereof will be omitted.

The microcomputer shown in FIG. 24 has the same structure as that shown in FIG. 11. However, signals from the air flow meter 23, the pressure sensor 40 and the throttle position sensor 28 are supplied to the input interface circuit 54, and signals from a starter 92 of the engine are supplied to the input/output interface circuit 55. Additionally, the input/output interface circuit 55 sends signals to the malfunction detection purge VSV 91 in order to control the VSV 91. It should be noted that, as is apparent from the construction of the third embodiment, the input/output interface circuit 55 of the microcomputer 21 of the third embodiment is not connected to the ISCV 88 or the rotation angle sensor 87 as is the previous embodiment.

Figure 25:
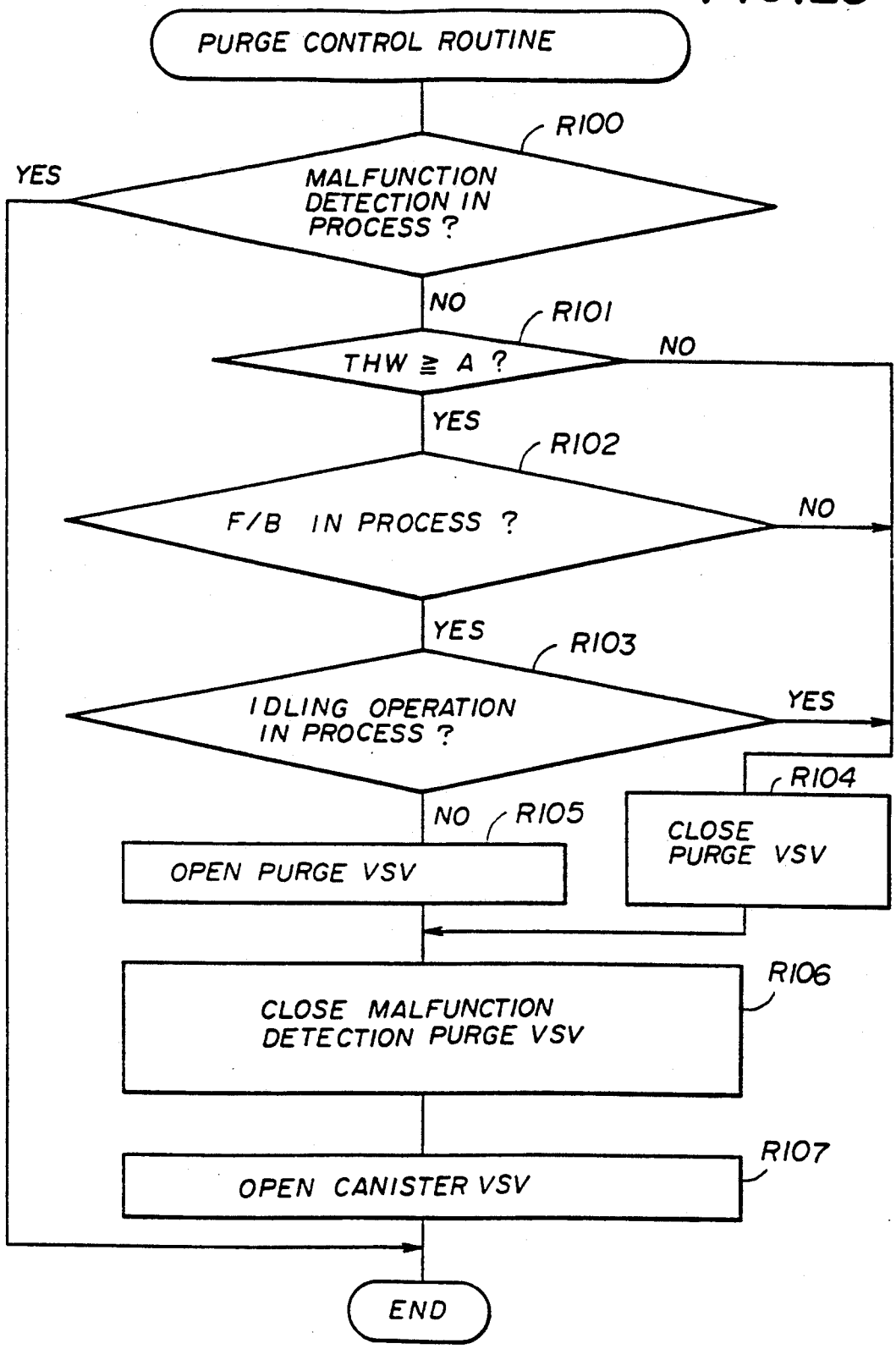
FIG. 25 is a flow chart of a purge control routine of the third embodiment according to the present invention.

Next, a description will be given, with reference to FIG. 25, of the evaporative fuel purging operation according to the present embodiment. The evaporative fuel purging operation is performed by the microcomputer 21 in accordance with the purge control routine shown in FIG. 25. This routine is executed in a part of the main routine.

In step R100 (hereinafter the word "step" is omitted), it is judged whether or not the malfunction detecting operation is in process. If the malfunction detecting operation is being performed, the routine ends. If the malfunction detection operation is not in process, the routine proceeds to R101 where it is judged whether or not the cooling water temperature THW, supplied by a cooling water temperature sensor not shown in the figures, is equal to or greater than a predetermined value A. This process is provided for judging whether or not the engine has been warmed up. When THW is equal to or greater than the value A, the routine proceeds to R 102 where it is judged whether or not the air-fuel ratio feedback operation is in process. When it is judged that the air-fuel ratio feedback operation is being performed, the routine proceeds to R103 where it is judged whether or not the engine is in idling operation. When the engine is not in idling operation, the routine proceeds to R105. In R105, the purge VSV 38 is opened, and then the routine proceeds to R106 where the malfunction detection purge valve 91 is closed.

It should be noted that, the routine proceeds to R104 where the purge VSV 38 is closed and then the routine proceeds to R106 only when THW is less than the value A, the air-fuel ratio feedback operation is in process and the engine is in the idling operation. Namely, the purge VSV 38 is opened for performing the purge operation only when the all conditions in the above mentioned steps R101, R102, and R103 are established.

Following execution of R106, the routine proceeds to R107 where the canister VSV 36 is opened, and the routine ends. During the execution of this routine, the pressure switching valve 82 is always closed. This routine for performing the purge operation is not executed during the malfunction detecting operation due to the provision of the step R100.

Next, a description will be given of a malfunction detection process for the evaporative fuel purge system according to the third embodiment.

Figure 26A:
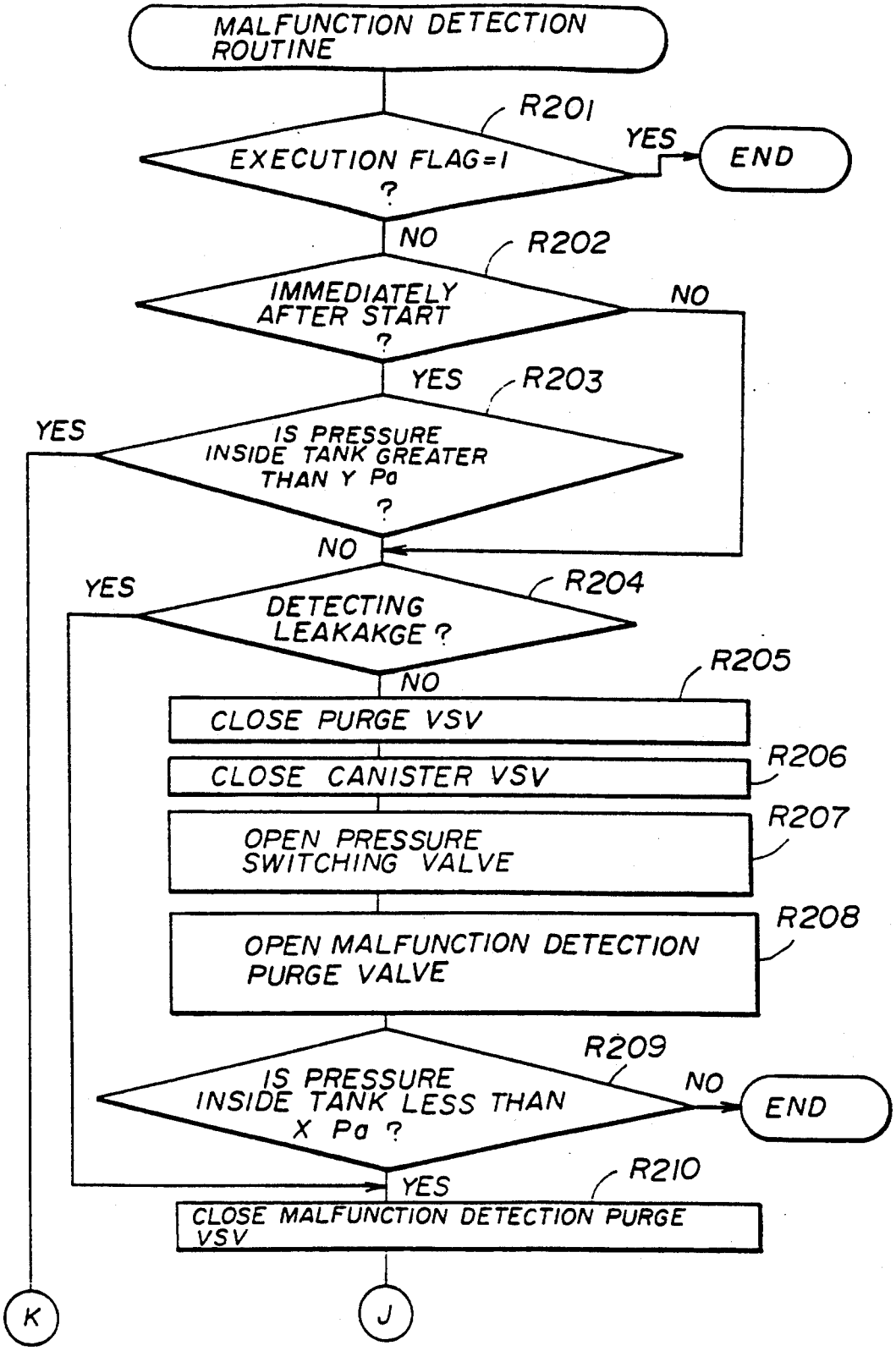
FIGS. 26A and 26B are parts of a flow chart of a malfunction detecting routine of a third embodiment according to the present invention.
Figure 26B:
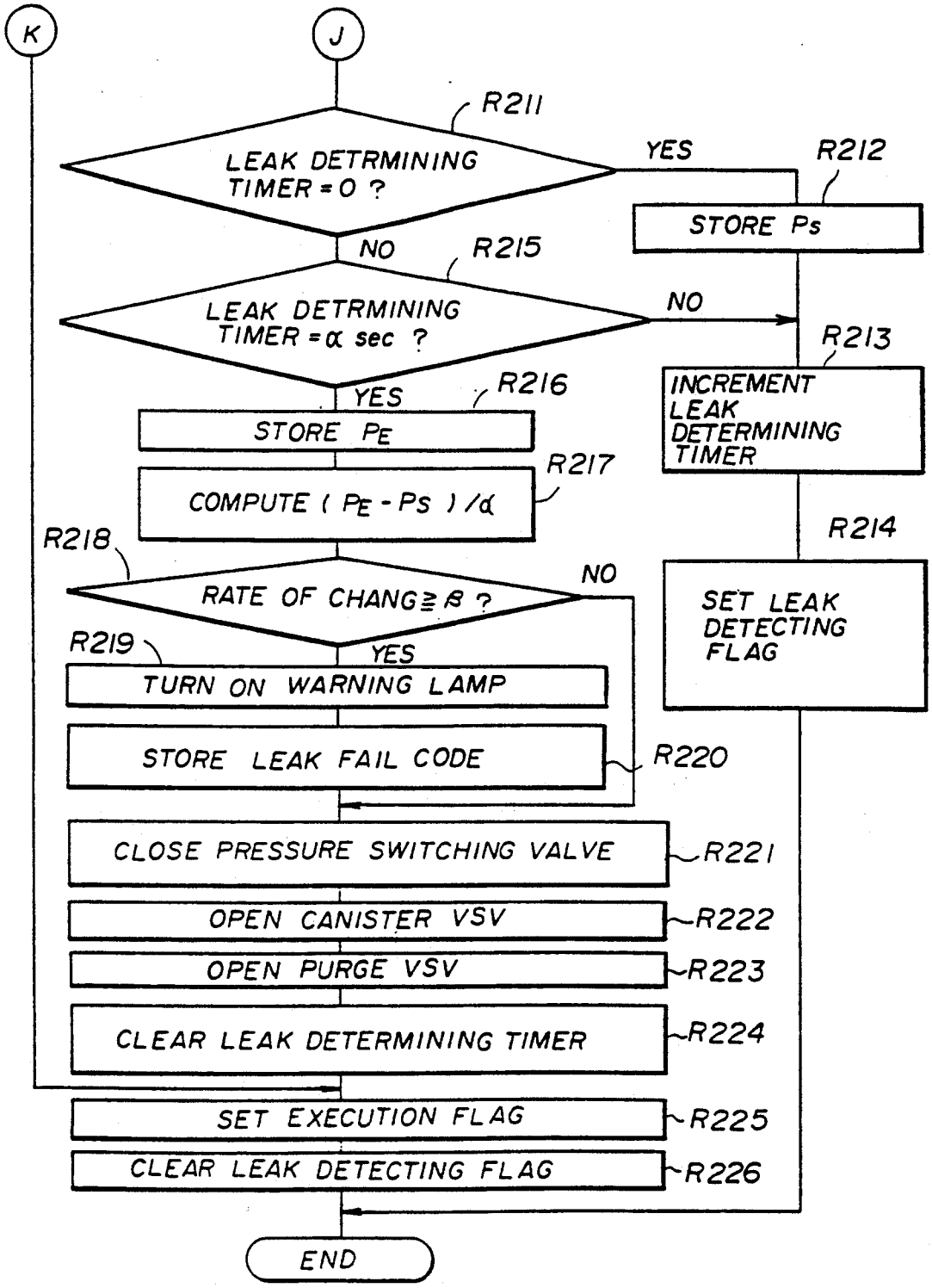

When a malfunction detection routine shown in FIGS. 26A and 26B starts, for example every 65 ms, in R201, it is judged whether or not an execution flag is set to 1. Since the execution flag has been cleared to 0 by the initial routine at starting time of the engine, the routine proceeds to the next step R202.

In R202, it is judged whether or not the engine is in a condition immediately after start; the judgment is determined by existence/nonexistence of a starter signal supplied by the starter 92. When the engine is in a condition immediately after start, the routine proceeds to R203 where it is judged whether or not the pressure inside the fuel tank 30 is greater than a predetermined pressure Y Pa, which is a positive pressure. If the pressure inside the fuel tank 30 is greater than Y Pa, the routine proceeds to R225 where the execution flag is set. Then the routine proceeds to R226 where the leak detecting flag is cleared, and the routine ends. This is because if the pressure inside the fuel tank 30 is greater than the predetermined positive pressure Y Pa, it is considered that there is no leakage in the system and accurate detection cannot be performed due to a large generation of fuel vapor in the fuel tank 30.

When it is judged, in R202, that the engine is not in a condition immediately after start, the routine proceeds to R204. When the pressure inside the fuel tank 30 is less than Y Pa in R203, it is considered that accurate detection of a malfunction can be performed as there is little generation of fuel vapor in the fuel tank 30, and the routine proceeds to R204.

In R204, it is judged whether or not a leak detection flag is set to a predetermined value. Since the leak detection flag is also cleared by the initial routine, the routine proceeds to the next step R205 where the purge VSV 38 is closed. Then the routine proceeds to R 206 where the canister VSV 36 is closed, and the routine proceeds to R207 where the pressure switching valve is opened. After that, in R208, the malfunction detection purge VSV 91 is opened.

By the above mentioned valve operation in R205 to 208, a negative pressure inside the surge tank 26 is introduced to the fuel tank 30 via the purge passage 39, the malfunction detection purge VSV 91, the purge passage 90, the air passage 35, the canister 33, the vapor passage **32*b*, the pressure switching valve 82, and the vapor passage 32*c* and 32*d*. When there is no leakage in the system 3**, the pressure inside the fuel tank is rapidly decreased.

The aforementioned pressure introducing means 10 shown in FIG. 1 comprises the above process in R205 to R208. Since the negative pressure is introduced via the canister 33, the fuel vapor in the fuel tank flows into the canister where most of the fuel vapor is adsorbed by the activated carbon **33*c***. Therefore, the fuel vapor suctioned into the engine is reduced as compared to the aforementioned technology suggested by the current applicant.

Next, in R209, it is judged whether or not the pressure inside the fuel tank 30 is less than X Pa. When the pressure is less than X Pa, the routine ends as the operation is in a negative pressure setting condition. Execution of the above mentioned steps R201 to R209 are repeated every 65 ms until the negative pressure inside the fuel tank 30 reaches X Pa. When it is judged, in R209, that the negative pressure is lower than X Pa, the malfunction detection purge VSV 91 is closed in R210.

By the closing of the VSV 91, all the three VSVs 36, 38, and 91 become closed, and thus the evaporative fuel purge system 3 from the purge passage 37 to the fuel tank 30 is maintained under hermetic conditions when there is no leakage in the system 3. In this case, the pressure inside the system gradually increases to the atmospheric pressure. Upon the execution of R210, the aforementioned determining means 12 of FIG. 1 is realized by execution of the steps R211 to R218.

In R211, it is judged whether or not a leak-determining timer is set to 0. Since the leak-determining timer is cleared to 0 by the aforementioned initial routine, the routine proceeds to R212 the first time the step R211 is executed. In R212, the current value obtained by the pressure sensor 40 is set as a detection-start pressure value $P_S$ and the value is stored in the RAM 52.

Next, a predetermined value is added to the value of the leak-determining timer in R213, and the leak detection flag is set to 1 in R214, and then the routine ends. The next time the routine starts, the routine jumps the steps from R205 to R209 and proceeds to R210 as it is judged that the leak detection flag is set to 1.

This time, since it is judged, in R211, that the leak-determining timer is not set to 0, the routine proceeds to R215 where it is judged whether or not the value of the leak-determining timer is equal to a value corresponding to a determination time $\alpha$ (a time for executing a leak determination). If the value is not equal to the value corresponding to the time $\alpha$, the routine ends after executing R213 and R214.

The steps R201 to R204, R210, R211, R215, R213, and R214 are executed every 65 ms. When the value of the leak-determining timer is equal to a value corresponding a determination time $\alpha$, a value obtained by the pressure sensor 40 is set as a detection-end pressure value $P_E$ and the value is stored, in R216, in the RAM 52. Then in R217, a rate of change is computed as per a relationship represented by $(P_S-P_E)/\alpha$ by using the values $P_S$ and $P_E$ which are read out from the RAM 52.

Next, in R218, it is judged whether or not the rate of change is greater than a predetermined threshold value $\beta$. If the rate of change is greater than $\beta$, it is determined, in Q219, that a malfunction has occurred because there is a large leak, as the pressure change is rapid and the warning lamp 41 is turned on so as to warn the driver of an occurrence of the malfunction. After that, in R220, a leak fail code is stored in the back-up RAM 53, and the routine proceeds to R221. The leak fail code is used for checking a cause of the malfunction in a repair operation by reading out the leak fail code from the back-up RAM 53.

On the other hand, if the rate of change is less than $\beta$, the routine proceeds to R221 by jumping R219 and R220 as the leakage is less than the specified value. In R221, the pressure switching valve 82 is closed, and in R222 the canister VSV 36 is opened. In R223, the purge VSV 38 is opened so as to release the system from hermetic condition.

By the above operation of the valves, the pressure inside the fuel tank 30 returns to a positive pressure in a short time via the atmospheric pressure as air is introduced into the system from the air inlet port 36*a*.

After that, the leak-determining timer is cleared in R224, the execution flag is set to 1 in R225, the leak detection flag is cleared to 0 in R226 and the routine ends. In the future, this routine will not be executed until the engine is restarted because it is judged, in R201, that the execution flag is set to 1.

As mentioned above, according to the present embodiment, since the negative pressure is introduced via the canister 33, the fuel vapor in the fuel tank 30 flows through the canister 33 and most part of the fuel vapor is adsorbed by the activated carbon 33*c*. Therefore, by the above construction, the fluctuation of the air-fuel ratio at the time negative pressure is introduced, is reduced as compared to the apparatus in previous technology suggested by the applicant; the reduction holds even if a canister is used having the vapor introducing port (33*a*) and the purge port (33*b*) connected via the same space in the canister.

Figure 27:
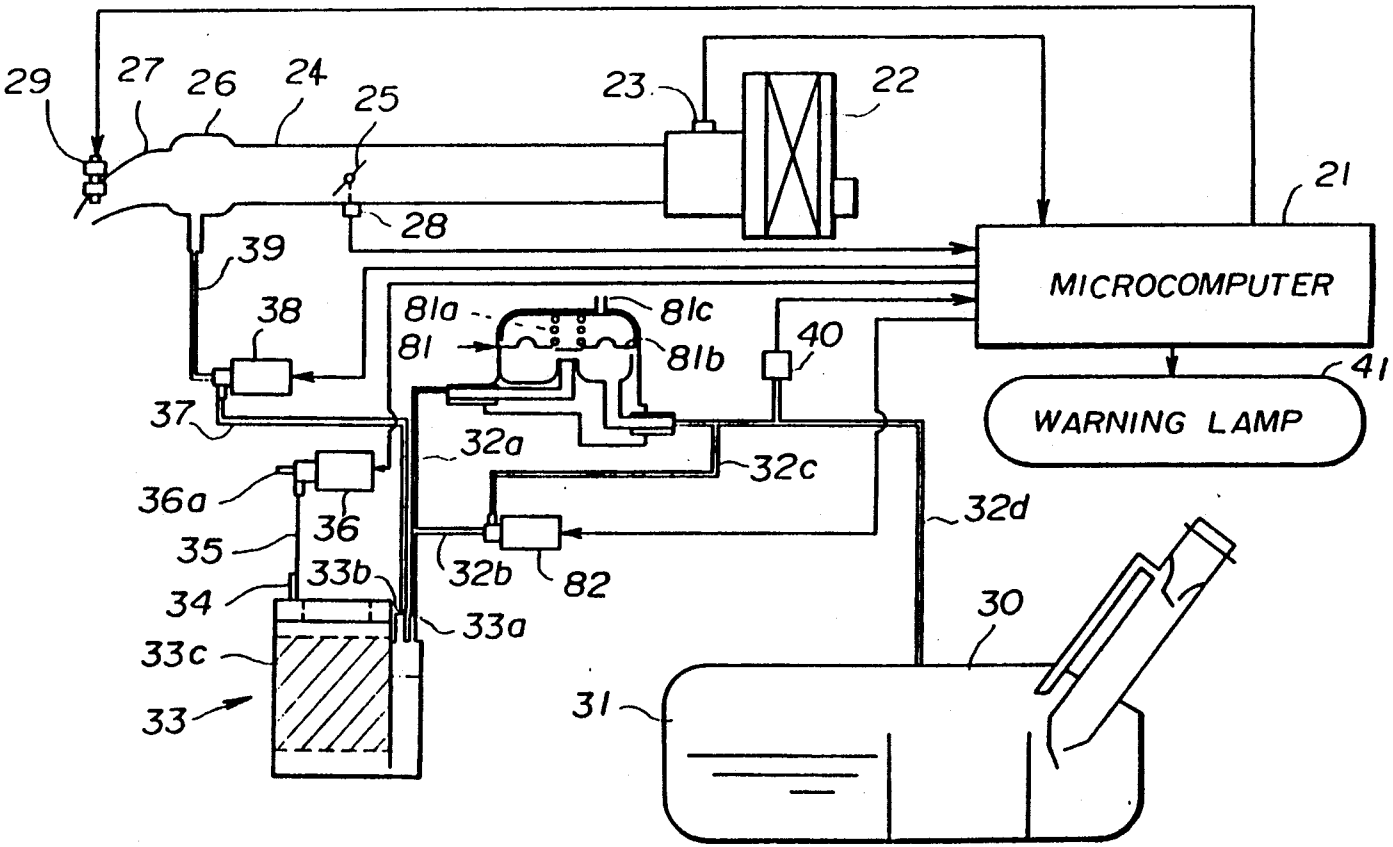
FIG. 27 is a schematic illustration of a construction of a fourth embodiment according to the present invention.

Next, a description will be given of a fourth embodiment of the malfunction detection apparatus according to the present invention. FIG. 27 is a schematic illustration of a construction of the fourth embodiment according to the present invention.

The construction of the apparatus of the third embodiment is similar to that of the second embodiment shown in FIG. 10. In FIG. 27 parts that are the same as parts shown in FIG. 10 are given the same reference numerals from figure to figure, and description thereof will be omitted.

The apparatus of the fourth embodiment shown in FIG. 27 does not have the rotation angle sensor 87 detecting a position of the crank, the oxygen sensor 47 detecting concentration of oxygen in the exhaust gas, or the intake air temperature sensor 83, shown in FIG. 10. Further, the apparatus of the fourth embodiment does not have the idling speed controlling valve 86 or the bypass passage 85 accordingly. Other parts of the fourth embodiment are the same as corresponding parts of the second embodiment shown in FIG. 10.

Figure 28:
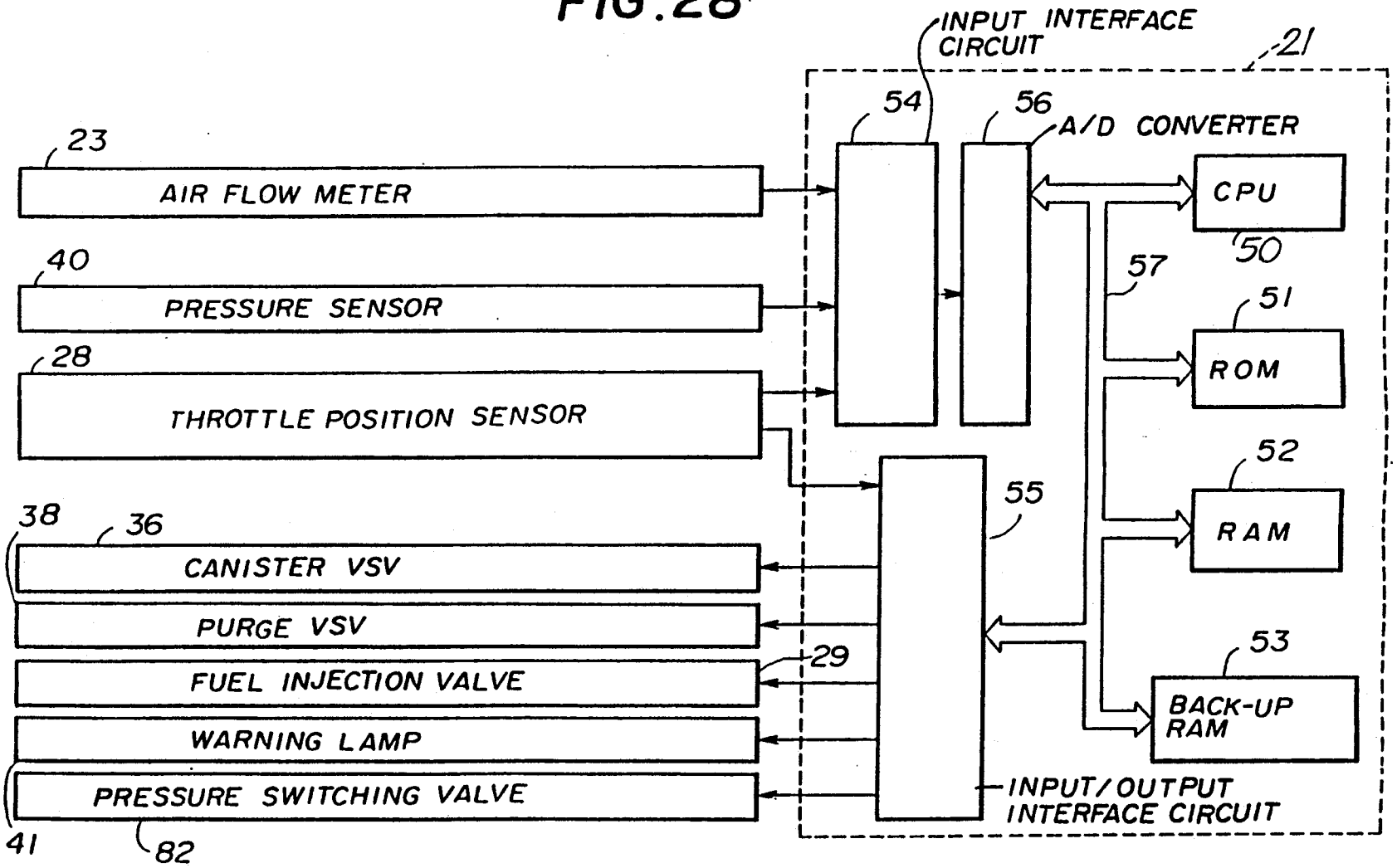
FIG. 28 is a block diagram of a microcomputer of the fourth embodiment shown in FIG. 27.

FIG. 28 is a block diagram of a microcomputer shown in FIG. 27. In FIG. 28, parts that are the same as parts shown in FIG. 11 are given the same reference numerals from figure to figure, and the description thereof will be omitted.

The micro computer 21 shown in FIG. 27 has the same structure as that shown in FIG. 11. However, signals from the air flow meter 23, the pressure sensor 40 and the throttle position sensor 28 are supplied to the input interface circuit 54; and signals from the pressure switching valve 82 are supplied to the input/output interface circuit 55. It should be noted that, as is apparent from the construction of the fourth embodiment, the input/output interface circuit 55 of the microcomputer 21 of the fourth embodiment is not connected to the ISCV 88 or to the rotation angle sensor 87 as they are not provided.

Figure 29:
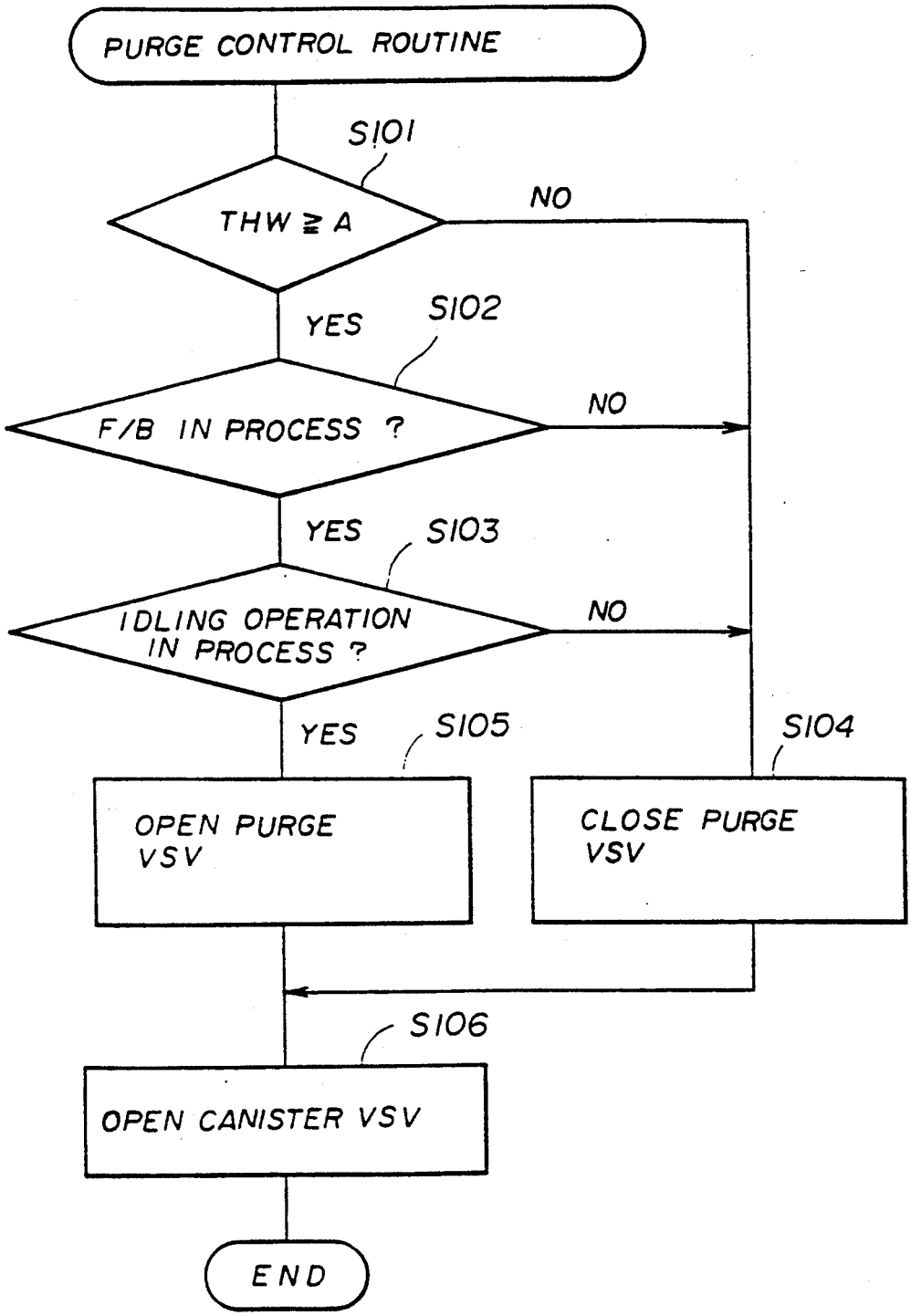
FIG. 29 is a flow chart of a purge control routine of the fourth embodiment according to the present invention.

Next, a description will be given, with reference to FIG. 29, of the evaporative fuel purging operation according to the present embodiment. The evaporative fuel purging operation is performed by the microcomputer 21 in accordance with the purge control routine shown in FIG. 29. This routine is executed in a part of the main routine.

In step S101 (hereinafter the word "step" is omitted), it is judged whether or not the cooling water temperature THW, supplied by a cooling water temperature sensor not shown in the figures, is equal to or greater than a predetermined value A. This process is provided for judging whether or not the engine has been warmed up. When THW is equal to or greater than the value A, the routine proceeds to S102 where it is judged whether or not the air-fuel ratio feedback operation is in process. When it is judged that the air-fuel ratio feedback operation is being performed, the routine proceeds to S103 where it is judged whether or not the engine is in the idling operation. When the engine is not in the idling operation, the routine proceeds to S104. In S104, the purge VSV 38 is closed, and then the routine proceeds to S106 where the canister VSV 36 is opened.

It should be noted that the routine proceeds to S105 where the purge VSV 38 is opened and then proceeds to S106 only when THW is less than the value A, the air-fuel ratio feedback operation is in process and the engine is in the idling operation. Namely, the purge VSV 38 is opened for performing the purge operation only when the all conditions in the above mentioned steps S101, S102, and S103 are established.

Next, a description will be given, with reference to FIGS. 30, of a malfunction detection process for the evaporative fuel purge system according to the fourth embodiment of the present invention.

Figure 30A:
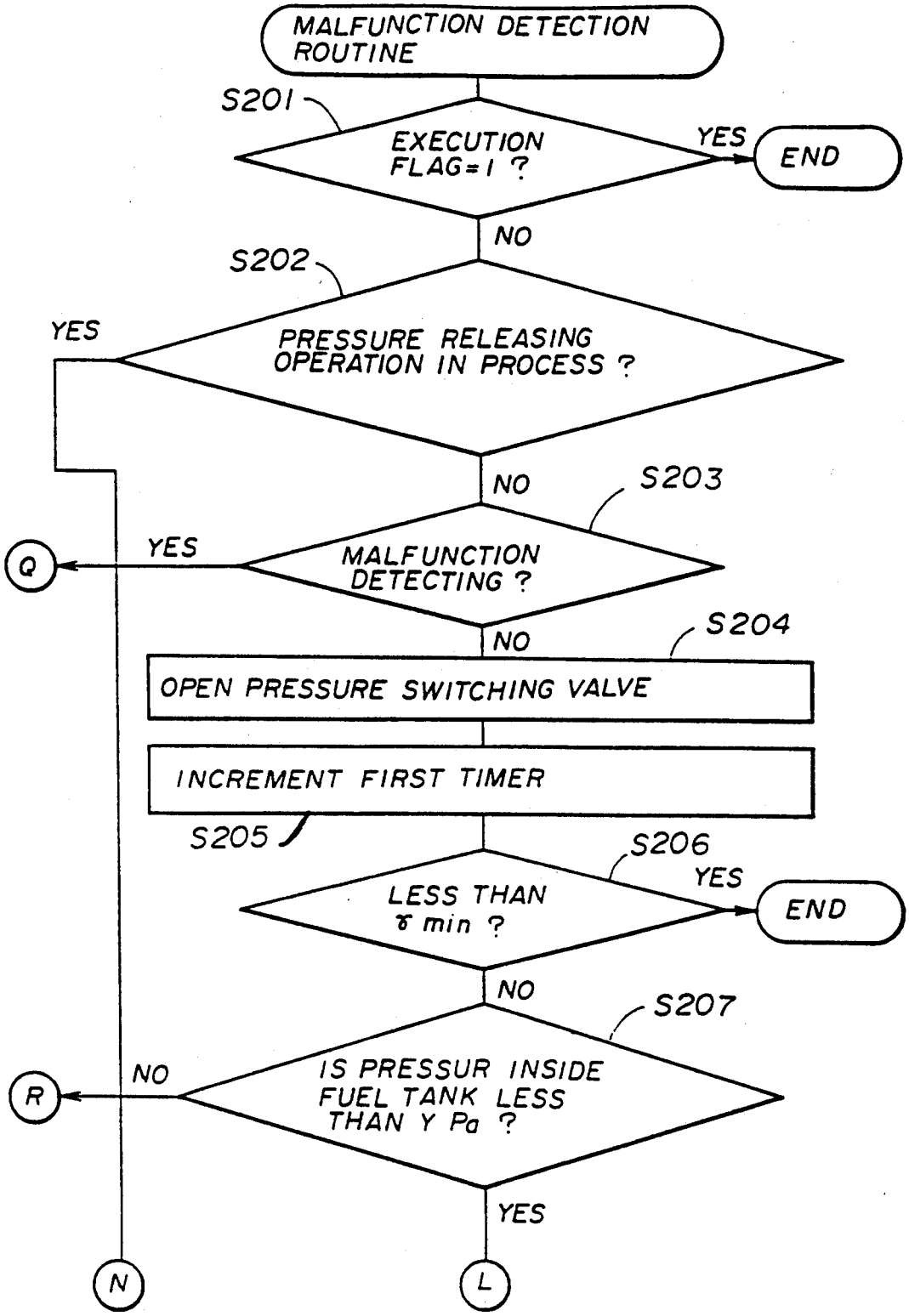
FIGS. 30A, 30B and 30C are parts of a flow chart of a malfunction detecting routine of the fourth embodiment according to the present invention.
Figure 30B:
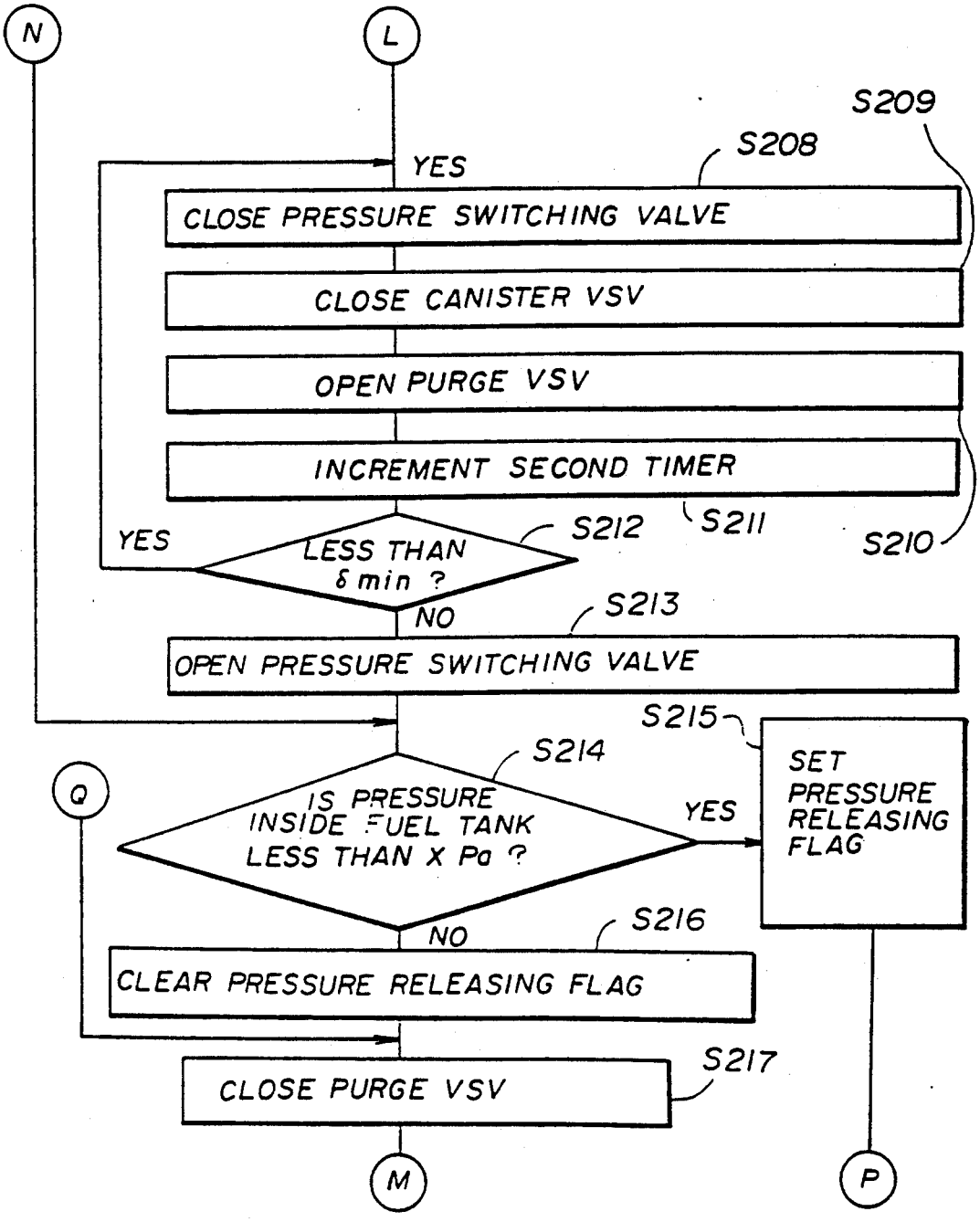
Figure 30C:
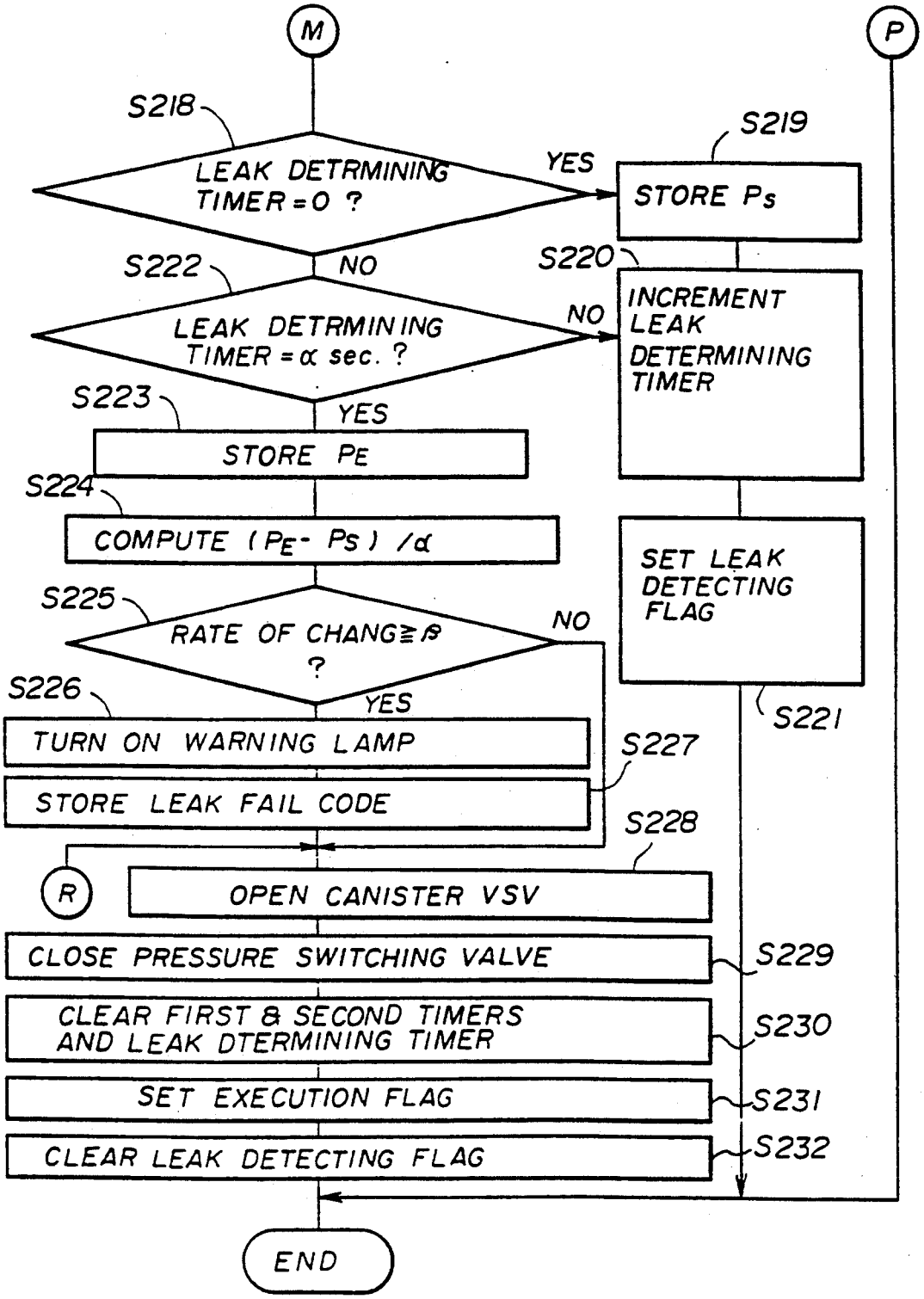

When a malfunction detection routine shown in FIGS. 30A, 30B, and 30C starts, for example every 65 ms, in S201, it is judged whether or not an execution flag is set to 1. Since the execution flag has been cleared to 0 by the initial routine at starting time of the engine, the routine proceeds to the next step S202.

In S202, it is judged whether or not the pressure releasing operation of the fuel tank 30 is in process by checking whether or not a pressure releasing flag is set. Since the pressure releasing flag is cleared in the initial routine, it is judged that the pressure releasing operation for the evaporative fuel purge system is not being performed, and the routine proceeds to S203.

In S203, it is judged whether or not a leak detecting flag, explained in the following, is set. Since this leak detecting flag is also cleared in the initial routine, the routine initially proceeds to S204 where the pressure switching valve is opened. Then in S205, a first timer is incremented, and in S206, it is judged whether or not the value of the first timer corresponds to $\tau$ minutes. When $\tau$ minutes have not elapsed since the opening of the pressure switching valve 82, the routine ends.

Figure 31:
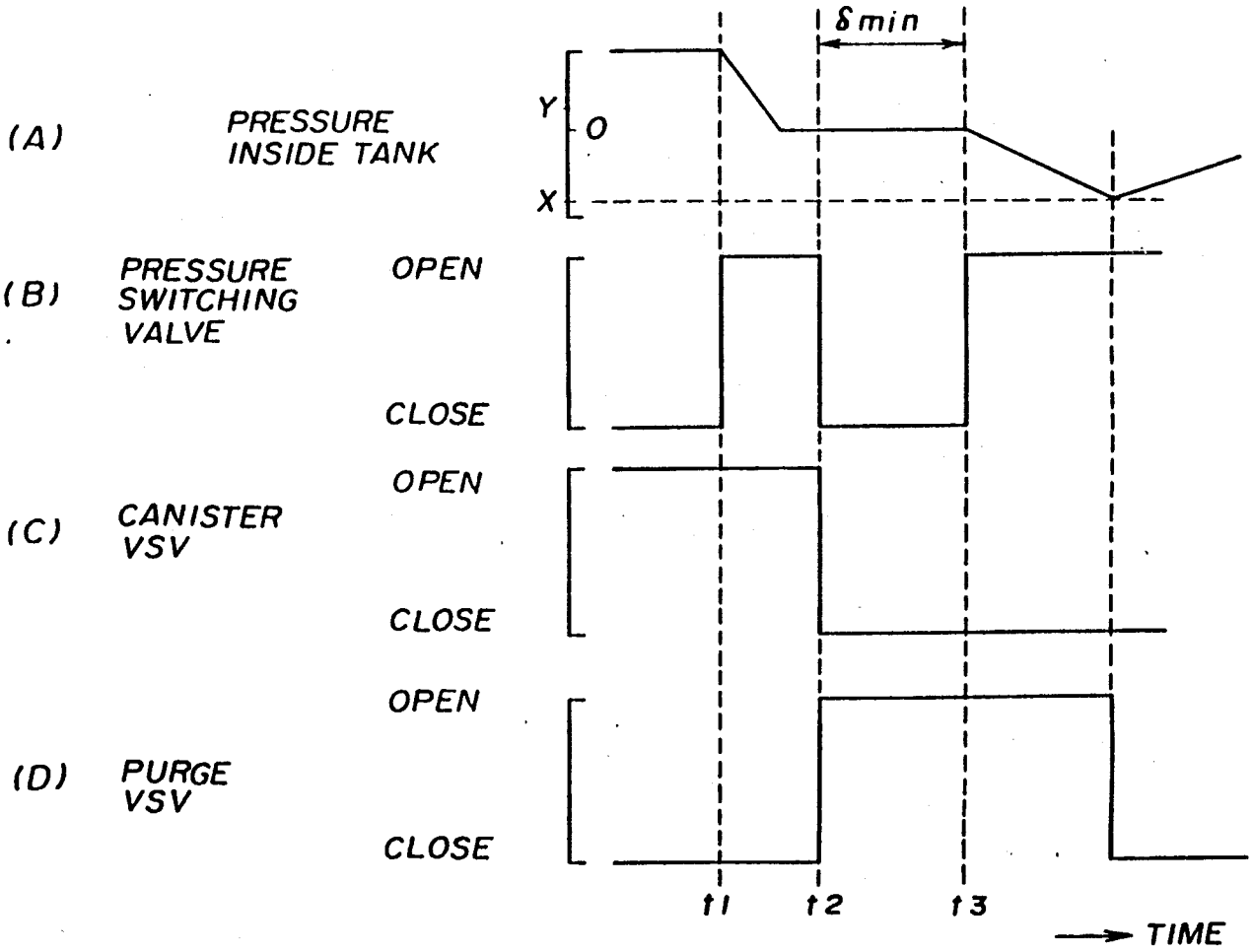
FIG. 31 is a time chart for explaining an operation of the malfunction detecting routine shown in FIG. 30.

If the opening of the pressure switching valve 82 is performed at time $t_1$, as indicated by (B) of FIG. 31, the fuel tank 30 is communicated with the air introducing port 36*a* via the vapor passages 32*d*, 32*c*, the pressure switching valve 82, the vapor passage 32*b*, the canister 33, and the canister VSV 36, as the canister VSV 36 is opened and the purge VSV 38 is closed at the time $t_1$ (as indicated by (C) and (D) of FIG. 31). Accordingly, the pressure inside the fuel tank 30, which has been controlled to be at a predetermined pressure by the pressure switching valve 82, is decreased to the atmospheric pressure starting from the time $t_1$ as indicated by (A) of FIG. 31.

After the routine has started a certain number of times, and when it is judged, in accordance with the first timer, that $\tau$ minutes have elapsed since the opening of the pressure switching valve 82 in S206, the routine proceeds to S207. In S207, it is judged whether or not the pressure in the fuel tank 30 is less than the predetermined pressure Y Pa, which is a positive pressure. The introduction of the negative pressure is started when the pressure inside the fuel tank has reached Y Pa.

If the pressure inside the fuel tank 30 is higher than Y Pa, it is determined that a large amount of fuel vapor has been generated and that there is no leakage in the system. In this case, it is considered that an accurate malfunction detection cannot be performed. Accordingly, the following processes are executed so as to not execute the malfunction detection operation until the next start of the engine. These steps are, S228 where the canister VSV 38 is opened, S229 where the pressure switching valve 82 is closed, S230 where the various timers are cleared, S231 where the execution flag is set, and S232 where the leak detecting flag is cleared. After execution of those steps S228 to S232, the routine ends.

If the pressure inside the fuel tank 30 is lower than Y Pa, that is, if the pressure inside the fuel tank 30 is between the pressure Y Pa and the atmospheric pressure, it is determined that a small amount of fuel vapor has been generated. In this case, it is considered that an accurate malfunction detection can be performed and thus the setting of the negative pressure is started.

In S208, the pressure switching valve 82 is closed, and in S209 the canister VSV 36 is also closed. In S210, the purge VSV 38 is opened. By executing the above steps, the negative pressure inside the surge tank 26 is introduced into the canister 33 via the purge passage 39, the purge VSV 38, and the purge passage 37; the negative pressure is further introduced into the vapor passages 32*a* and 32*b*. Accordingly, the pressure control valve 81 is closed due to the negative pressure introduced to the vapor passage 32*a*. Because the pressure switching valve 82 is closed in S208, the negative pressure is not introduced into the fuel tank 30.

As mentioned above, in the present embodiment, the negative pressure is introduced firstly into a part of the system, which part is from the purge VSV 38 to the vapor passages 32*a* and 32*b*. By this operation, the fuel vapor adsorbed by the activated carbon 33*c* is released and suctioned into the surge tank 26 by flowing through the purge passage 37, the purge VSV 38, and the purge passage 39. At this time, the fuel vapor inside the fuel tank 30 is not suctioned.

The closing of the pressure switching valve 82, the opening of the canister VSV 36, and the opening of the purge VSV 38 are performed at the same time $t_2$ as indicated by (B), (C), and (D) of FIG. 31.

Next, a second timer is incremented in S211, and in S212, it is judged that the value of second timer is less than a value corresponding to $\delta$ minutes.

Until $\delta$ minutes have elapsed since the time $t_2$, the steps S208 to S212 are repeated and the introduction of the negative pressure into the part of the system continues. Due to this procedure, the fuel vapor in the canister 33 is reduced to almost 0. In S213, the pressure switching valve 82 is opened at time $t_3$, as indicated by (B) of FIG. 31, when it is judged that $\delta$ minutes have elapsed since $t_2$. By this operation, the negative pressure is introduced into the entire system including the fuel tank 30.

Accordingly, after $t_3$, the fuel vapor in the fuel tank 30 is suctioned into the surge tank 26 while a part of the fuel vapor is adsorbed by the activated carbon 33*c* in the canister 33. The pressure inside the fuel tank 30 decreases as indicated by (A) of FIG. 31, when there is no leakage in the evaporative fuel purge system. The aforementioned pressure introducing means 10 shown in FIG. 1 comprises the pressure switching valve 82, the purge VSV 38, and the canister VSV 36 together with the operation performed in the above mentioned steps S208 to S213.

Next, in S214, it is judged whether or not the pressure inside the fuel tank 30 is less than a predetermined pressure X Pa. This pressure X Pa is determined such that the malfunction detecting operation is started when the pressure inside the fuel tank 30 reaches X Pa. When the pressure inside the fuel tank 30 is higher than the pressure X Pa, the pressure releasing flag is set in S215 so that the introduction of the negative pressure is continued, and the routine ends. Accordingly, the steps S201, S202, S214, and S215 are repeated every 65 ms until the pressure inside the fuel tank 30 decreased to a pressure lower than X Pa. When it is judged, in S214, that the pressure inside the fuel tank 30 is lower than X Pa, the pressure releasing flag is cleared in S216 and then, in S217, the purge VSV 38 is closed.

In the above step S217, if the closing of the purge VSV 38 is performed at time $t_4$ as indicated by (D) of FIG. 31, the purge VSV 38 and the canister VSV 36 are both in a closed condition. Accordingly, the system from The purge VSV 38 to the fuel tank 30 is in hermetic condition unless there is a malfunction in the system, and the pressure inside the system slowly increases toward atmospheric pressure. After the purge VSV 38 is closed in S217, a process of the aforementioned determining means 12 shown in FIG. 1 is executed in the following steps S218 to S225.

In S218, it is judged whether or not a leak-determining timer is set to 0. Since the leak-determining timer is cleared to 0 by the aforementioned initial routine, the routine proceeds to S219 the first time the step S218 is executed. In S219, the current value obtained by the pressure sensor 40 is set as a detection-start pressure value $P_S$ and the value is stored in the RAM 52.

Next, a predetermined value is added to the value of the leak-determining timer in S220, and the leak detection flag is set to 1 in S221, and then the routine ends. The next time the routine starts, the routine jumps the steps S204 to S216 and proceeds to S217, as it is judged that the leak detection flag is set to 1.

This time, since it is judged, in S218, that the leak-determining timer is not set to 0, the routine proceeds to S222 where it is judged whether or not the value of the leak-determining timer is equal to a value corresponding to a determination time $\alpha$ (a time for executing a leak determination). If the value is not equal to the value corresponding to the time $\alpha$, the routine ends after executing S220 and S221.

The steps S201 to S203, S217, S218, S222, S220, and S221 are executed every 65 ms. When the value of the leak-determining timer is equal to a value corresponding a determination time $\alpha$, a value obtained by the pressure sensor 40 is set as a detection-end pressure value $P_E$ and the value is stored in the RAM 52 in S223. Then in S224, a rate of change is computed as per a relationship represented by $(P_S-P_E)/\alpha$ by using the values $P_S$ and $P_E$ which are read out from the RAM 52.

Next, in S225, it is judged whether or not the rate of change is greater than or equal to a predetermined threshold value $\beta$. If the rate of change is greater than or equal to $\beta$, in S226, it is determined that a malfunction has occurred because there is a large leak, as the pressure change is rapid and the warning lamp 41 is turned on so as to warn the driver of an occurrence of the malfunction. After that, in S227, a leak fail code is stored in the back-up RAM 53, and the routine proceeds to S228. The leak fail code is used for checking a cause of the malfunction in a repair operation by reading the leak fail code out from the back-up RAM 53.

On the other hand, if the rate of change is less than $\beta$, the routine proceeds to S228 by jumping S226 and S227, as the leakage is less than the specified value. In S228, the canister VSV 36 is opened so that the system is released from the hermetic conditions. And in S229, the pressure switching valve 82 is closed so that the pressure control valve 81 is in effective operation.

By the above operation of the valves, the pressure inside the fuel tank 30 returns to a positive pressure in a short time via the atmospheric pressure as the air is introduced into the system via the air inlet port 36*a*.

After that, the leak-determining timer is cleared in S230, the execution flag is set to 1 in S231, the leak detection flag is cleared to 0 in S232 and the routine ends. In the future, this routine will not be executed until the engine is restarted because, in S201, it is judged that the execution flag is set to 1.

As mentioned above, according to the present embodiment, since the negative pressure is firstly introduced into a part of the evaporative fuel purge system excluding the fuel tank 30, the fuel vapor in the canister is firstly suctioned into the surge tank 26. After that, the negative pressure is introduced into the entire system including the fuel tank 30. Accordingly, the fuel vapor in the system is stepwise suctioned into the surge tank 26, and thus the fuel vapor suctioned at one time is reduced as compared to the conventional apparatus previously suggested by the current applicant. Therefore, a fluctuation of the air-fuel ratio at the time the malfunction detection is performed is suppressed and thus the exhaust emission is greatly reduced.

Figure 32:
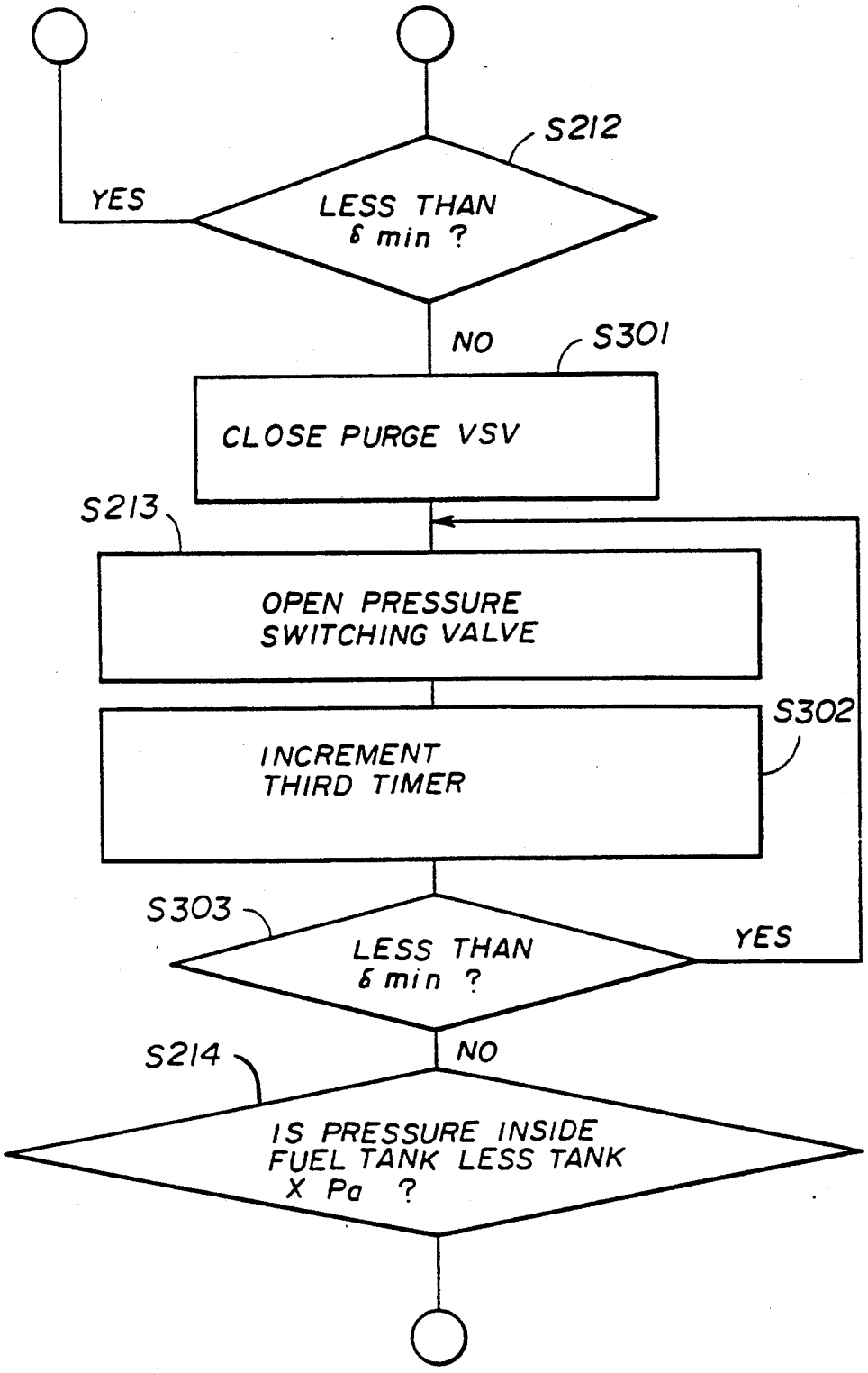
FIG. 32 is a part of a flow chart of a variation of the second embodiment of the malfunction detection routine.

FIG. 32 is a part of a flow chart of a variation of the second embodiment of the malfunction detection routine. In FIG. 32 steps that are the same as steps shown in FIGS. 30 are given the same reference numerals from figure to figure, and description thereof will be omitted.

The steps of the malfunction detection routine according to this variation of the fourth embodiment are the same as that of the fourth embodiment mentioned above except that this variation further includes the steps S301, S302, and S303. When the routine of this variation starts, the routine follows the same steps as the routine of the fourth embodiment until the routine reaches step S212 shown in FIG. 32A, where it is judged whether or not $\delta$ minutes have elapsed. When it is judged that $\delta$ minutes have have elapsed, the routine proceeds to S301, as shown in FIG. 32, where the purge VSV is closed, and then the routine proceeds to S213, which is the same step as in the routine of the fourth embodiment. In S213 the pressure switching valve is opened in order to introduce the negative pressure from the canister 33 into the fuel tank 30.

After executing S213, the routine proceeds to S302 where a third timer is incremented. In S303 it is judged whether or not a value of the third timer is less than $\theta$ minutes. If the third timer has a value less than $\theta$ minutes, the routine returns to S213. Accordingly, the routine does not proceed to S214 until $\theta$ minutes have elapsed since the time both the purge VSV 38 and the pressure switching valve 82 were opened. When it is judged, in S303, that $\theta$ minutes have elapsed, the routine proceeds to S214 and after that, the routine follows the same steps as in the routine of the fourth embodiment.

In the above variation, the negative pressure is temporarily stored in the canister 33 and then the negative pressure is introduced into the fuel tank after the purge VSV 38 is closed. Therefore, the fuel vapor in the fuel tank 30 is not directly suctioned into the surge tank 26.

The present variation has the same effects as that of the fourth embodiment.

It should be noted that the negative pressure introducing operation for performing the malfunction detection operation can be performed either when the engine is running in a driving operation condition or when the engine is running in an idling operation condition. In the case where the negative pressure is introduced in a driving operation condition, since fuel in the fuel tank is agitated due to the driving of the vehicle, and the temperature of the fuel in the fuel tank is raised, a relatively large amount of fuel vapor is generated in the fuel tank. Therefore, the pressure inside the fuel tank is decreased slowly, and thus it takes a relatively long time to build up a predetermined negative pressure inside the fuel tank.

Accordingly, when the negative pressure is introduced while the engine is in a driving operation condition (vehicle is running) and the evaporative fuel purge system is put in a hermetic condition, the pressure inside the system increases faster than when the negative pressure is introduced while the engine is in an idling operation.

In the meantime, when there is a leakage in the system, the pressure inside the system increases faster than under normal conditions due to air flows into the system. Therefore, it is difficult to distinguish the causes of a rapid pressure increase, that is, it is difficult to distinguish whether the pressure increase is caused by a leakage or by a generation of fuel vapor.

It is considered that if the malfunction detection operation is performed while the engine is in an idling operation condition, the difficulty is reduced as the generation of fuel vapor is small compared to that during a driving operation condition.

However, since the rotational speed of the engine in an idling operation condition is reduced and maintained at minimum by feedback control, suction air to the engine is less than that while in a driving operation condition. Therefore, a small amount of fuel vapor suctioned in the surge tank affects the air-fuel ratio more than while in driving operation conditions where a greater amount of air is suctioned into the engine. Namely, if the same amount of fuel vapor is suctioned into the surge tank, the air-fuel ratio in an idling operation condition is shifted to the rich side.

In order to eliminate the above mentioned disadvantage, it is considered to provide a suction-air amount increasing means for increasing a suction air amount for the engine. This suction-air amount increasing means increases the air amount suctioned into the engine while the purge VSV is opened to introduce the negative pressure into the evaporative fuel purge system. For example, the suction-air amount increasing means is realized by providing means for increasing an idling speed for a predetermined period of time immediately after the introduction of negative pressure into the system has started. The idling speed is returned to the normal speed after most of the fuel vapor in the evaporative fuel purge system including the fuel tank has been suctioned. According to the provision of the suction-air amount increasing means, the malfunction detection operation can be performed even while the engine is in an idling condition without a large fluctuation of the air-fuel ratio.

The present invention is not limited to the specifically disclosed embodiments, and variations and modifications may be made without departing from the scope of the present invention.

What is claimed is:

1. A malfunction detection apparatus for detecting a malfunction in an evaporative fuel purge system having a fuel tank storing an amount of fuel, a vapor passage connecting said fuel tank and said canister, a purge passage through which said fuel vapor stored in the canister is purged into an intake passage of an engine, and a purge control valve provided in said purge passage to allow a purge operation by opening of the purge control valve, the malfunction detection apparatus comprising:

a pressure introducing means for introducing a negative pressure from the intake passage of the engine into said evaporative fuel purge system;

a pressure detecting means for detecting a pressure inside said evaporative fuel purge system when the negative pressure is introduced into the system by said pressure introducing means;

an air-fuel ratio fluctuation suppressing means for suppressing a fluctuation of the air-fuel ratio of mixture gas suctioned into the engine which results from suctioning of the fuel vapor collected in the fuel tank, the suppression being effected by controlling said pressure introducing means when the negative pressure is introduced into said evaporative fuel purge system by said pressure introducing means;

a determining means for determining the existence of a malfunction in said evaporative fuel purge system by monitoring a pressure in said evaporative fuel purge system, said monitoring using values supplied by said pressure detecting means.

2. The malfunction detection apparatus as claimed in claim 1, further comprising a control valve connected to an air inlet port of said canister so as to open or close said air inlet port, wherein:

said pressure introducing means comprises a valve controlling means for controlling said control valve and said purge control valve, the negative pressure inside said intake passage being introduced into said evaporative fuel purge system by closing said control valve and opening said purge control valve;

said air-fuel ratio fluctuation suppressing means comprising a fuel vapor concentration computing means for computing a concentration of fuel vapor suctioned into said intake passage when said purge control valve is opened to introduce the negative pressure, and a stopping means for stopping the introduction of the negative pressure by opening said control valve when a concentration of said fuel vapor is equal to or greater than a predetermined value, said determining means closes said control valve and said purge control valve when the concentration of said fuel vapor is less than a predetermined value in order to start a malfunction detection operation.

3. The malfunction detection apparatus as claimed in claim 2, wherein said fuel vapor concentration computing means computes a concentration of said fuel vapor by using an air-fuel ratio feedback correction factor computed by using signals from an oxygen sensor provided on an exhaust gas passage for detecting a concentration of oxygen contained in an exhaust gas of the engine.

4. The malfunction detection apparatus as claimed in claim 2, wherein said determining means determines the existence of a malfunction in said evaporative fuel purge system by comparing a rate of pressure change inside said evaporative fuel purge system over a predetermined period of time with a predetermined value, said rate of pressure change being obtained by using pressure values detected and supplied by said pressure detecting means.

5. The malfunction detection apparatus as claimed in claim 1, wherein said air-fuel ratio fluctuation suppressing means comprises a fuel amount detecting means for detecting whether or not a fuel amount stored in said canister has become less than a predetermined value, said pressure introducing means starting the introduction of the negative pressure in accordance with the detection performed by said fuel amount detecting means.

6. The malfunction detection apparatus as claimed in claim 5, further comprising an orifice provided to said vapor passage so as to limit a flow rate of fuel vapor flowing out from said fuel tank when the negative pressure is introduced by said pressure introducing means.

7. The malfunction detection apparatus as claimed in claim 5, further comprising an orifice provided to a passage provided between said fuel tank and said purge passage so as to limit a flow rate of fuel vapor flowing out from said fuel tank when the negative pressure is introduced by said pressure introducing means.

8. The malfunction detection apparatus as claimed in claim 5, wherein said fuel amount detecting means determines whether or not a fuel amount stored in said canister has become less than a predetermined amount when a predetermined time has elapsed since said purge control valve was opened to start the purge operation.

9. The malfunction detection apparatus as claimed in claim 8, wherein the opening and closing of said purge control valve is controlled by using a duty-ratio and the elapsed time is weighted by a predetermined value in correspondence to a duty-ratio used for the opening of said purge control valve.

10. The malfunction detection apparatus as claimed in claim 5, wherein operation of said purge control valve is controlled using a duty ratio control, which duty ratio changes in response to the air-fuel ratio; and wherein said fuel amount detecting means determines that a fuel amount stored in said canister has become less than a predetermined value when the duty ratio reaches 100%.

11. The malfunction detection apparatus as claimed in claim 5, wherein a purge learning operation which determines the quantitative relationship between the amount of the fuel vapor purged and an air-fuel ratio is prohibited while the negative pressure is being introduced into said evaporative fuel purge system.

12. The malfunction detection apparatus as claimed in claim 5, wherein said determining means determines existence or nonexistence of a malfunction in said evaporative fuel purge system by comparing a rate of pressure change inside said evaporative fuel purge system over a predetermined period of time with a predetermined value, said rate of pressure change being obtained by using pressure values detected and supplied by said pressure detecting means.

13. The malfunction detection apparatus as claimed in claim 1, wherein said air-fuel ratio fluctuation suppressing means controls said pressure introducing means so that the negative pressure is introduced into said fuel tank via said canister so that the fuel vapor in said fuel tank flows through an adsorbent contained in said canister.

14. The malfunction detection apparatus as claimed in claim 13, wherein said pressure introducing means comprises a second purge passage connecting an air inlet port of said canister with said intake passage, and a control valve provided on said second purge passage so as to open or close said second purge passage, the negative pressure inside said intake passage being introduced into said canister via said second purge passage and said control valve when said control valve is opened.

15. The malfunction detection apparatus as claimed in claim 13, wherein said determining means determines existence or nonexistence of a malfunction in said evaporation fuel purge system by comparing a rate of pressure change inside said evaporative fuel purge system over a predetermined period of time with a predetermined value, said rate of pressure change being obtained by using pressure values detected and supplied by said pressure detecting means.

16. The malfunction detection apparatus as claimed in claim 1, wherein said air-fuel ratio fluctuation suppressing means controls said pressure introducing means so that the negative pressure is introduced into said fuel tank a predetermined period of time after the introduction of the negative pressure into said evaporation fuel purge system excluding said fuel tank.

17. The malfunction detection apparatus as claimed in claim 16, wherein said air-fuel fluctuation suppressing means closes said purge control valve when the negative pressure is introduced into said fuel tank so that only the negative pressure stored inside said evaporative fuel purge system excluding said fuel tank is applied to said fuel tank.

18. The malfunction detection apparatus as claimed in claim 16, wherein said determining means determines existence or nonexistence of a malfunction in said evaporative fuel purge system by comparing a rate of pressure change inside said evaporative fuel purge system over a predetermined period of time with a predetermined value, said rate of pressure change being obtained by using pressure values detected and supplied by said pressure detecting means.

* * * * *

UNITED STATES PATENT AND TRADEMARK OFFICE
CERTIFICATE OF CORRECTION

PATENT NO. : 5,315,980

DATED : May 31, 1994

INVENTOR(S) : Taksyuki OTSUKA, et al.

It is certified that error appears in the above-identified patent and that said Letters Patent is hereby corrected as shown below:

Column 3, line 2, after "system" insert a comma.

Column 3, line 22, delete "of" at end of line.

Column 3, line 35, change "FIGS. 5;" to --FIGS. 5A and 5B;--.

Column 7, line 60, change "power-ip" to --power-up--.

Column 8, line 13, change "KI" to --K1--.

Column 8, line 25, change "KI" to --K1--.

Column 9, line 34, change "processes," to --process--.

Column 12, line 5, change "passages" to --passage--.

Column 24, line 25, delete "of".

Column 14, line 68, after "Accordingly," insert --the--.

Column 15, line 55, change "computer" to --computed--.

Column 16, line 56, change "form" to --from--.

Column 17, line 60, change "ration" to --ratio--.

UNITED STATES PATENT AND TRADEMARK OFFICE

CERTIFICATE OF CORRECTION

PATENT NO. : 5,315,980

DATED : May 31, 1994

INVENTOR(S) : Taksyuki OTSUKA, et al.

It is certified that error appears in the above-identified patent and that said Letters Patent is hereby corrected as shown below:

Column 18, line 5, after "embodiment" insert --is--.

Column 18, line 39, change "FAFVA," to --FAFAV--.

Column 19, line 21, delete "that".

Column 21, line 53, change "maintain in constant" to --maintained at a constant level--.

Column 24, line 3, change "read" to --reading--.

Column 25, line 65, delete "the" before "all".

Column 27, line 40, insert --to-- after "sponding".

Column 31, line 11, change "decreased" to --decreases--.

Column 31, line 51, insert --to-- after "ing".

Column 32, line 46, delete one "have".

UNITED STATES PATENT AND TRADEMARK OFFICE

CERTIFICATE OF CORRECTION

PATENT NO. : 5,315,980

DATED : May 31, 1994

INVENTOR(S) : Taksyuki OTSUKA, et al.

It is certified that error appears in the above-identified patent and that said Letters Patent is hereby corrected as shown below:

Column 36, line 26, change "evaporation" to --evaporative--.

Column 36, line 27, change "evaporation" to --evaporative--.

Column 36, line 38, change "evaporation" to --evaporative--.

Signed and Sealed this

Eighth Day of November, 1994

*Attest:*

*Attesting Officer*

Bruce Lehman

BRUCE LEHMAN

*Commissioner of Patents and Trademarks*